US005632614A

United States Patent [19]

Consadori et al.

[11] Patent Number: 5,632,614

[45] Date of Patent: May 27, 1997

[54] GAS FIRED APPLIANCE IGNTION AND COMBUSTION MONITORING SYSTEM

[75] Inventors: Franco Consadori, Salt Lake City; D. George Field, Pleasant Grove; Kevin D. Banta; Gary S. Nichols, both of Sandy, all of Utah

[73] Assignee: Atwood Industries , Inc., Rockford, Ill.

[21] Appl. No.: 499,420

[22] Filed: Jul. 7, 1995

[51] Int. Cl.[6] ..... F23N 5/08

[52] U.S. Cl. ..... 431/79; 431/74; 431/63; 431/66

[58] Field of Search ..... 431/79, 74, 62, 431/63, 66

[56] References Cited

U.S. PATENT DOCUMENTS

| | | | |
|---|---|---|---|
| 2,840,146 | 6/1958 | Ray | 431/79 |
| 3,902,841 | 9/1975 | Horn | 431/79 |
| 3,903,418 | 9/1975 | Horn | 250/338 |
| 3,975,137 | 8/1976 | Hapgood | 431/78 |
| 4,435,149 | 3/1984 | Astheimer | 431/12 |
| 4,505,668 | 3/1985 | DiBiano et al. | 431/202 |
| 4,595,353 | 6/1986 | de Haan | 431/263 |
| 4,778,378 | 10/1988 | Dolnick et al. | 431/79 |
| 4,878,831 | 11/1989 | Ewing | 431/79 |
| 4,898,531 | 2/1990 | Goldstein et al. | 431/79 |
| 4,927,350 | 5/1990 | Zabielski | 431/12 |
| 4,976,608 | 12/1990 | Hyde | 431/202 |
| 5,052,661 | 10/1991 | Dunlay et al. | 266/87 |
| 5,111,048 | 5/1992 | Devitt et al. | 250/342 |
| 5,112,217 | 5/1992 | Ripka et al. | 431/12 |
| 5,245,196 | 9/1993 | Cabalfin | 250/554 |
| 5,281,243 | 1/1994 | Leininger | 44/629 |
| 5,322,216 | 6/1994 | Wolter et al. | 236/25 |
| 5,332,386 | 7/1994 | Hosome et al. | 431/12 |

*Primary Examiner*—Carroll B. Dority
*Attorney, Agent, or Firm*—Workman, Nydegger & Seeley

[57] ABSTRACT

A gas fired appliance measures infrared emissions from a metal object heated in a combustion chamber to evaluate combustion. Associated circuitry uses the evaluation to control operational parameters of the appliance, including fuel and air fed to the appliance. A second metal object, prior to fuel ignition, is electrically heated to emit infrared radiation. Infrared emissions from the second metal object, indicative of the temperature thereof, are monitored to assure an ignition temperature to ignite a combustible air and fuel mixture. A fan directs a stream of ambient air upon the second metal object to cool the same and reduce the infrared emanating therefrom. The reduction in infrared from the second metal object is monitored to verify proper fan operation.

39 Claims, 27 Drawing Sheets

GAS FIRED APPLIANCE IGNTION AND COMBUSTION MONITORING SYSTEM

A portion of the disclosure of this patent document contains material to which a claim of copyright protection is made. The copyright owner has no objection to the reproduction by anyone of the patent document or the patent disclosure as it appears in the Patent and Trademark Office patent file or records, but reserves all other rights with respect to the copyrighted work.

BACKGROUND

I. Field of the Invention

This invention relates to fuel gas ignition and combustion monitoring systems, and more particularly to a system and method which utilize an electronically monitored ignition and combustion monitoring device for controlling the operation of a gas fired appliance.

II. Background Art

Fuel gas is used in a wide range of gas fired appliances including ranges, stoves, gas refrigerators, barbecue pits, gas fired fireplaces, clothes dryers and water heaters. A conventional mechanism for igniting the fuel supplied to the gas fired appliances is a high voltage spark created by a spark generator. In spark ignition, two separated conductors have a voltage potential difference therebetween sufficient to induce a spark to jump the gap separating the two conductors. A third rod is engulfed in the flames of combustion and is used by the conductivity thereof to ascertain ongoing combustion. The conductivity of the air and third rod within the combustion envelope verifies that combustion is ongoing.

A problem known to spark generation equipment is the large draw of power required to make the spark jump the gap. This is particularly true if, by some happenstance, the gap size is increased between the two conductors. Additionally, the spark causes electromagnetic interference which tends to be a nuisance to radios, television sets, personal computers, and other electronic appliances in the area. In light of such a problem with spark ignition systems, it would be an advance in ignition systems for gas fired appliances to provide an ignition system that meets both conventional and developing telecommunication standards for electromagnetic interference omission.

Gas fired appliances are frequently controlled by microprocessors. Such microprocessors can be interfered with by spark generators. Additionally, the high voltages characteristics of spark generation can be deleterious to semiconductors in the control system of the appliance, as such high voltages can lead to the breakdown of semiconductor parts therein. Thus, the reliability of semiconductor components for controlling gas fired appliances may be jeopardized.

Another problem known to spark generators for the ignition of gas fired appliances is that the spark that is generated is consistent in both standard magnitude and size for an average environment of relative humidity. Consequently, in very high ambient relative humidity, the spark being generated may be insufficient to cause proper ignition of the fuel gas. Particulates in the air, accumulations of soot, and variations in altitude, in addition to the foregoing, can hinder spark generation and the ignition of the fuel gas.

An option to spark ignition for gas fired appliances is circuit ignition using a hot carbide surface, such as silicon carbide. Circuit ignitions are, however, typically more expensive than spark ignition systems. Carbides used for hot surface ignition of combustible fuel gases can withstand very high temperatures, have a high melting point, and are corrosion resistant. A difficulty with such hot surface ignition systems is the necessity of having to bond or otherwise weld the carbide to a metallic system that conducts electricity. This type of welding is necessary to electrically resistance heat the carbide, but is both expensive and difficult in that it requires very high temperatures to accomplish. Further, the carbide providing the hot surface ignition tends to be quite brittle and thus frangible and unreliable in physically non-fragile environments, such as is known to recreational vehicle appliances.

From the foregoing, it can be seen that it would be an advance in gas fired appliance ignition art to provide an ignition system that is inexpensive, does not cause electromagnetic interference with controllers of the gas fired appliance, and withstands heavy-duty use without breaking.

Gas fired appliances may have an ignition and combustion system that is regulated by a controller that causes the correct order, correct timing, and safety features thereof to be cooperating as subsystems of the appliance. Such modem gas fired appliances consist of a gas supply system, an ignition and combustion verification system, a safety cut-off valve to the gas supply system, and a heat extraction or heat exchange system. It is the goal of such controllers to provide transparent operation of the gas fired appliance to the user. By way of example, such a controller may control the combustion mix of air and fuel gas so that it is neither too lean nor too rich, but rather combusts most efficiently. Such a controller may regulate the operation of an electrically activated solenoid valve which opens and closes the gas flow to the appliance so that the right amount of gas at the right velocity is mixed into the combustion area or mixing space for combustion.

In the case of furnaces and other gas fired appliances requiring an air delivery system, a blower fan may also be operated by a controller. Should there ever be an extinguishment of combustion, a blower fan may be operated by the controller so as to purge the combustion area free of combustible fuel gas and thereby prevent a build up of same and a subsequent explosion. When the controller operates the blower fan following extinguishment of a flame, a safety timing period is provided between the receipt of the controller of a request of a thermostat to start opening the gas valve, and the subsequent opening of the gas valve supplying fuel gas to the combustion area. Thus, the controller may control the timing of the actual delivery and purging of the combustible fluid contents of the combustion area.

Another important function which may be controlled by a controller, and may also be accomplished by mechanical systems, is that of a sail switch which measures air flow to the combustion area. A sail switch is a mechanical switch that is switched on or off by the flow or non-flow of air. The switch signals the controller to turn off the supply of fuel gas if air flow to the combustion area has been terminated. By way of example, an obstruction in the air intake to the blower fan may cause a rich fuel gas mixture in the combustion area due to an absence of air coming through the air intake. A sail switch would prevent such a problem by giving an indication of air intake malfunctioning, which indication is acted on by the controller to prevent the fuel gas from flowing into the combustion chamber. Thus, gas is not combusted in the case where air is not being provided to the combustion area, or is not being provided so as to remove heat from the combustion chamber. The sail switch helps to indicate that air is flowing to reduce the heat of combustion, and thus prevent the burning up of heat exchanger components of the gas fired appliance.

In short, the sail switch is an anemometer to measure the amount of air that is being delivered to the combustion area. The sail switch, by its function of assuring that the appliance will not operate without a proper air flow to the combustion chamber, prevents a typical problem of air flow blockage or redirections of the air which may in turn cause the flames of redirection of the flames of combustion to be redirected to an area that is hazardous to the appliance.

While prior art sail switch techniques have been widely used with success, there is still a serious risk of human error when using such systems. The sail switches used on such gas fired furnaces are often prone to mechanical failure due to environmental conditions, and due to corrosion over time as the appliance ages. Thus, improper sail switch operation may occur. Accordingly, there is a need for a gas fired appliance that safely and accurately acknowledges a proper in take of air to the combustion area so as to assure that a flue is not blocked. The system and method of the present invention provide an effective solution to these problems which has not heretofore been fully appreciated or solved.

A controller for a gas fired appliance may also be in electrical communication with a limit switch or ECO. The ECO switch cuts off power so as to close the gas supply valve whenever certain critical areas of the appliance reach a maximum tolerable temperature. In the case of furnaces and other gas fired appliances having a blower fan to the combustion chamber, a timing relay is also operated in conjunction with the ECO so that there is a purging of the gas combustion area following the shut off of electrical power to the appliance.

An ignition control board or other appliance controller device, incorporates the foregoing functions of monitoring the ignition, combustion, and ongoing operation of a gas fired appliance. It would be an advance in art to provide a safe and reliable integrated ignition and combustion control system that overcomes foregoing problems while intercoordinating typical functions provided by a gas fired appliance.

BRIEF SUMMARY AND OBJECTS OF THE INVENTION

The system and method of the present invention have been developed in response to the present state of the art, and in particular, in response to the problems and needs in the art not heretofore fully or completely solved by ignition and combustion systems for gas fired appliances. It is not intended, however, that the system and method of the present invention will necessarily be limited solely to ignition and combustion control, since they will also find useful application with potentially many kinds of gas fired appliances which require the control of various operational aspects, including temperature regulation, burn efficiency, and operational communications. Thus, it is an overall object of the present invention to provide a system and method which provide for the safe and efficient operation of a gas fired appliance.

Another important object of the present invention is to provide a system and method whereby state of the art electronic technology can be utilized to assist the safe and efficient operation of a gas fired appliance.

Another important object of the present invention is to provide a gas ignitor system and method of electronic monitoring fuel gas ignition which increases the convenience and safe utilization of gas fired appliances in general.

These and other objects and features of the present invention will become more fully apparent from the following more detailed description taken in conjunction with the drawings and claims, or may be learned by the practice of the invention.

Briefly summarized, the foregoing and other objects are achieved in an electronically monitored ignition system and method for combustible gases used in gas fired appliances. By way of example, such appliances include ranges, stoves, gas refrigerators, or gas appliances in general. The novel ignition and combustion control system and method is capable of igniting combustible gases as well as detecting a flame resulting from such ignition.

The ignition and flame sensing system is used in a heat exchange system that employs a fuel-to-air mixing mechanism. The gas mixture is fed to an electrically heated solid material providing a hot surface ignition for the mixture. The hot surface ignition on the electrically heated solid material produces a flame by combustion of the fuel. Energy of the flame from the combustion heats a solid material that emits radiation when heated. The flame heated solid material may be the same as, or different from, the electrically heated solid material.

Radiation from the solid material is detected by an infrared sensor and is monitored by associated circuitry. The infrared sensor may be focused to detect radiation from either or both of the electrical and flame heated solid material. As mentioned, the electrical and flame heated solid materials may also be one and the same. Alternately, multiple infrared sensors with associated circuitry may also be provided to focus on a separate one of the electric or flame heated solid materials.

Radiation emitted from the electric or flame heated solid materials is indicative of the temperature of the solid material. The temperature of the solid material is effected by the degree of its electrical or flame heating. As such, circuitry associated with the infrared sensor can verify that the electrically heated solid material is both operational and hot enough to function in hot surface ignition. Additionally, the infrared sensor and associated circuitry can prove that combustion was successfully achieved by the electrically heated solid material serving as a point of hot surface ignition.

The temperature of the electrically heated solid material can be lowered by the degree to which an air flow engulfs the same so as to lower its temperature by a cooling off effect. As such, the infrared sensor and associated circuitry can verify that a blower fan associated with the gas fired appliance is being properly operated so as to cause a proper air flow into a combustion chamber in which the electrically heated solid material is also situated.

The temperature of the flame heated solid material can be affected by the existence and efficiency of the flame that heats the solid material. The degree of infrared radiation being emitted by the flame heated solid material is indicative of how efficient the burning of the flame is, as well as being indicative of the temperature of the combustion area. Such efficiency of radiation emission may be effected by a poor air-to-fuel mixture due to a blockage in air intake, contaminated fuel gas, and atmospheric conditions including air borne particulates and high relative humidity, any one on combination of which may lower the efficiency of the combustion and thus the emission of radiation that is detected and verified by the infrared sensor and it associated circuitry.

A further capability of the one or more infrared sensors in the inventive method and system is the ability to detect excessive infrared emission characteristic of weakening or failing structural material of the gas fired appliance, such as a broken seam or a hole in a combustion chamber of a gas fired furnace. Weakened materials that are heated, such as sheet metal, give off excessive infrared energy during failure.

In general summary, the inventive method and system coordinates on-going combustion by the detection of infrared emissions emanating from a solid material engulfed within and being heated by a flame of combustible gas, where an infrared sensor is focused by line of sight upon the solid material that is emitting infrared radiation in proportion to the temperature of the solid material, the solid material being heated by a flame in a combustion area, the flame heated solid material being constant in surface area and composition, and upon which an infrared sensor is focused for the purpose of evaluating the presence and efficiency of the combustion of combustible fuel, the circuitry associated with the infrared sensor receiving a signal from the infrared sensor and using such signal for verifying the presence and continuity of a flame in a combustion area, which radiation is monitored by the infrared sensor as a means of deriving therefrom the presence and efficiency of the combustion of a combustible gas that is used to heat the infrared radiating solid material, where the monitored efficiency of combustion is used by the circuitry associated with the one or more infrared sensor(s) to control operational parameters including the input of fuel and air to the combustion chamber.

The circuitry associated with one or more infrared sensors of the inventive system may be characterized as an electronic circuit means or a controller. The controller is responsive to a control signal produced by the infrared sensor for controlling a valving means which supplies fuel to the combustion chamber.

Aspects of the inventive method and system relating to the ignition of combustible fuel may be considered as separate functional aspects relating to on-going combustion of the combustible fuel.

Structurally, in a preferred embodiment, the inventive ignition and combustion control system consists of two rods which are connected together by a first filament material. Preferably, although optionally, the first filament material is made from KANTHAL™. This material is basically an aluminum and nickel alloy that has a high melting point. Alternatively, the material may be stainless-steel with an aluminum silicone additive such that its melting point is high (i.e. above 1,200 degrees Fahrenheit).

The first filament material is wrapped with four or five turns around each of the two rods, and is then welded using spot welds to the two rods. The proper electrical resistance for hot surface ignition of combustible gas in the system is determined as a function of the number of turns in the first filament material between the two rods. In this way, the hot surface ignition area on the first filament material can be optimized for the combustible gas having contact therewith as an electrical current resistance heats the first filament material between the two rods. Preferably, the first filament material is within the line of sight of the infrared sensor.

Preferably, one of the two rods is longer than the other and may have welded at or near an end thereof a second filament material that is coiled or wrapped there around. When so wrapped, the larger rod act as a heat sink for the second filament material. Alternatively, the longer rod can be either straight or bent at an angle without a second filament material wrapped there around, yet still extend beyond the length of the shorter rod. Regardless of the form of the larger rod, it is intended that the end extending past the end of the shorter rod be within the line of sight of the infrared sensor and also be heated by a flame in the combustion area of the appliance which is the product of the combustion of the fuel gas.

Both the first filament material between the two rods and the second filament material at an end of the longer rod are preferably of low thermal mass and have a rapid response to heating such that infrared emissions can be detected by a relatively inexpensive infrared sensor. The longer of the two rods, when lacking a second filament material, may be composed of materials having a rapid response to emit infrared radiation through heating, such as KANTHAL™. The geometry of end of the longer rod may also be thinned to have a low thermal mass so as to give a rapid infrared radiation emission upon heating of the sallie.

The first filament material extending between the two rods, referred to herein as the first radiator, is initially heated with an electrical current passed therebetween. The electrical current passing through the first radiator causes the first radiator to be raised to an ignition temperature for the combustible gas. The elevated temperature of the first radiator, acting as a hot surface ignitor, ignites the combustible gas. The inventive ignition system is capable of verifying that the first radiator is hot enough to ignite the combustible gas by detecting emissions of infrared radiation emanating from the first radiator material due to the resistance heating thereof.

In an alternative embodiment, the next step following resistance heating of the first radiator is to actuate a blower fan to direct a stream of air into a combustion area where the resistance heated first radiator is located. The stream of air causes a slight cooling of the first radiator. This cooling is detected by a decrease in infrared radiation being emitted by the first radiator, which decrease is detected by the infrared sensor and associated circuitry. Such a decrease in the emission of infrared radiation is an indication that the blower fan is properly delivering air into the combustion area. Such a embodiment is preferred in confined areas of combustion for the fuel gas, such as is found in gas fired furnaces.

Upon verification of achieving the ignition temperature by the first radiator, the current between the rods is cut off, the first radiator cools down, and the appliance is controlled to supply additional combustible gas to the flame. In some preferred embodiments of the inventive system and method, the flow of combustible gas tends to shift and extend the length of the flame to engulf the length of the longer rod extending beyond the shorter rod, which length may have the second filament material thereon. The extended flame causes the extended length of the second rod, and/or second filament material thereon, to heat up.

Upon heating by the combustion flames, the extended length of the second rod, and/or second filament material, these being referred to herein as the second radiator, begins to emit infrared energy which is then detected by the infrared sensor and it associated circuitry. Once the flame is shifted in position and elongated by a supply of gas and air mixture that is under greater pressure that the initial ignition pressure, the first radiator is no longer resistance heated or within the times of the combustible gas. Thus, the infrared sensor substantially detects only infrared energy being emitted by the second radiator, as the first radiator is no longer resistance heated or within the heating zone of ongoing combustion.

Henceforth, the infrared sensor witnesses the on-going combustion of combustible gases as evidenced by the emission of infrared energy from the second radiator. As such, the second radiator serves as the solid material object upon which the infrared sensor focuses so that its associated circuitry can verify the presence of a flame of combustible gas or the absence thereof. The infrared sensor and circuitry also verifies, by the intensity of infrared radiation, a measure of bum efficiency of the combustible fuel as well as ascertaining potential material failure and weakening of the structural elements of the combustion area.

It is contemplated that the invention involves microprocessor control of the gas fired appliance for the purposes of controlling the flow of gas to the appliance, controlling the temperature of the first radiator for the purpose of ignition of the combustible gas, as well as other microprocessor controls which monitor and automatically adjust the general operation of the gas fired appliance.

As an example of the type of control that the inventive ignition and combustion control system and method is capable of, should the flame of combustible gas extinguish or otherwise perform substandardly, then a supply valve for the flow of gas to the appliance can be modulated closed by microprocessor control when a substandard signal from the infrared sensor is detected based upon the quantity of emitted radiation from the second radiator. After the flow of gas has been cut off, the microprocessor can then control the ignition system to attempt one or more retries to ignite the combustible gas by signals derived from the first radiator after the extinguishment of the flames of the combustible gas is verified by signals to the microprocessor derived from the second radiator.

A further concept of the type of control capable with the inventive system and method is the ability to sense the effect of a flow of air upon the first radiator. To do so, the general principle is observed that the infrared energy emitted by a heated solid material is inversely proportional to the cooling effect of air upon the heated solid material. The amount of cooling air to which the heated solid material is exposed is proportional to the infrared energy emitted. As such, infrared energy emitted by a heated radiator, with the infrared sensor and associated circuitry, function as a form of anemometer to measure air velocity.

In further application, the efficiency of the combustion in the appliance is also effected by air flow and is indicated by the degree of infrared radiation emitted from the heated solid material, which infrared radiation is detected by the infrared sensor and circuitry associated therewith. By way of example, should the air flow into the gas combustion chamber become blocked during ongoing combustion, then the diminished air flow will cause a decreased efficiency in the combustion of combustible gas. This efficiency decrease will cause the second radiator, which is engulfed in flames, to emit less infrared radiation due to the decrease of gas combustion. The infrared sensor will detect the decrease in the emission of infrared energy from the second radiator and the appliance operational parameter, such as the flow of combustible gas thereto, is then adjusted using software control via a microprocessor associated with the inventive system. Thus, the infrared sensor, associated circuitry, and the second radiator are used in the inventive system and method to monitor obstructions of air flow to the combustion chamber.

The monitoring of air flow performs the function of a conventional sail switch, and is also used to maximize the efficiency of the combustion of the combustible gas. By controlling both air and fuel feeding to the combustion area, a comprehensive gas fired appliance control and efficiency system is achieved.

As a further extension and safety feature of the invention, the infrared sensor can be used to detect abnormal infrared emissions which may signal that the materials from which the appliance is constructed have reached a critical temperature that is near the point of fatigue or cracking. Upon such abnormal emissions of radiation which are detected by the infrared sensor and circuitry, microprocessor control of the appliance initiates a process to decrease or otherwise turn-off the feed of combustible gas to the appliance via a gas valve modulation system.

While it is preferable, the infrared sensor need not be physically situated in direct view of either the first or second radiators. Rather, optical fibers having an end directed toward such radiators can be used to direct the infrared radiation to an infrared sensor that is located remotely from the source of the infrared radiation. By way of example, an infrared sensor on a gas fired stove can be focused upon an end of one or more optical fibers having an opposite end directed at solid material engulfed within a flame so as to assist therethrough infrared radiation therefrom.

The inventive ignition system has the versatility of being able to detect a variety of combustible gases including propane, natural gas, or liquid petroleum gas. Once the type of combustible gas is known, the appropriate range of infrared radiation from the first and second radiators that is applicable to the ignition and combustion of such gas can then be set as a process variable in the microprocessor control for the corresponding gas fired appliance.

In summary, the device may be characterized in main preferred embodiments thereof as a system and method having an electronic ignition control board for the purpose of igniting and monitoring a gas fired appliance operation by infrared sensing of a solid infrared emitting material as a mean of gauging the presence, absence, ignition potential for, and efficiency of a flame of combustible gas.

The inventive system is easy to manufacture while at the same time providing improved overall safety in the ignition and accurate determination of the existence and the quality of on-going combustion of fuel gas in a gas fired appliance.

BRIEF DESCRIPTION OF THE DRAWINGS

The presently preferred embodiments and the presently understood best mode of the invention will be described with additional detail through use of the accompanying drawings, wherein corresponding structural parts are designated by the same reference numerals throughout, and in which.

DETAILED DESCRIPTION OF THE PREFERRED EMBODIMENTS

III. The System

A. The Presently Preferred Inventive Ignitor and Combustion Monitor within Gas Fired Appliances: (FIGS. 1A–3).

Figure 1A:
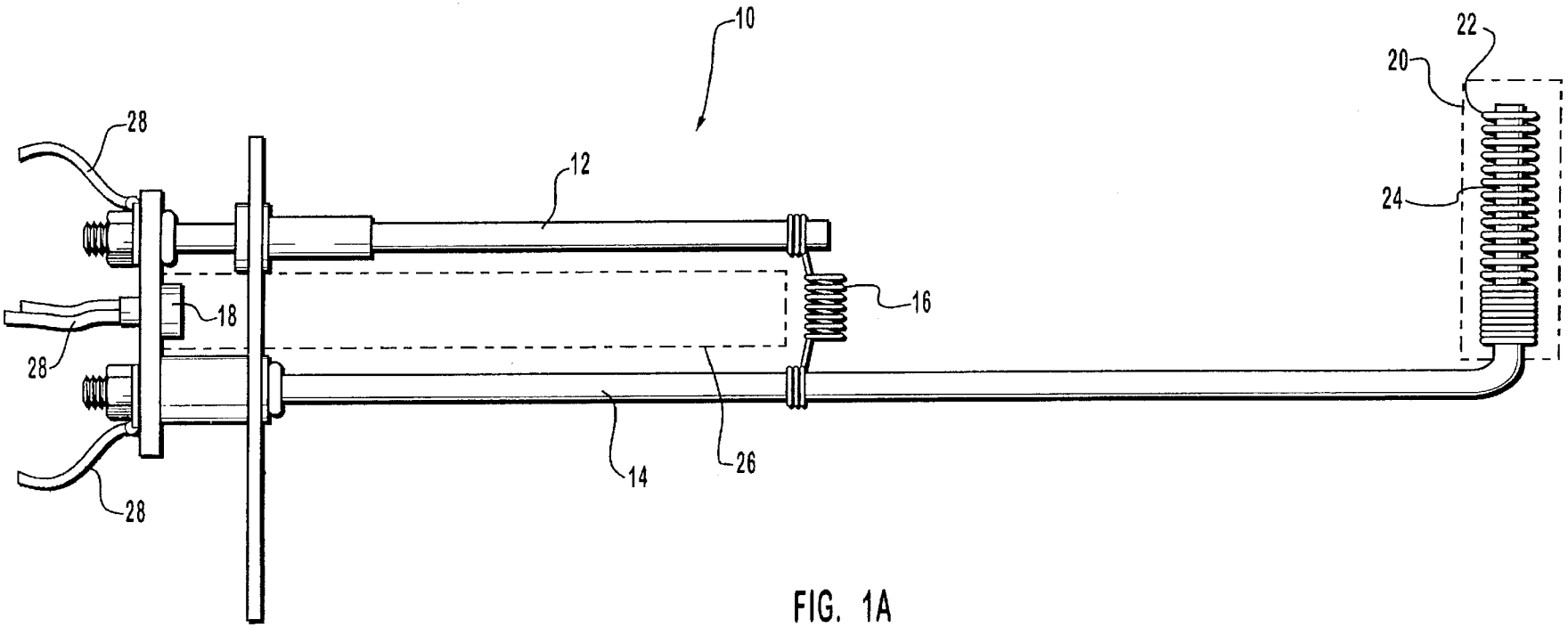
FIG. 1A is a preferred embodiment of the inventive hot surface ignition and combustion monitoring device.

FIG. 1A depicts a preferred embodiment of the inventive device referred to hereinafter as an ignitor, generally indicated at 10. Ignitor 10 has a first electrically conductive rod 12 and a second electrically conductive rod 14 with an electrically conductive ignition coil 16 therebetween. A voltage potential between first conductive rod 12 and second conductive rod 14 causes ignition coil 16 to undergo electrical resistance heating. When ignition coil 16 is heated, it begins to glow and emit infrared radiation. The temperature to which ignition coil 16 is heated is sufficient for hot-surface ignition of a combustible gas that comes in contact with ignition coil 16.

While ignition coil 16 is being electrically heated, an IR detector 18 detects infrared radiation being emitted by ignition coil 16. During the time that ignition coil 16 is being electrically heated, IR detector 18 detects the emission of infrared radiation therefrom. Preferably, IR detection 18 has ignition coil 16 within its line of sight.

After a predetermined period of time, electrical current supplied to ignition coil 16 by first and second conductive rods 12, 14 is terminated. This predetermined period of time is equal to or greater than the period of time necessary for ignition coil 16 to ignite the combustible gaseous fuel coming in contact therewith. When electrical current ceases to flow through ignition coil 16, ignition coil 16 will no longer emit a high degree of infrared radiation as it begins to cool. The cooling and emission of a lesser amount of radiation by ignition coil 16 will be detected by IR detector 18 as ignition coil 16 cools.

After ignition coil 16 has ignited by a hot surface thereon the combustible gaseous fuel, the flames of combustion will be directed towards combustion and emission region 20 seen in phantom in FIG. 1A.

The physical arrangement and placement of combustion and emission region 20 is such that the flames from the combustion of gaseous fuel will essentially heat only combustion and emission region 20 and will not substantially heat ignition coil 16. The gradation in temperature between ignition coil 16 and combustion and emission region 20 is preferable due to the physical arrangement of the fuel being fed to combustion and emission region 20. Alternatively, a blower fan may direct air so as to shift the flames of combustion. The net effect of this physical arrangement or flame shifting is that infrared radiation will be emitted from combustion and emission region 20 to a substantially larger degree than that which is emitted from ignition coil 16.

As combustion and emission region 20 is heated by the flames produced through the combustion of gaseous fuel, solid materials that are within combustion and emission region 20 will begin to heat up. Preferably, the solid material that is within combustion and emission region 20 will be of the type that emits a high degree of infrared radiation when heated. As seen in FIG. 1A, an emission coil 22 is wrapped around and upon an emission element 24, both of which are within combustion and emission region 20. Emission coil 22 is preferably a relatively thin coil that withstands heating for an extended period of time without failure. Emission element 24 is similarly able to withstand heating over a lengthy period of time without disintegration or otherwise failing.

While the materials within combustion and emission region 20 are being heated to the point of emitting infrared radiation, IR detector 18 detects infrared radiation being emitted from combustion and emission region 20. By the detection of infrared radiation coming from combustion and emission region 20, IR detector 18 can determine whether a successful combustion has taken place and is ongoing. Preferably, combustion and emission region 20 and, specifically, emission coil and elements 22, 24, are within the line of sight of IR detector 18.

In order to preserve the integrity of the detection of infrared radiation detected by IR detector 18, a cloaking tube 26 may be placed around IR detector 18 at one end thereof, while the other end of cloaking tube 26 opens near ignition coil 16. Preferably, cloaking tube 26 defines a line of sight of IR detector 18 directly toward emission coil and element 22. By limiting the peripheral view of IR detector 18 using cloaking tube 26, or a similarly functioning structure, IR detector 18 will be limited in its detection of infrared radiation from a limited number of sources, which will preferably be ignition coil 16 and combustion and emission region 20.

The solid materials to receive heating from the combustion of the gaseous fuel, which solid materials are found within combustion and emission region 20, must be carefully chosen to withstand extended periods of being heated within a combustible gas. Preferably, this material is an aluminum-nickel alloy or a stainless-steel material with an aluminum-silicon additive such that its melting point is high (e.g. above 1200° F.).

With respect to emission coil 22, it is preferably wrapped around emission element 24 several times and is spot-welded thereon. Preferably, emission coil 22 and emission element 24 are both made from KANTHAL™, supplied as 8-gauge rod. This rod is between 4 and 5% aluminum, about 22% chromium, and substantially comprises iron. The size of the rod is between 0.6 inches and 0.12 inches diameter. While the foregoing represents a preferred material for emitting infrared radiation from within combustion and emission region 20, those of skill in the art will understand that other materials are capable of emitting infrared radiation adequately for the present inventive system.

While cloaking tube 26 is depicted in FIG. 1A in one embodiment thereof as a shield or tube to block peripheral vision of IR detector 18, tube 26 may also be considered to one or more optical transmission fibers capable of transmitting infrared radiation from either ignition coil 16 or combustion and emission region 20 so as to communicate the same to IR detector 18. In such an alternative embodiment, combustion and emission region 20 and ignition coil 16 may be located at an open gas fuel and air source such as a gas burner of a stove, where tube 26 transmits infrared radiation by optical fiber therein from such location at the burner of a stove to a remote location where IR detector 18 is situated. Such an embodiment of a gas fired stove provides an environment in which IR detector 18 can be safely maintained out of the heating zone of the burner. It should also be understood that IR detector 18 may be further separated from first and second conductive rods 12, 14 in a gas fired stove embodiment of the present inventive ignition and combustion control system and method. Alternatively, a heavy duty IR detector 18 may be maintained closer to the combustion flames, when properly positioned or thermally shielded by a mica shield or other transparent shield, so that IR detector 18 may be positioned directly in between first and second conductive rods 12, 14 and within the line of sight of solid materials to be monitored for infrared radiation.

Figure 1B:
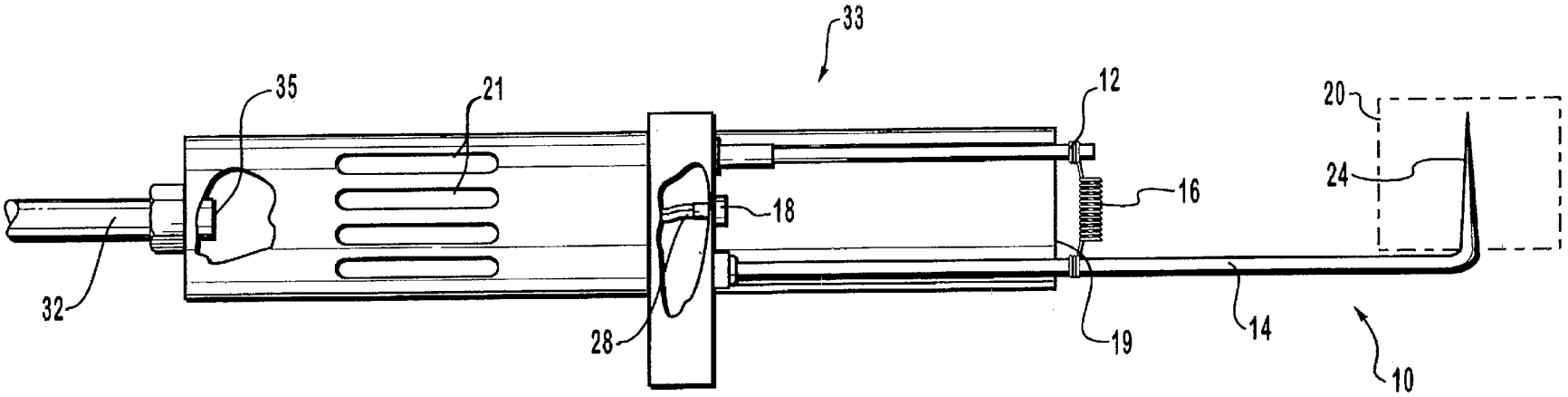
FIG. 1B shows an alternative preferred embodiment of the inventive hot surface ignition and combustion monitoring device positioned above and adjacent to a burner tube with the ignition coil thereof protruding from an end of the burner tube.
Figure 1C:
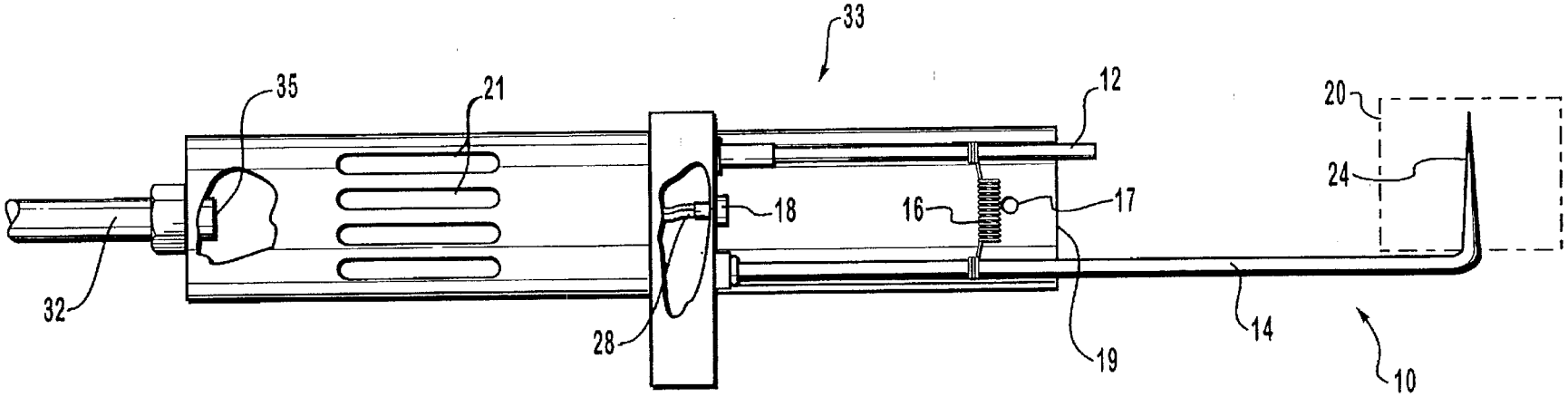
FIG. 1C shows the alternative preferred embodiment of the inventive hot surface ignition and combustion monitoring device positioned above and adjacent to a burner tube, wherein the ignition coil thereof is positioned above and adjacent to an ignition hole providing an inlet for ambient air to the inside of the burner tube.

Alternative embodiments oft he inventive ignition and combustion detection system are seen in FIGS. 1B and 1C. A burner tube 33 is disposed below and immediately adjacent to ignitor 10. Burner tube 33 has at one end thereof a gas line 32 feeding a supply of combustible fuel through an orifice 35. Ambient air, due to pressure differentials, is fed to the inside of burner tube 33 through a venturi 21 to be mixed with combustible fuel from fuel inlet 32. Past an opposite end 19 of burner tube 33 is combustion and emission region 20.

In the embodiment of ignitor 10 seen in FIG. 1B, ignition coil 16 is positioned outside of and past end 19 of burner tube 33. Thus, ignition of the supply of combustible fuel emitted from orifice 35 of gas line 32 takes place at end 19 of burner tube 33. Upon combustion, the pressure of combustible fuel emitted from orifice 35 of fuel end 32 shifts the flame from the region of ignition coil 16 to combustion and emission region 20. By such flame shifting, ignition coil 16 is not heated by the flames of combustion, and emission element 24 within combustion and emission region 20 is heated by the flames of combustion which have shifted away from end 19 of burner tube 33.

As can be seen in FIG. 1B and 1C, emission element 24 is a thin piece of material which, preferably, has a flat surface effaced toward and within the line of sight of IR detector 18. Unlike ignitor 10 seen in FIG. 1A, emission element 24 does not have an emission coil 22 wrapped therearound. As such, emission element 24 of FIGS. 1B and 1C has a relatively small thermal mass, which is conducive to rapid emission of infrared radiation upon heating of the same.

The embodiment of ignitor 10 seen in FIG. 1C shows burner tube 33 having an ignition hole 17 proximal of end 19. Immediately adjacent to ignition hole 17 and above burner tube 33 is ignition coil 16 of ignitor 10. In this embodiment, a combustible fuel is fed into fuel inlet 32 and through orifice 35 so as to, by pressure differential, draw ambient air through venturi 21 creating a primary fuel-air mixture. The primary mixture of fuel and air translates to the location of ignition hole 17. Again, by pressure differential, ambient air is received through ignition hole 17 to mix with the primary mixture of fuel and air so as to create a secondary and combustible mixture of fuel and air. As the combustible secondary mixture of fuel and air begins to surround ignition coil 17 from within burner tube 33 at ignition hole 17, ignition coil 16 is heated electrically to a temperature at which the secondary mixture of fuel and air will combust. Upon combustion, the pressure of gaseous fuel from fuel inlet 32 will cause the flames of combustion to shift out of burner tube 33 and extend to combustion and emission region 20. By such flame shifting, ignition coil 16 is outside of the flames of combustion, and emission element 24 within combustion and emission region 20 is engulfed within the flames of combustion. Consequently, IR detector 18 essentially receives infrared radiation solely from combustion and emission region 20 to the exclusion of ignition coil 16 which is no longer electrically resistance heated.

The concept of shifting the flames of combustion following ignition away from the hot ignition surface to a solid material exposed to ongoing combustion may be accomplished through increased gas mixture pressure, spatial arrangement of the infrared radiators, forced air pressures, or by other conventional means.

An alternative embodiment from ignitor 10 seen in FIGS. 1A, 1B, and 1C is an embodiment in which the flames of combustion, subsequent to ignition, engulf only ignition coil 16. In such an embodiment, ignition coil 16 is electrically resistance heated to the point of igniting the combustible gaseous fuel mixture. Subsequent to ignition, ignition coil 16 is no longer electrically heated, but rather is thermally heated by the flames of combustion. IR detector 18 thus detects infrared radiation emitted from ignition coil 16 as it is electrically and then thermally heated. In such embodiment, the flames of combustion do not heat combustion and emission region 20. This embodiment is not considered the best mode in that ignition coil 16 is exposed for prolonged periods to high temperatures due to the flames of combustion. Additionally, ignition coil 16 has a limited thermal heat sink in communication therewith so as to transfer heat energy therefrom to the heat sink. As a result, ignition coil 16 has a shorter life due to a rigorous environment of constant exposure to high temperatures, both thermally and electrically. In such embodiment, the presence of the extended portion of second conductive rod 14 having at an end thereof emission coil 22 and emission element 24 would not be necessary. Additionally, the thermal mass of ignition coil 16 should be increased to lengthen its service life, should the requisite power be available in the appliance to achieve hot surface ignition temperatures.

The inventive ignition and combustion monitoring device can be placed in a variety of gas fired appliances such as furnaces, water heaters, barbecue pits, fire places, stoves, refrigerators, and other appliances where the ignition and subsequent combustion of a gaseous fuel is required.

The foregoing is a description of preferred embodiments of the inventive ignition and combustion monitoring device. Components of one such embodiment are more fully described in Table I, below. The artisan will understand that different structural, component, and material designs and arrangements are possible to implement the device seen in FIG. 1A.

Figure 2:
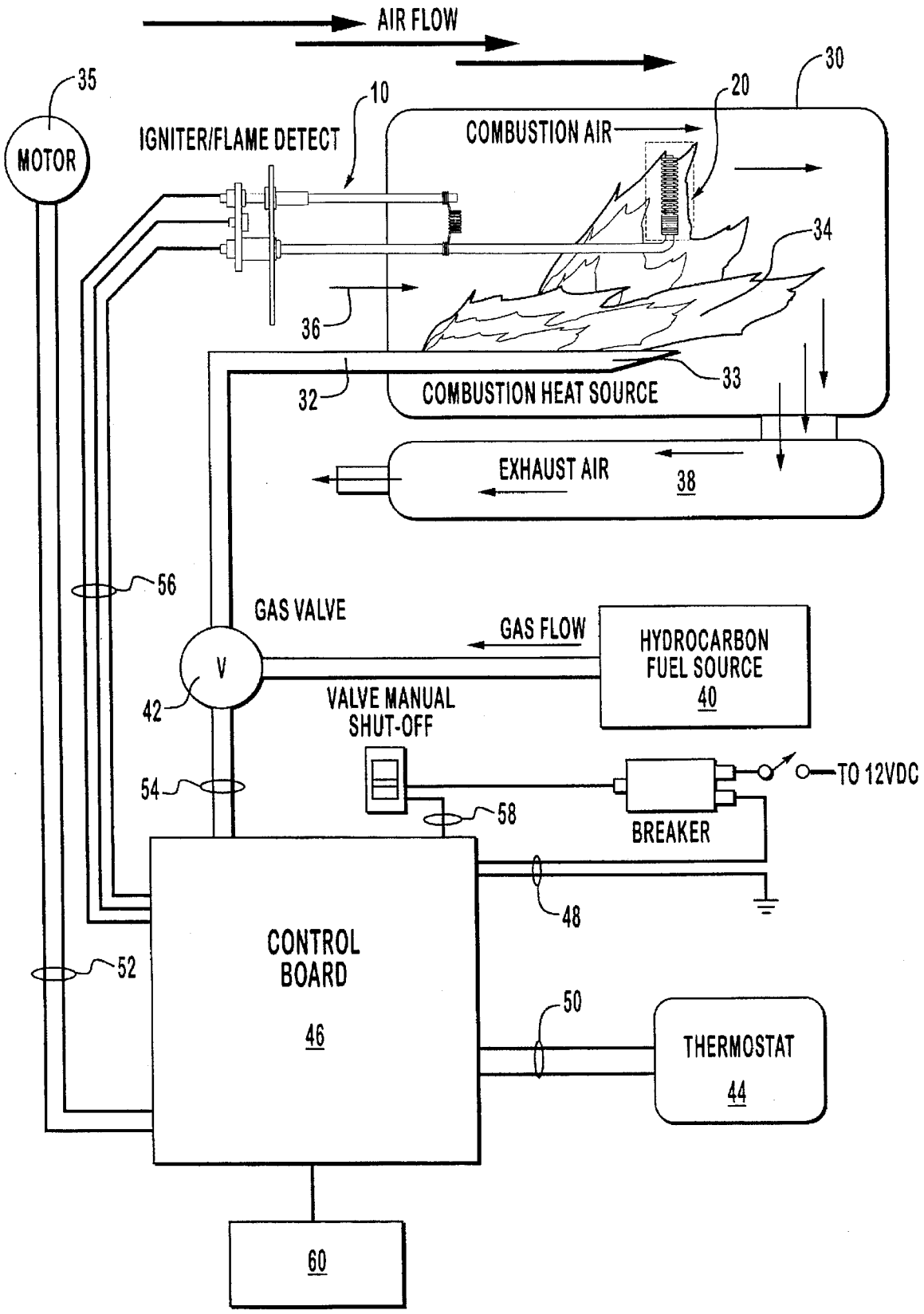
FIG. 2 is a preferred embodiment of an inventive gas fired furnace incorporating the inventive ignition and combustion monitoring device.

FIG. 2 depicts an embodiment of an inventive gas fired furnace containing the inventive ignitor. A fire box 30 has therein ignitor 10. Ignitor 10 is supplied with gaseous fuel by a fuel inlet 32. Fuel inlet 32 distributes the gaseous fuel in a spread out or otherwise extended area. Upon ignition, a series of combustion plumes 34 heat combustion and emission region 20 shown in FIG. 2.

The furnace seen in FIG. 2 has an air-intake flow seen by an arrow 36 which carries a stream of air into fire box 30. A blower fan 35 forces air in the direction of an arrow 36 into fire box 30. The force of blower fan 35 on the air flow through fire box 30 also forces the heated air within fire box 30 to exit at an exhaust vent 38. The air of the air stream is heated within fire box 30 and exits fire box 30 through an exhaust vent 38. Exhaust vent 38 will preferably exhaust heated air into the ambient where the furnace is installed so as to heat an intended area.

As seen in FIG. 2, a fuel source 40 deliver fuel gas to a gas valve 42 prior to being delivered to fire box 30. For subsequent combustion, fuel supply 40 feeds gaseous fuel through a gas valve 42 to fire box 3. Outside of firebox 30 is a temperature detection and signaling device 44 which detects ambient temperature within the environment to be heated by the furnace.

An appliance control board 46 controls the operation of the furnace. Appliance control board 46 is in electrical communication with a power supply through power supply leads 48. Control board 46 is in electrical communication with the temperature detection and signaling device 44 through thermostat leads 52. Appliance control board 46 is also in electrical communication with blower fan 35 through blower fan leads 42.

Ignitor 10 is in electrical communication, through ignitor and IR detector leads 56, with appliance control board 46. Appliance control board 46 also controls a manual gas shut-off valve modulating capability of the furnace through manual shut-off valve leads 58. Additionally, input and output communications to appliance control 46 are made to appliance control board 46 through an I/O communications device 60.

Figure 3:
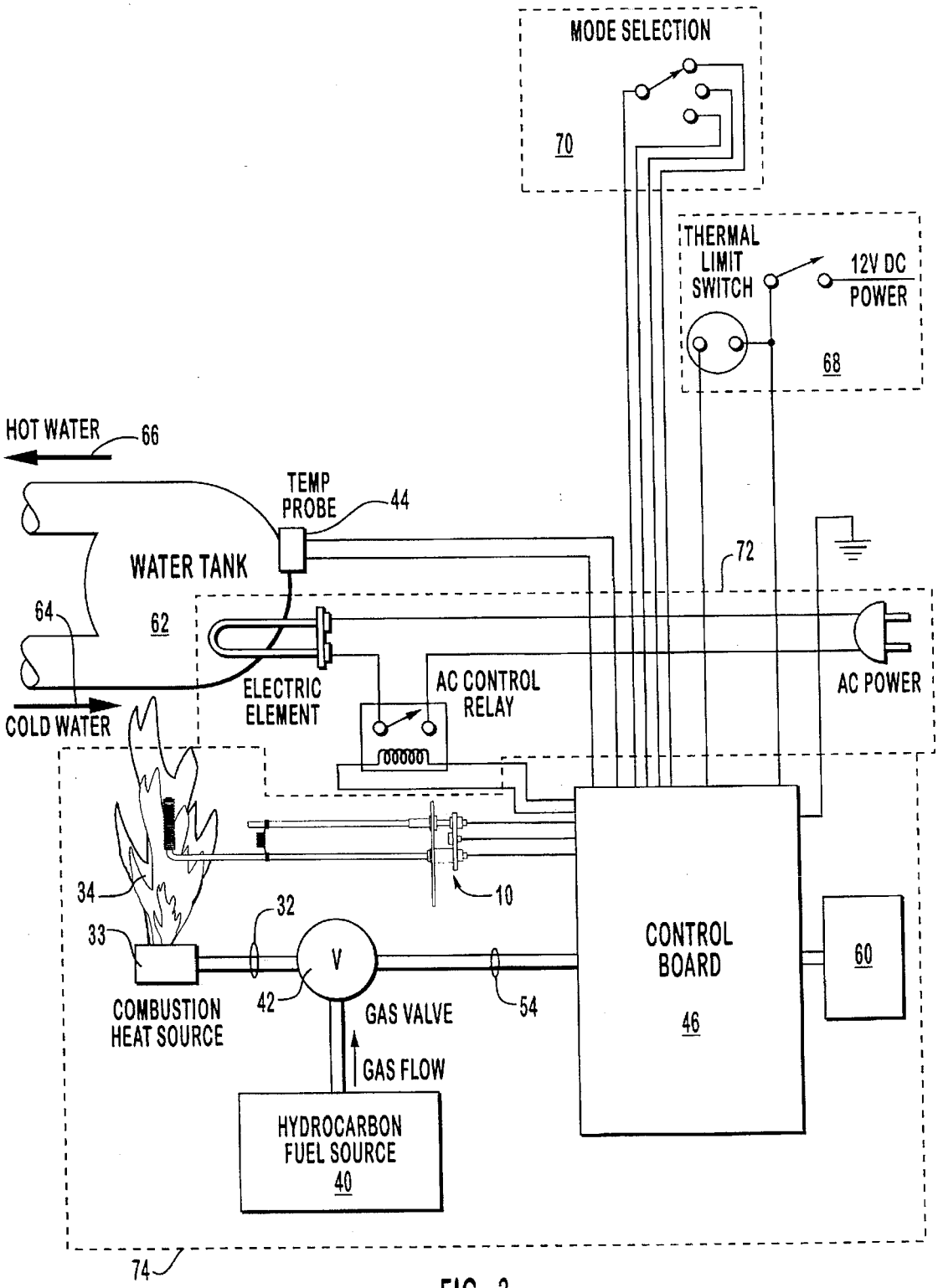
FIG. 3 is preferred embodiment of an inventive gas fired water heater incorporating the inventive ignition and combustion monitoring device.

An alternative embodiment of the inventive ignitor is shown installed within a water heating system is seen in FIG. 3. As seen in FIG. 3, ignitor 10 heats a water tank 62 by combustion plumes 34. As water tank 62 is heated, cold water following in the direction of an arrow 64 causes water to enter water tank 62, and hot water exits in the direction indicated by an arrow 66 from water tank 62 upon external demand for same. The temperature of water within water tank 62 is detected by temperature and detection signaling device 44 which communicates with control board 46 for the monitoring of the water temperature. A power supply and thermal limit switch 68 also feeds into control board 46 for the purpose of detecting excessive water temperatures which, for instance, might tend to scald a user demanding hot water from water tank 62.

Various operational parameters may be set by a user with a mode-selection device 70 which is in electrical communication with appliance control board 46.

As an option to gaseous fuel combustion to heat water tank 62, an electrical resistance heating system 72 seen in FIG. 3 can also heat the water within water tank 62. Heating system 72 obviates the need for ignitor 10 and associated circuitry, except where IR detector 18 and associated circuitry monitor for structural failure of combustion area components as discussed above.

In the case of a gas fired hot water heater, the infrared sensor detects for both low and high radiation being omitted by the second radiator. It is necessary to so monitor in that forced air is not fed to the combustion area of the hot water heater. The absence of a forced air stream, in combination of a poor combustion, may result in the combustion of carbon and produce a flame from such combustion which emits an excessive amount of infrared radiation. As such, the method implemented for the inventive gas fired water heater must anticipate such circumstances and cause the control of the appliance to respond appropriately.

The burning of carbon is visually indicated by an orange color, and may be due to an insufficient air supply available to the combustion area of the gas fired water heater. In the gas fired water heater, a sail switch function would not be incorporated in that no blower fan is used. Thus, the method for using the inventive ignition and combustion control system must anticipate an excessive infrared radiation being detected from the gas combustion area of the gas fired water heater, the explanation for which is a poor air supply as opposed to an excessive temperature. Parameters may be set within the microprocessor and its data storage area so as to discern between excessive temperatures of the water in the water heater, and a deprivation of air to the combustion area of the water heater.

FIG. 3 shows a group of the inventive equipment 74 that is needed for most gas fired appliances to operate with the inventive ignition and combustion control system and method.

Figure 4:
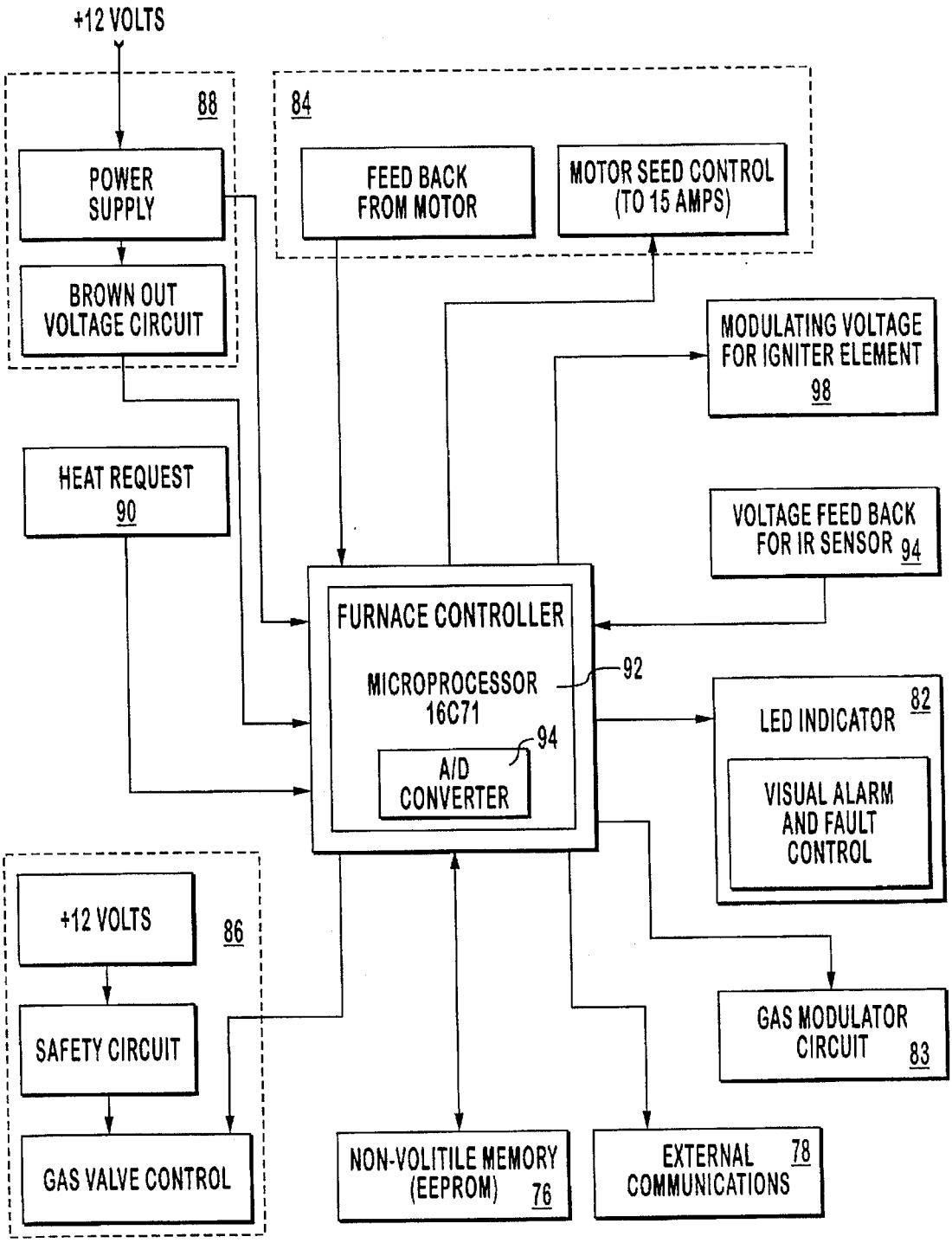
FIG. 4 is a functional block diagram which schematically illustrates the primary components of one presently preferred electronic circuit used in connection with the electronic controller incorporated into the inventive ignition and combustion monitoring system.
Figure 5A:
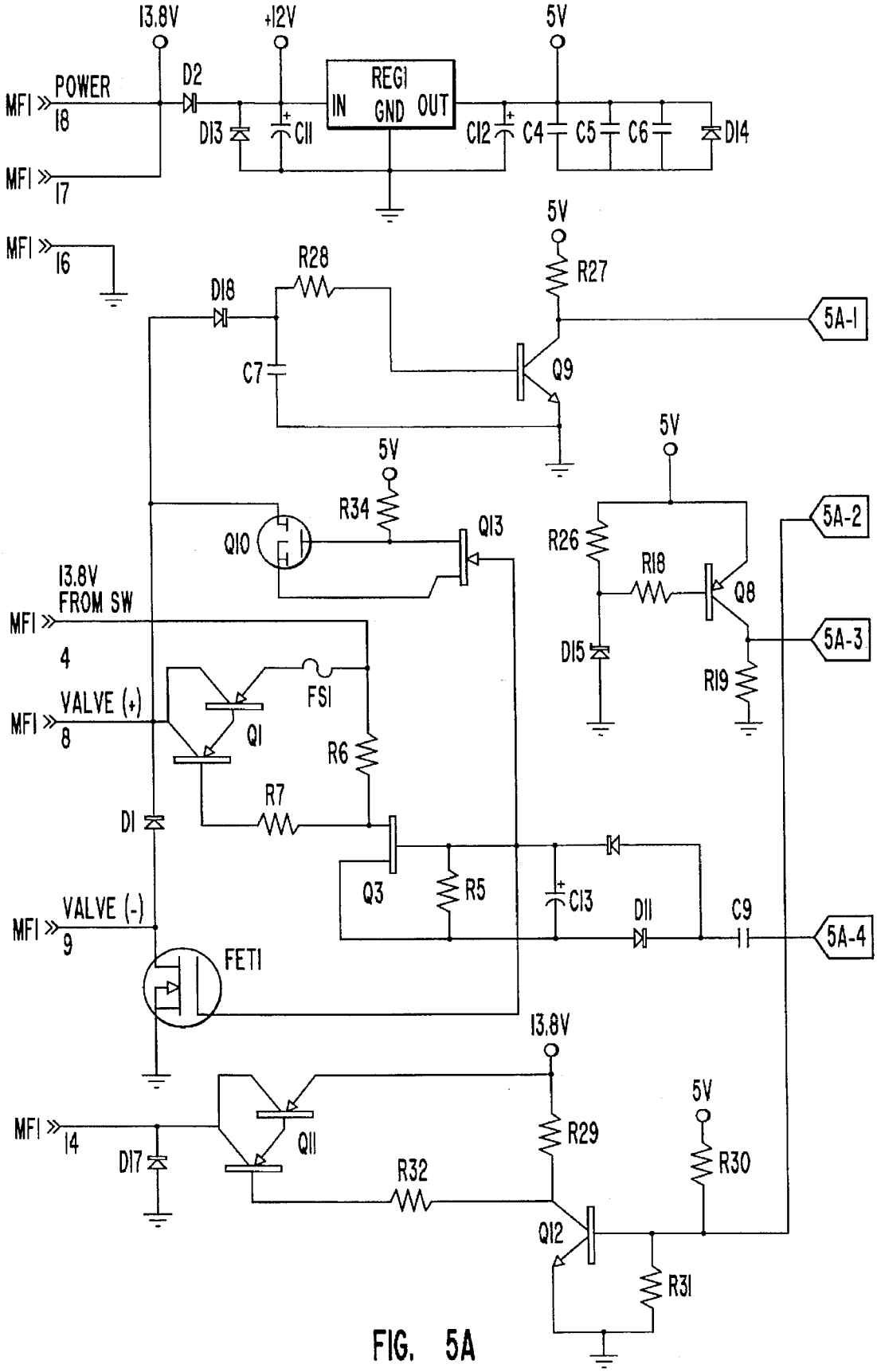
FIGS. 5A–5D taken together constitute a detailed electrical schematic diagram which illustrate, as an example, a presently preferred embodiment and one presently understood best mode for implementing the electronics of the system and method of the present invention in a gas fired furnace.
Figure 5B:
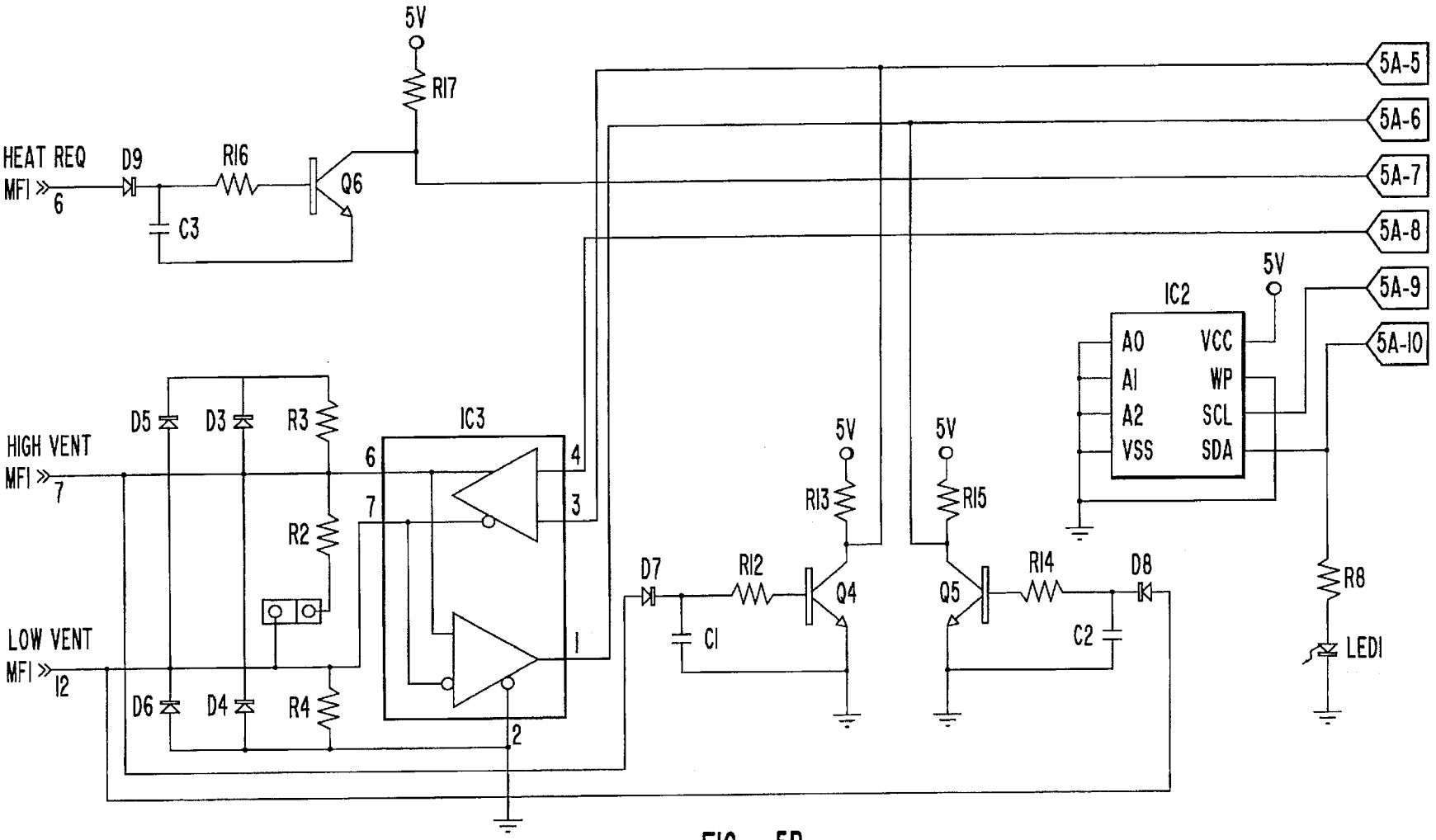
Figure 5C:
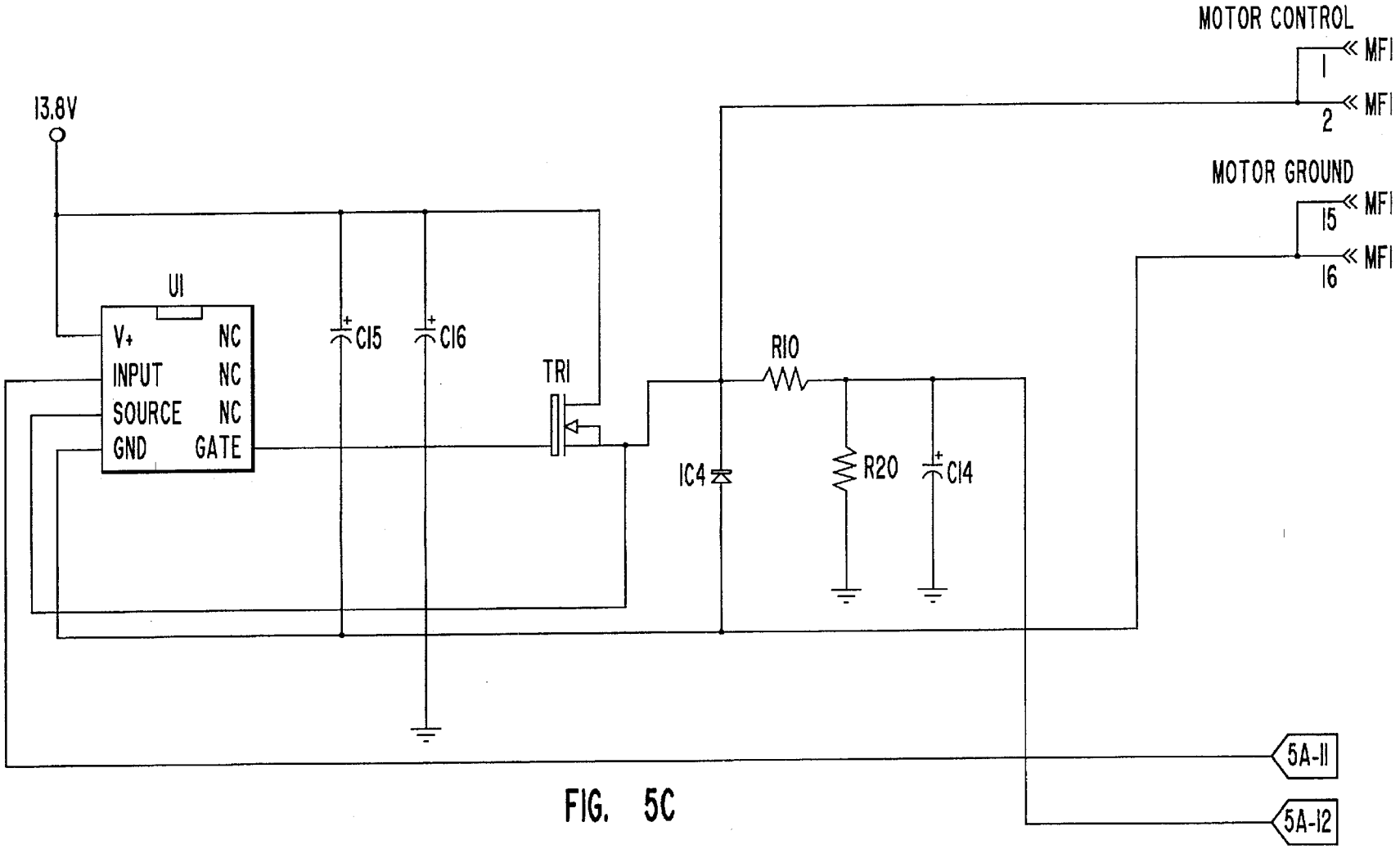
Figure 5D:
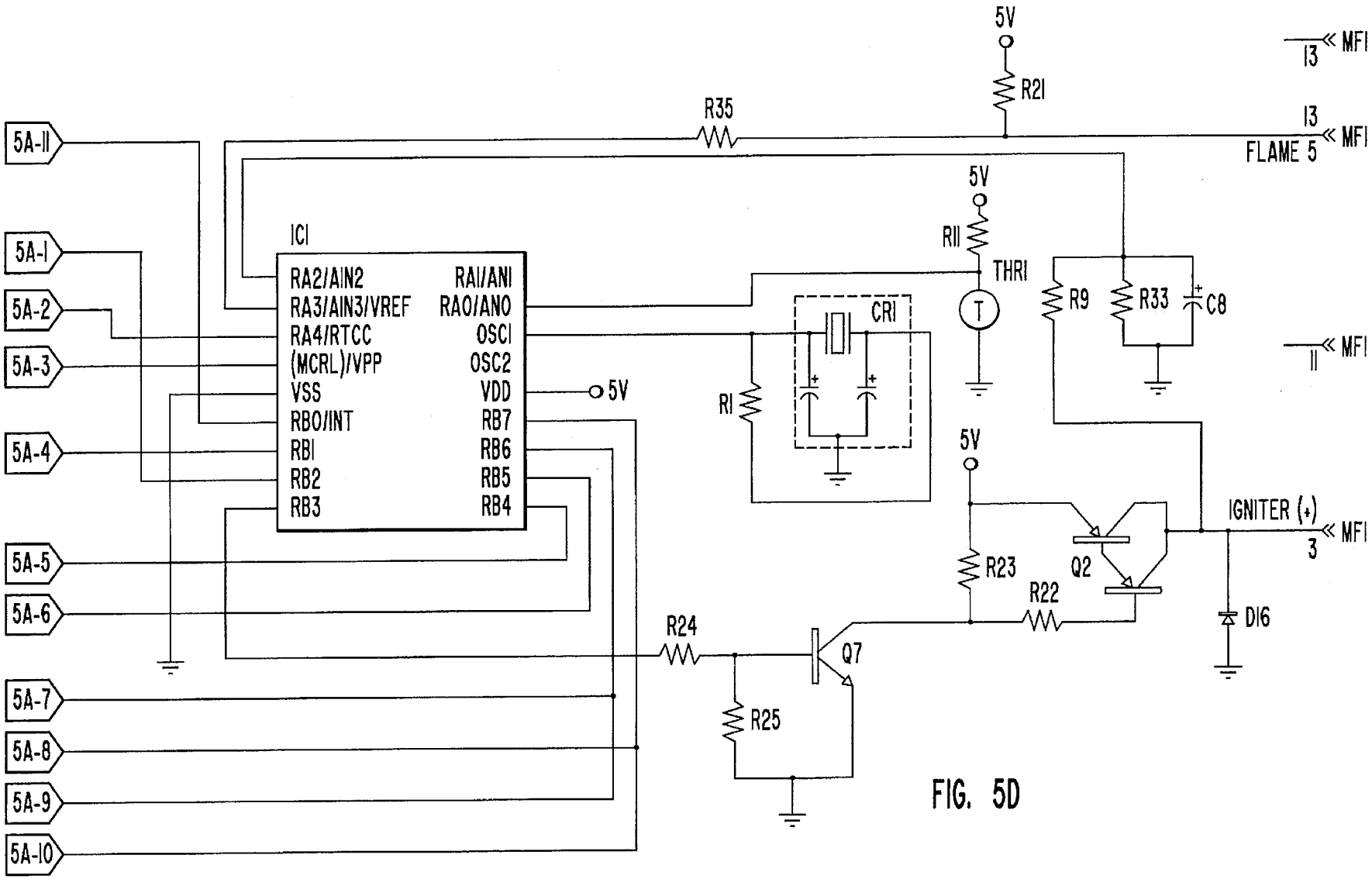

B. The Presently Preferred Electronic Controller: FIGS. 4 through 5D.

Appliance control board 46, seen in FIGS. 2–3, incorporates a variety of both hardware and software to accomplish the function of operating a gas fired appliance. In FIG. 4, a microprocessor 92 may have an optional non-volatile memory, such as an EPROM, to store additional software and data to be fed to appliance control board 46, seen in FIGS. 2–3. An external communications module 78 can be used to feed appliance data to peripheral equipment, as well as to receive data to be fed to the appliance. A gas modulator circuit 80 is used to control the flow of gas going through a valve to the appliance. An LED indicator for alarms is seen at 82. Device 82 may include visual LED indicators, sound alarms, or a combination thereof.

The controlling of blower fan 35, seen in FIG. 2, may be controlled by a blower fan control module 84 seen in FIG. 4. Power supply and voltage regulation is accomplished by a module seen at 88. The temperature that is achieved by the medium being heated may be controlled by a temperature input 90 which directly measures the medium being heated and communicates a signal with microprocessor 92.

All of the foregoing data is communicated with microprocessor 92, seen in FIG. 4, for being processed. Microprocessor 92 has an analog to digital converter 94 which converts the signals from the aforedescribed devices in preparation for processing the data contained in the signals.

In the presently preferred embodiment, microprocessor 92 in FIG. 4, and IC1 seen in FIG. 5, is an example of a digital processor means. Such a digital processor means can be a general purpose microprocessor or an equivalent device. Alternatively, it may be desirable to utilize a more powerful microcomputer, such as an IBM personal computer, to devise a microprocessor-based apparatus specifically designed to carry out the data processing functions incidental to this invention. Importantly, the hardware which embodies the processor of the present invention must function to perform the operations essential to the invention and any device capable of performing the necessary operations should be considered an equivalent of the processor means. As will be appreciated, advances in the art of modem electronic devices may allow the processor to carry out internally many of the functions carried out by hardware illustrated in FIGS. 2 though 5 as being independent of the processor. The practical considerations of cost and performance of the system will generally determine the delegation of functions between the processor and the remaining dedicated hardware. However, a low cost processor is desirable.

Visual display aspects of I/O device 60 seen in FIGS. 2 and 3, and controlled through LED indicator 82 of FIG. 4, performs the function of a display means. As intended herein, the display means may be any device which enables the operating personnel to observe visually displayed or audibly reported operational parameters calculated by the microprocessor. Thus, the display means may be a device such as a cathode ray tube, an LCD display, a chart recorder, and/or speaker, or any other device performing a similar function. In the preferred mode, the display means may be one or more series of low cost LEDs.

The functional block diagram of FIG. 4 can be implemented by the circuitry depicted in FIGS. 5A–5D, the components thereof being more fully described in Table II, below. The artisan will understand that different circuit designs are possible to implement the functional block diagram of FIG. 4. Thus, FIGS. 5A–5D and the component list of Table II are offered only for purposes of illustration and not for purpose of limitation of the inventive method and system.

IV. The Method

Attention is next turned to a detailed description of the presently preferred method by which the system of the present invention is used to ignite and monitor the combustion of a fuel gas, and to control the operation of a gas fired furnace, with particular reference to FIGS. 6 through 14, 15-A through 15H, and 16 through 19 which illustrate one presently preferred embodiment of the instructions which may be utilized for digital processor control of the gas fired furnace depicted in various aspects in FIGS. 1–2, and 4–5.

Both the function block diagram of FIG. 4 and the electrical schematic of FIGS. 5A–5D illustrate a presently preferred embodiment of an inventive gas fired appliance ignition and combustion monitoring system.

As will be appreciated by those of ordinary skill in the art, and as noted above, while the system and method as described in reference to the preferred embodiments herein illustrate the system and method as implemented using state of the art digital processing design and corresponding program instructions for controlling the processor, the system and method could also be implemented and carried out using a hardware design which accomplishes the necessary electronic processing, which is thus intended to be embraced within the scope of various of the claims as set forth hereinafter.

Figure 6:
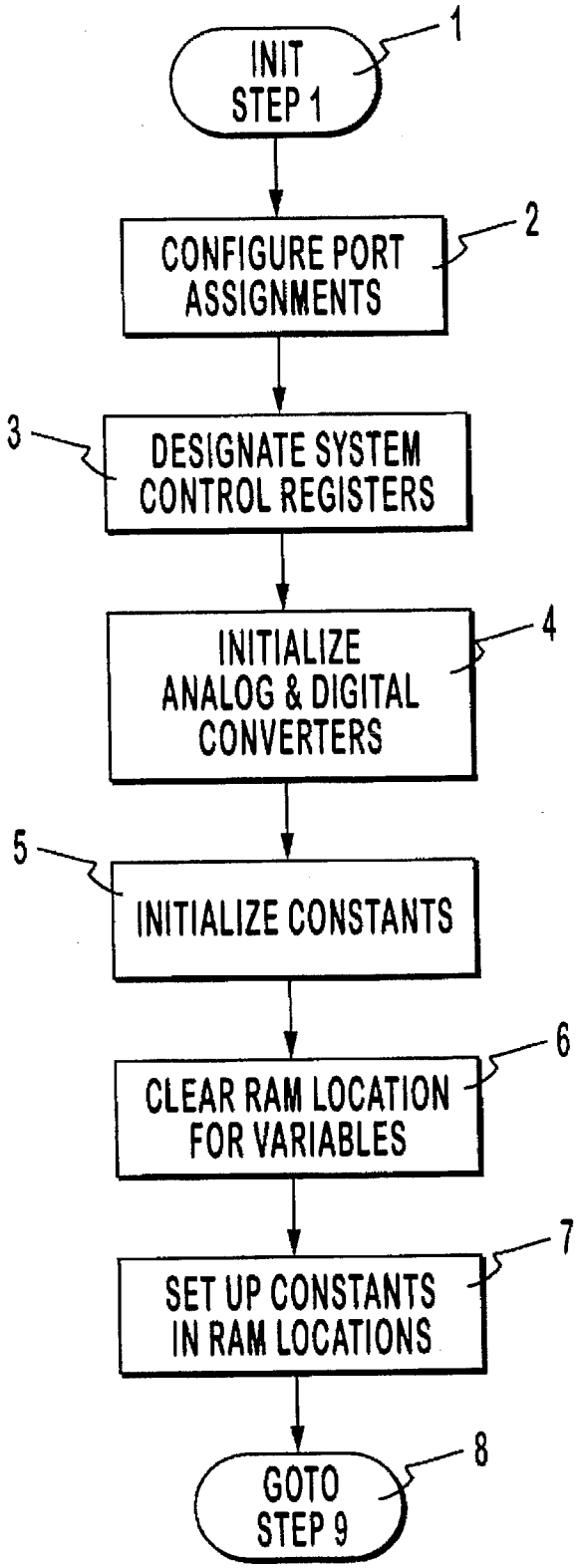
FIGS. 6–14, 15*a*–15*h*, and 16–19 taken together illustrate flow charts showing one presently preferred method for programming the digital processor of the inventive ignition and combustion monitoring system in accordance with the method of the present invention for controlling a gas fired furnace.
Figure 7:
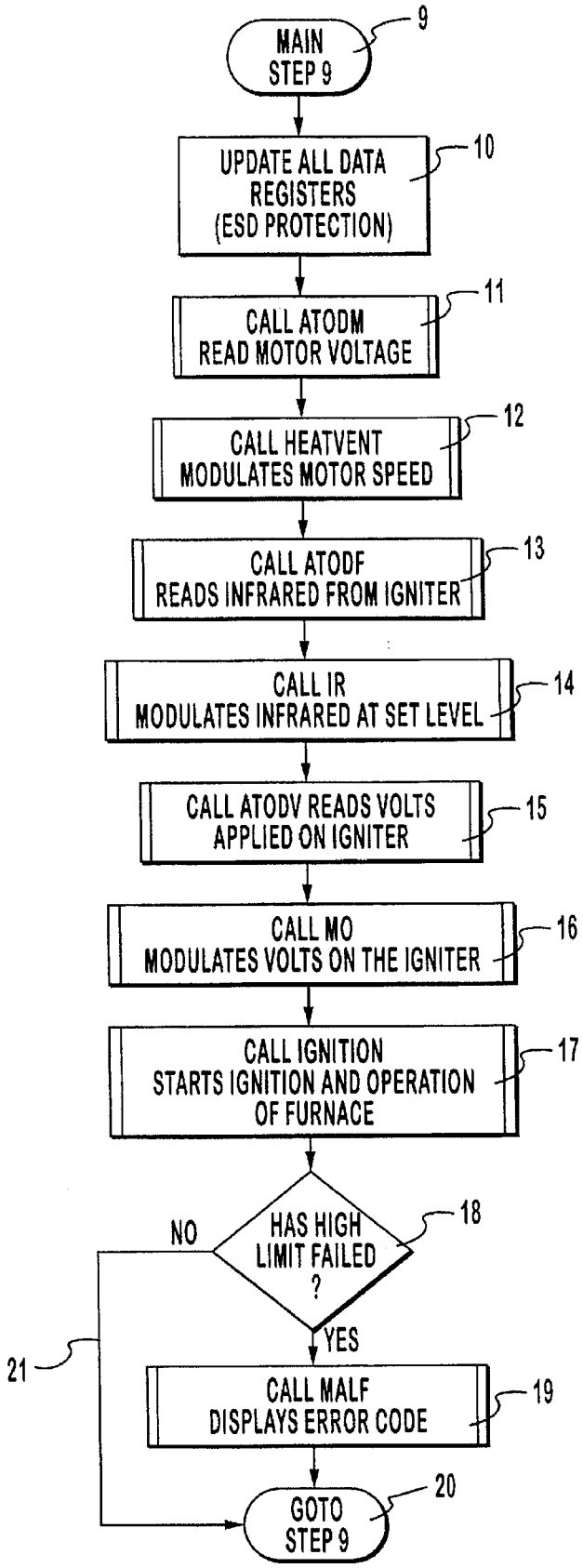

The method of the present invention is seen in overview in FIGS. 6 and 7 which depict flow charts schematically illustrating the primary routines of one presently preferred method for programming both the initialization mode and the operational mode, which modes are performed essentially by the digital processor means of the fuel gas ignition and combustion monitoring system in accordance with the method of the present invention. As seen in FIGS. 6 and 7, the software programming is essentially divided into two sections: respectively, the initialization loop and the main execution loop. The initialization loop, as seen in FIG. 6, prepares the system hardware for the main execution loop and in part verifies functionality of the hardware. The main execution loop, as seen in FIG. 7, controls all other functions in the operation of the furnace.

Microprocessor control of the preferred embodiment of the inventive furnace is detailed in Appendix A hereof by a software source code listing of programs, subprograms, and subroutines, each of which includes documentation descriptive thereof. Each of the programs, subprograms, and subroutines in Appendix A is labeled with a title seen in the top-most labeled step corresponding to a title of a software flow chart seen in FIGS. 6 through 14, 15-A–15H, and 16–19. Each of the FIGS. 6–14, 15-A–5H, and 16–19 graphically sets forth a series of steps for performing a program, subprogram, or subroutine for which a listing appears in Appendix A. A description of each of these steps in the Figures is found in Appendix B, which with the source code listings in Appendix A provides a complete understanding of the method of a preferred embodiment of the invention. A summary of the general functions performed by the flow charts depicted in each of the Figures, however, is set forth below.

FIG. 6 depicts steps to prepare the microprocessor for the ongoing execution of the software by initializing the data storage addresses and registers, as well as assignment of addresses for subsequent storage of data. Miscellaneous maintenance and initialization routines are carded out.

The steps depicted in FIG. 7 will now be generally described. At the start of the steps, the blower fan motor is initiated into directing an air stream into the furnace combustion chamber. The ignitor receives a current developing a voltage potential between the two electrically conductive rods so as to resistance heat a first radiator extending there between. The voltage applied to the first radiator is monitored by the microprocessor.

Infrared radiation is detected as it is emitted by the resistance heated first radiator, and particularly as the stream of air from the blower fan engulfs and cools the first radiator so as to reduce the infrared radiation emitted therefrom. A verification routine, similar to the sail switch function described above, acknowledges that the blower fan is operating properly, or alternatively that a malfunction has occurred. A gas valve is opened, under the control of the microprocessor, as the blower fan increases its air flow into the combustion chamber. The first radiator is heated for a period of two seconds, which is the desired amount of time to cause a hot surface ignition of the combustible gas mixture that is entering the combustion chamber. Another period of four seconds passes during which flames from the now ignited combustible gas heat the second radiator which is situated at the end of the longer of the two rods on the ignitor.

After a six second period has passed, infrared radiation is detected by the infrared sensor, where the infrared radiation is radiating from the second radiator. In the event that infrared radiation is insufficient, the microprocessor is signaled that an ignition has failed. In such case, the supply of gas to the combustion chamber will be shut off, and the blower fan will cause a purge of the combustion chamber for a period of 45 seconds.

The foregoing routine of blower fan operation, resistance heating of the first radiator, and attempt to detect infrared radiation coming from the second radiator will continue for a total of three cycles as the system repeats attempts to ignite the combustible fuel. Once combustion within a six second period is verified by IR detection from the second radiator, then a period of 45–50 seconds passes during which a proper infrared radiation level must be detected by the infrared sensor, or else the system will shut down the gas flow to the combustion chamber and will begin the foregoing retry attempts to ignite the combustible fuel.

Once ongoing combustion is established by sufficient detection of radiation by the infrared sensor, the thermostat is monitored to determine if a request for heat has been signaled. In the event that the thermostat is not requesting to heat, then the flow of gas to the combustion chamber will cease, combustion will cease, and the fire pot of the furnace will be purged by the blower fan for a period of 45 to 50 seconds.

In the event that the furnace becomes too hot, then an ECO switch in communication with the furnace will send a signal to the microprocessor to shut the power down to most of the system. Particularly, the gas valve is no longer electrically modulated and the flow of gas to the combustion chamber ceases. Upon such cessation of flow of gas to the combustion chamber, combustion also ceases. Upon such a thermal failure, a period of two and one-half minutes passes during which electrical power to the gas valve is monitored to determine if a cooling of the furnace has occurred which is signified by power being applied to the gas valve. In the event that a cooling has transpired, then the ignition routine described above will take place.

FIG. 7 shows at step 17 a routine titled "IGNITION". This routine includes most basic operations of the inventive ignition and combustion control system for the method of controlling the gas fired furnace. This routine is further expanded in FIGS. 15*a*–15*h*. FIGS. 15*a*–15*h* reveal that step 17 seen in FIGS. 7 calls for a variety of other routines for the purpose of accomplishing the basic functions of the ignition and combustion and control method for the gas fired furnace.

The remains of FIGS. 8 through 19 will now be briefly discussed in perspective to the overall operation of the furnace.

Figure 8:
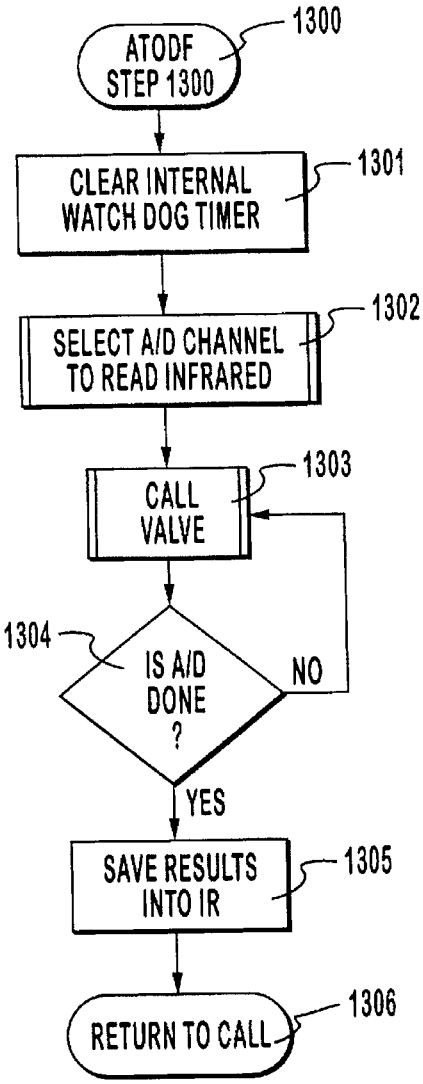

The flow chart seen in FIG. 8 essentially monitors infrared radiation detected by the infrared sensor by reading the voltage therefrom.

Figure 9:
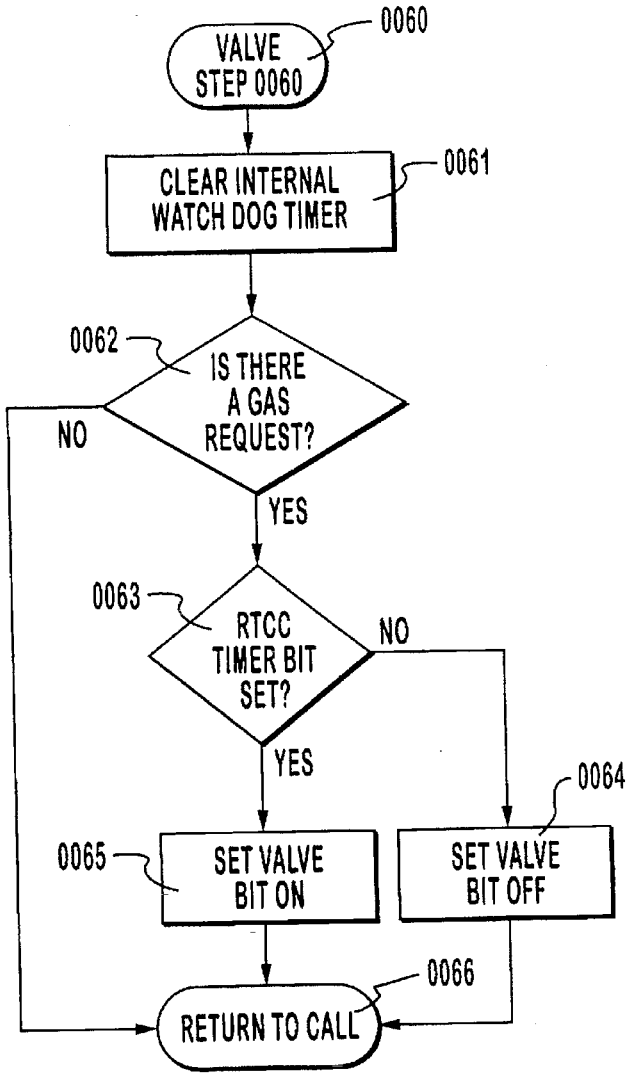

In FIG. 9, a maintenance routine performs a series of steps necessary for the modulation of a valve controlling the flow of fuel gas to the furnace combustion area.

Figure 10:
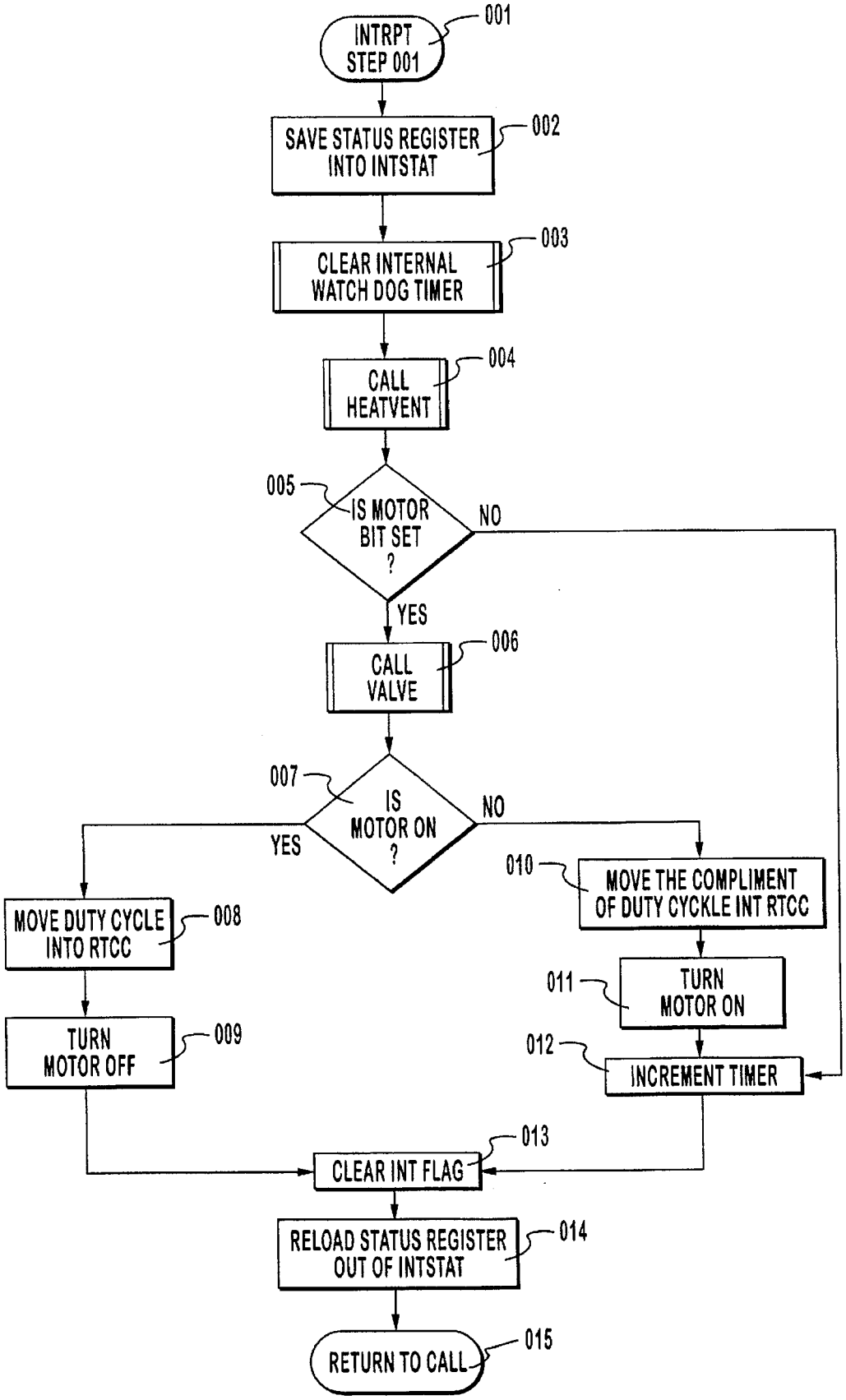

In FIG. 10, a routine performs a series of steps necessary for controlling the blower fan to the furnace.

Figure 11:
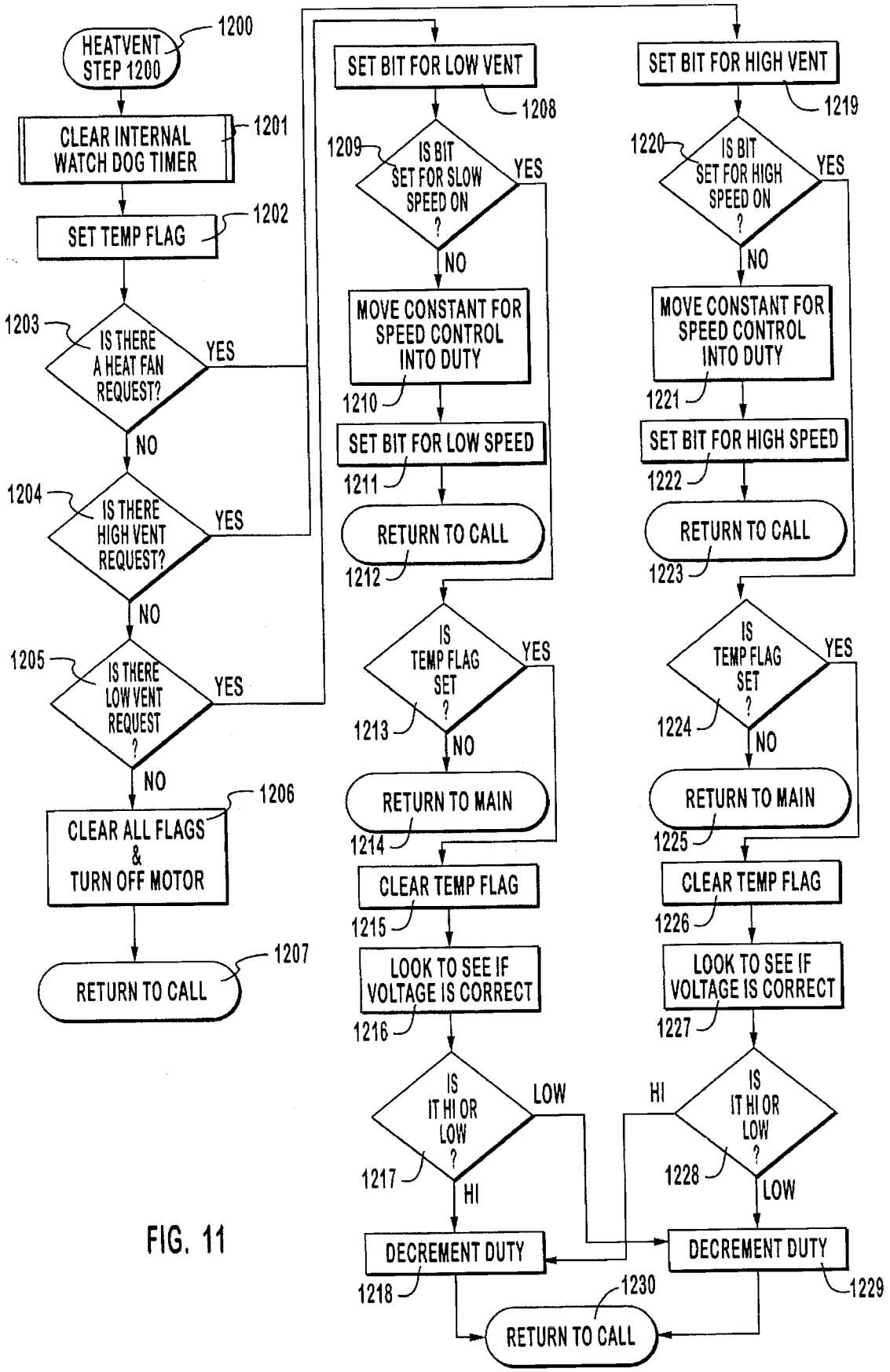

In FIG. 11, high and low speeds of the blower fan are controlled given a variety of operation conditions.

Figure 12:
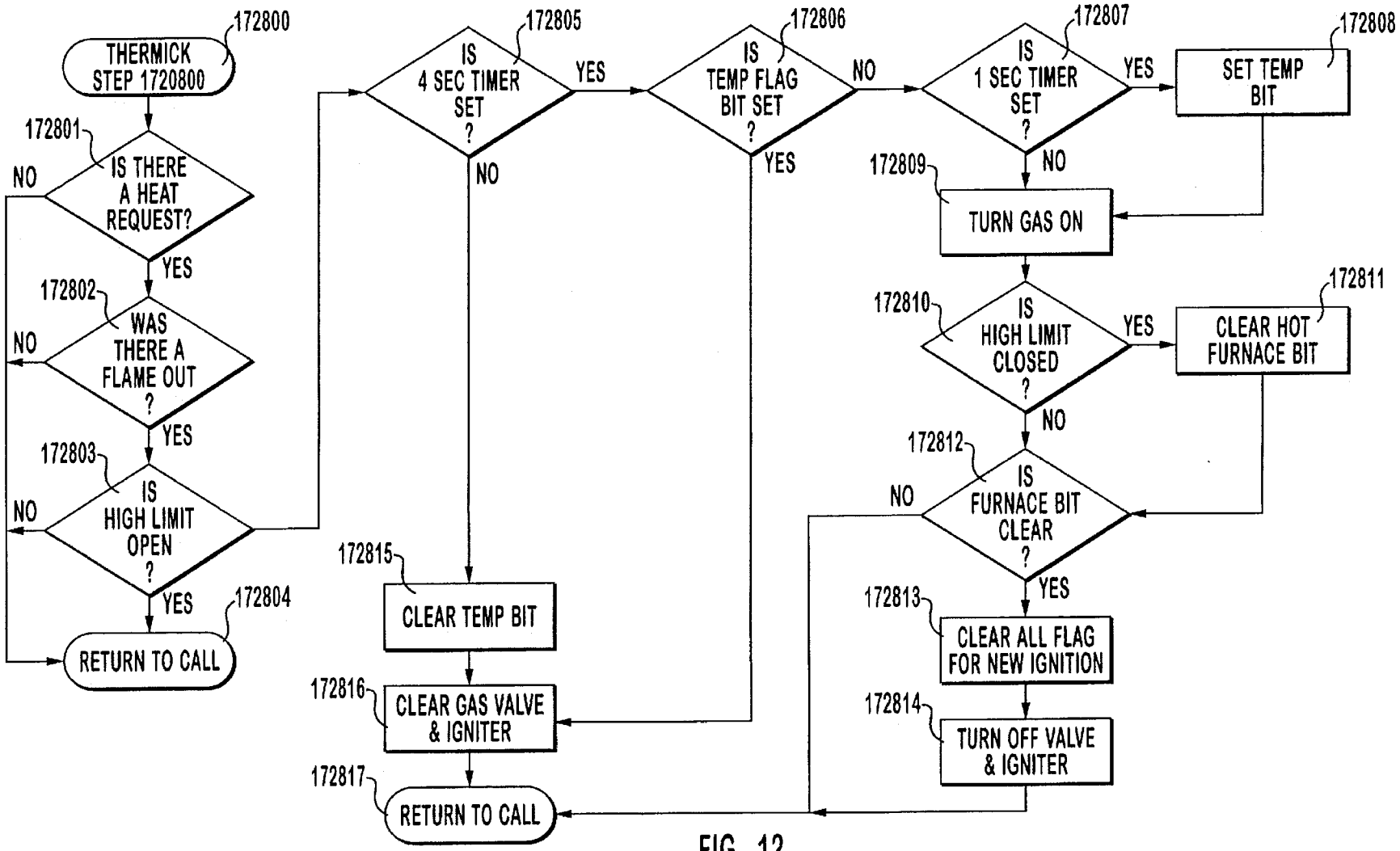

In FIG. 12, verification of the presence of the flame is determined as well as a utility performed for determining if the furnace is overheating.

Figure 13:
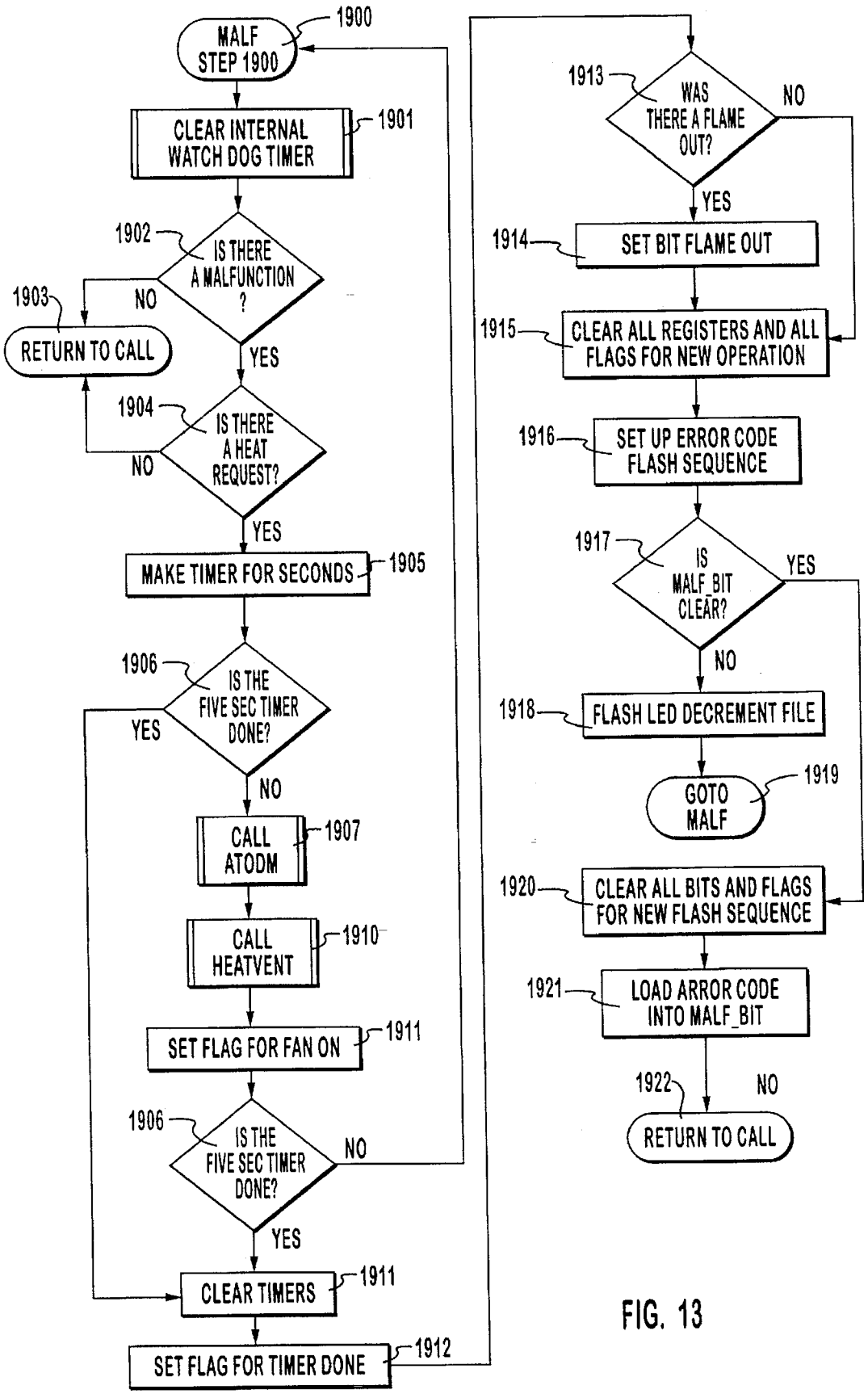

FIG. 13 monitors the overall system to determine if a malfunction has occurred and will initiate visual alarms in the event of an operational malfunction.

Figure 14:
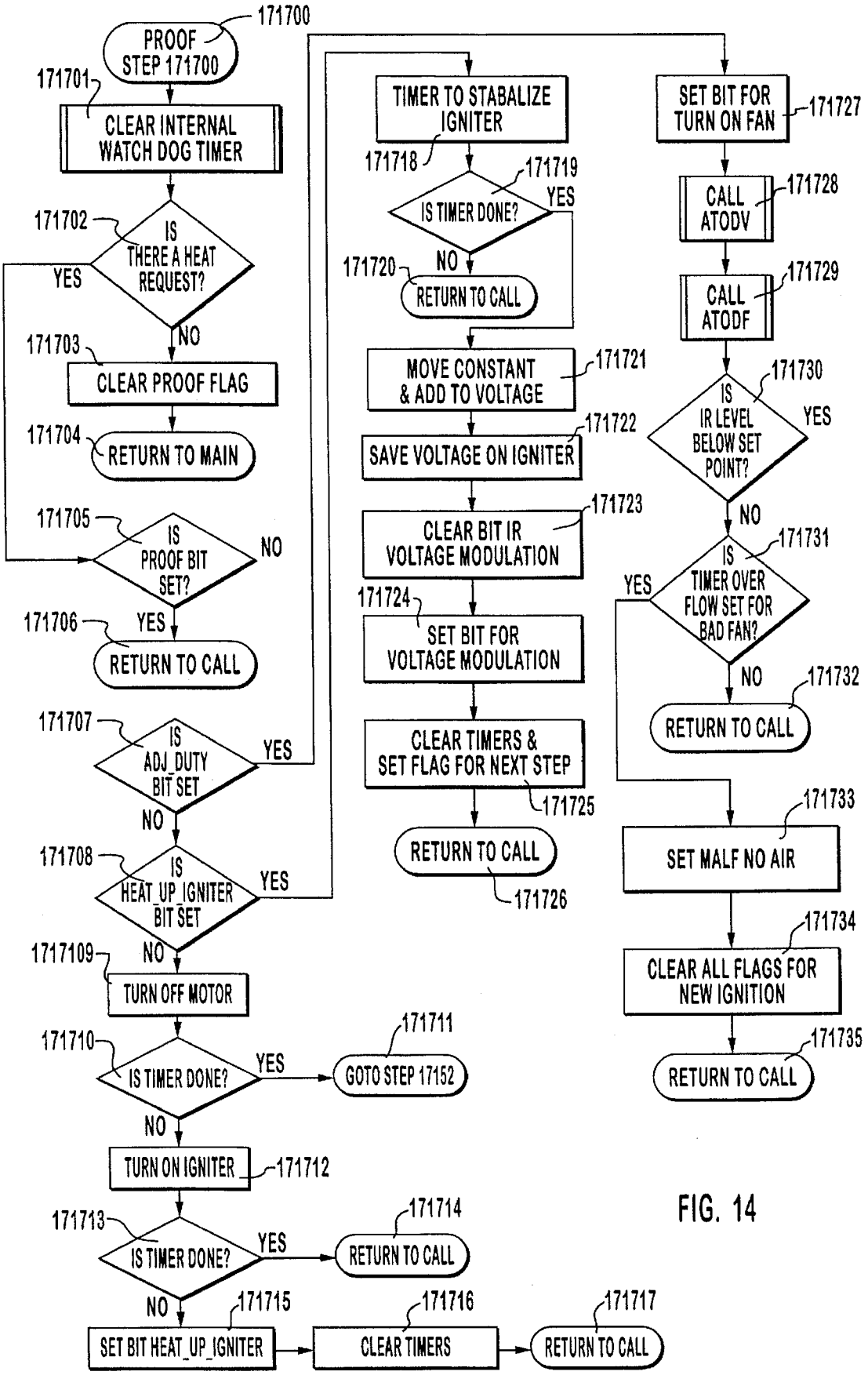
Figure 15A:
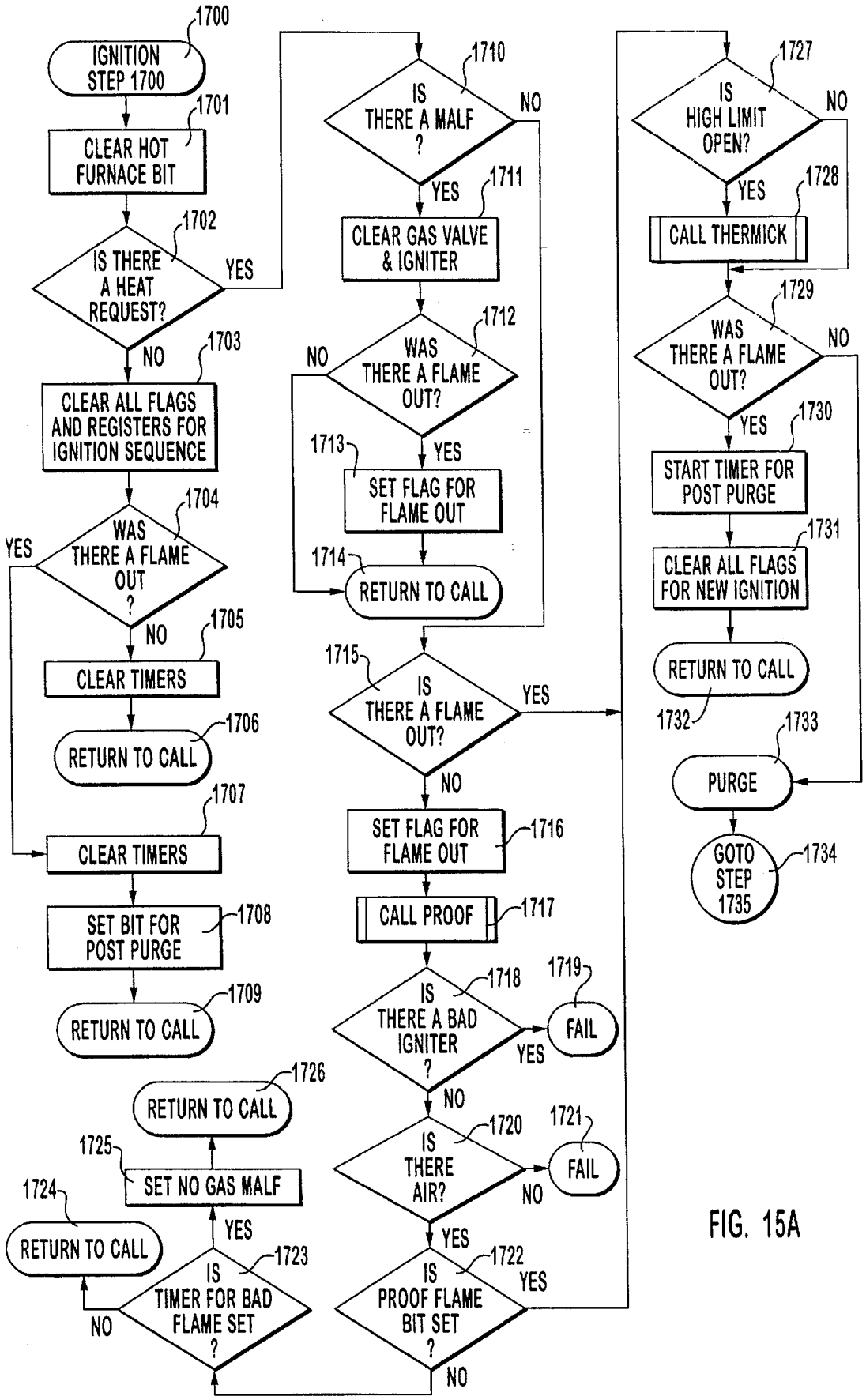
Figure 15B:
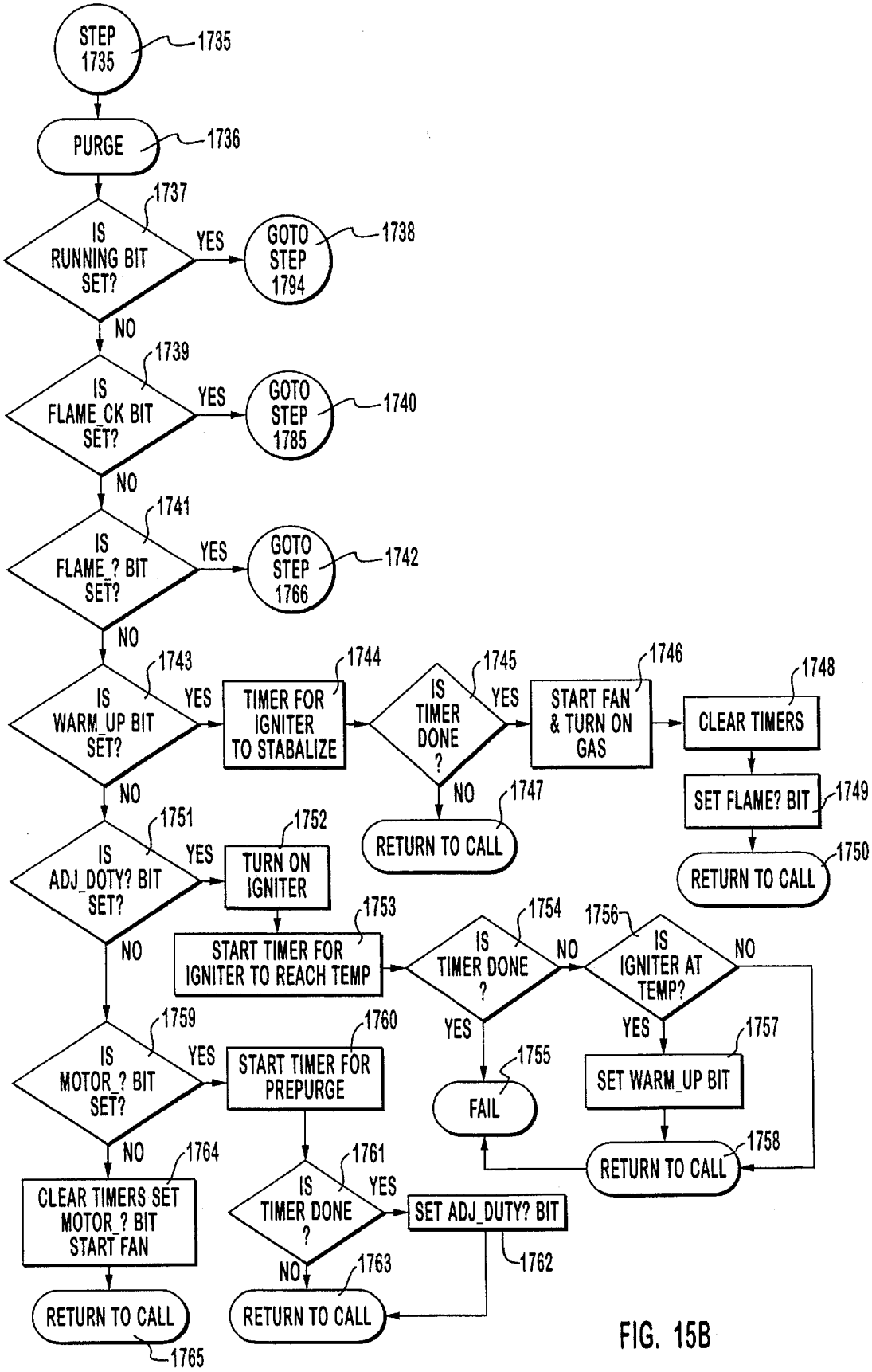
Figure 15C:
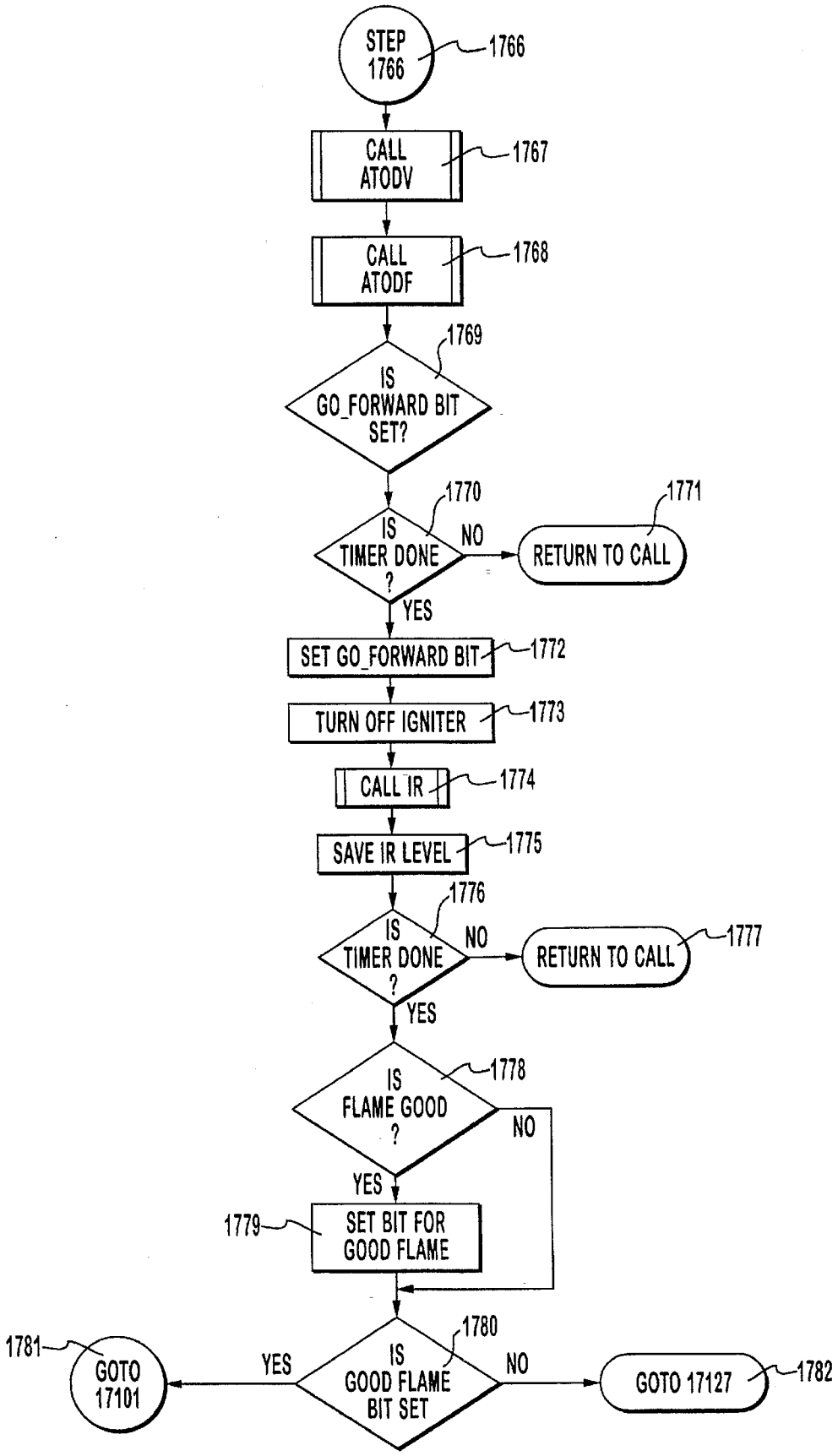
Figure 15D:
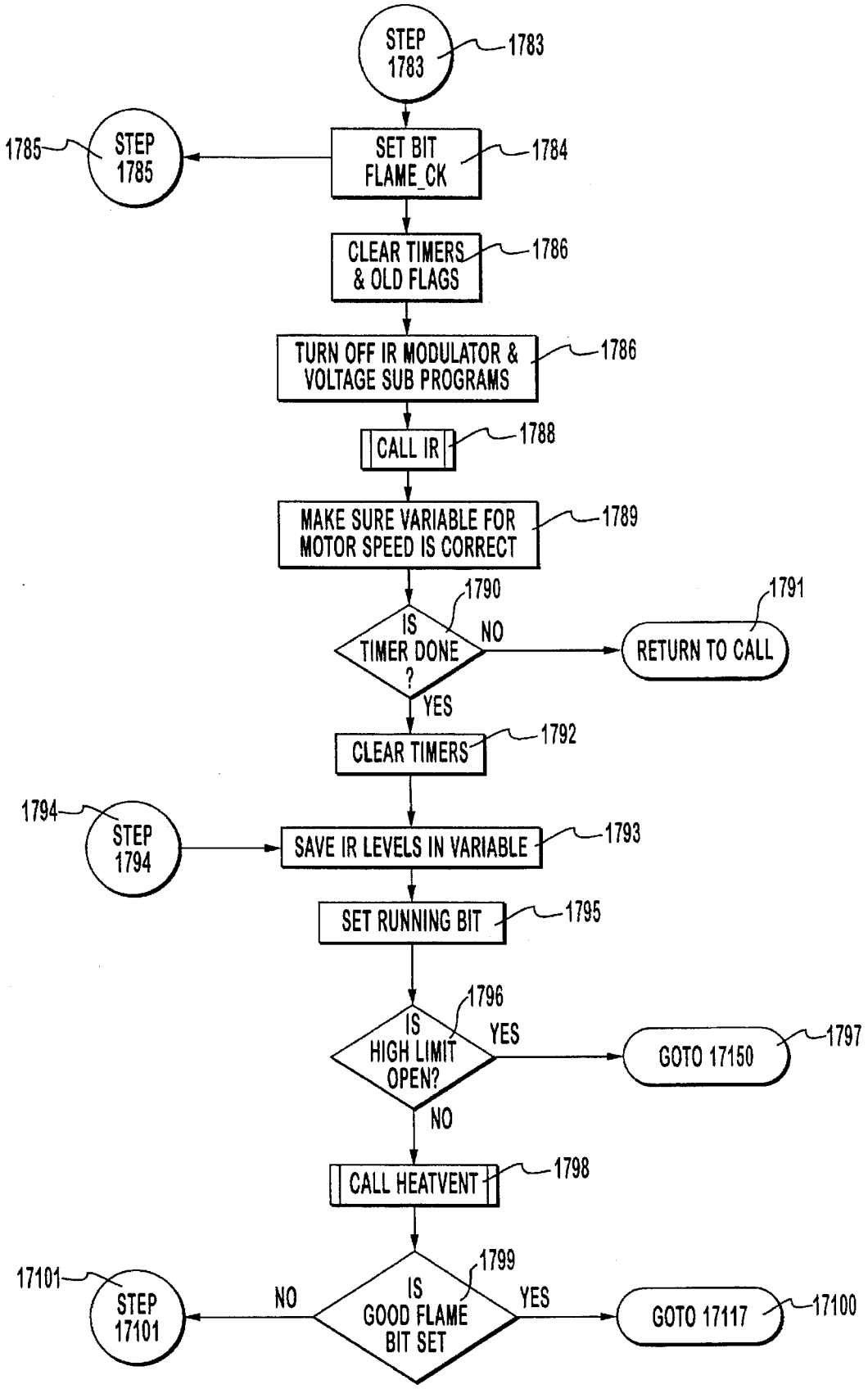
Figure 15E:
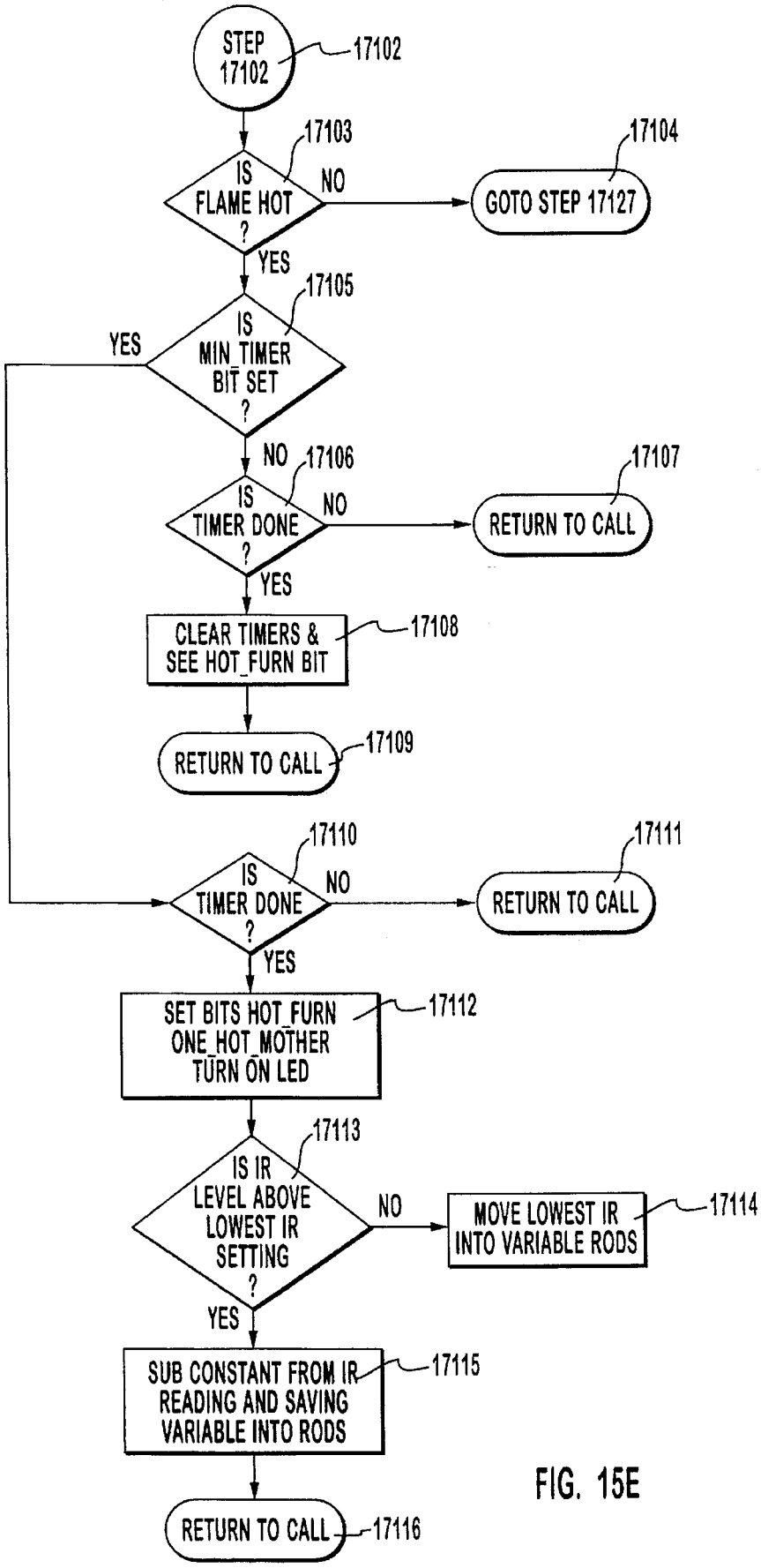
Figure 15F:
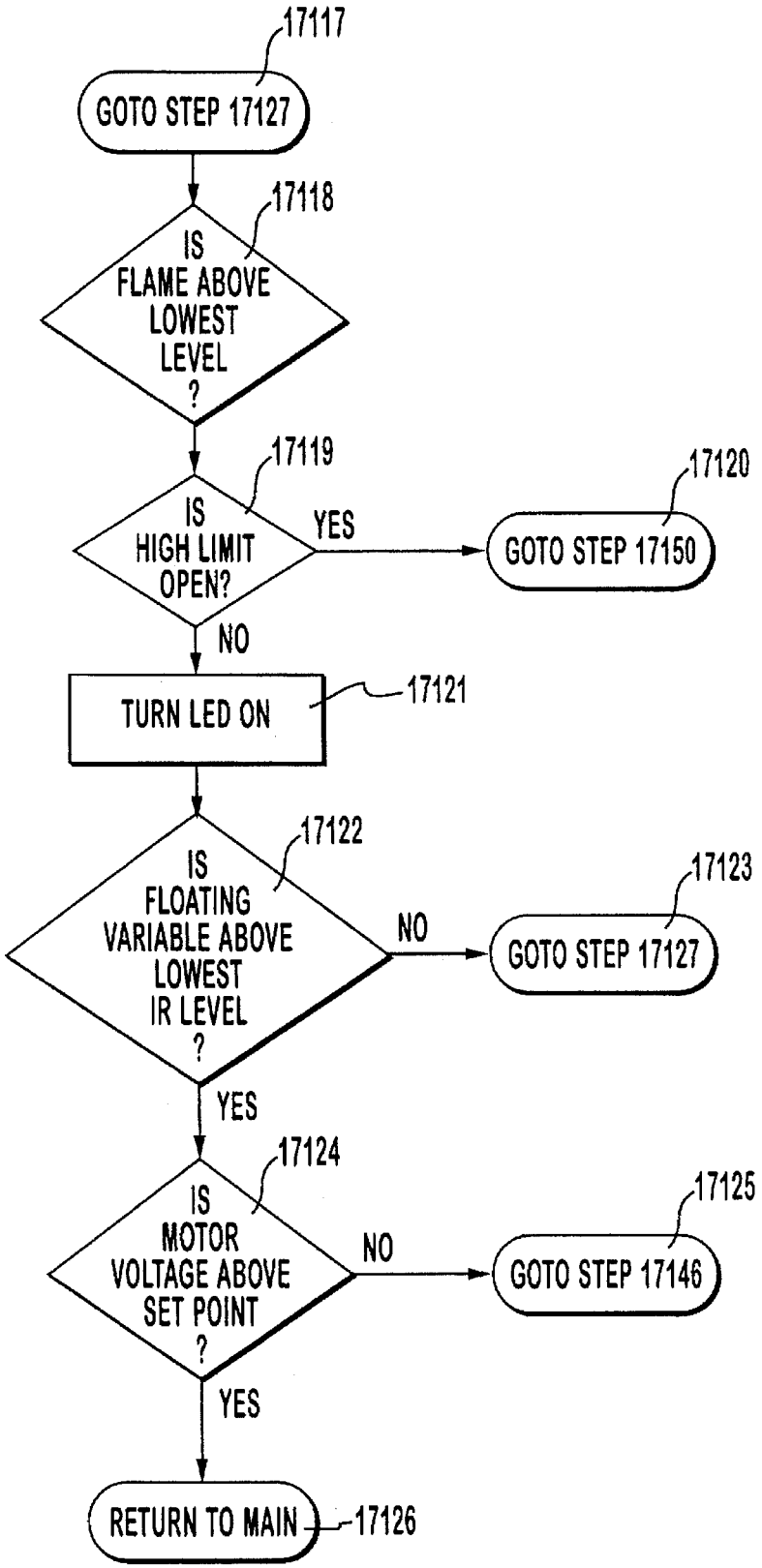
Figure 15G:
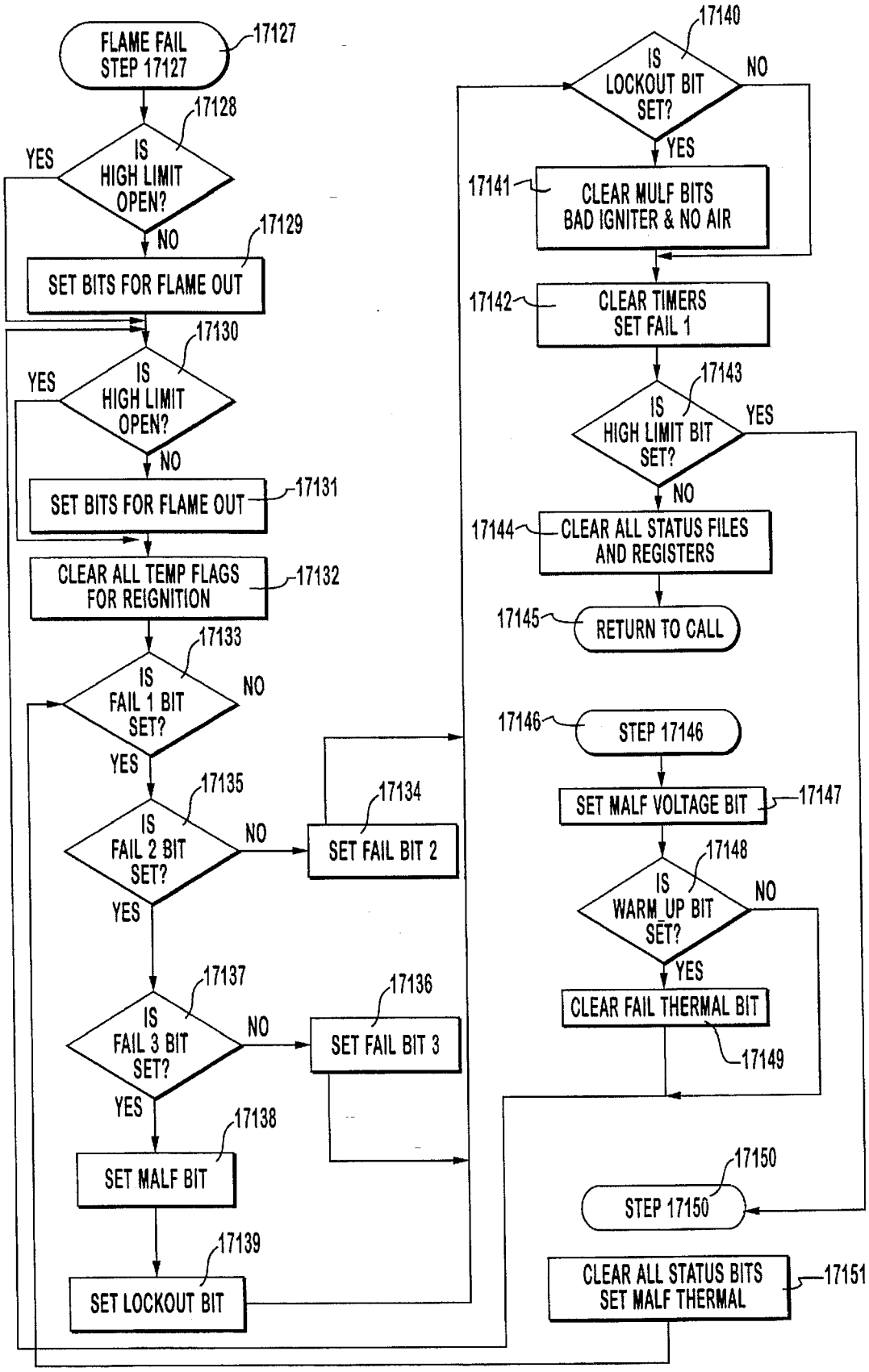
Figure 15H:
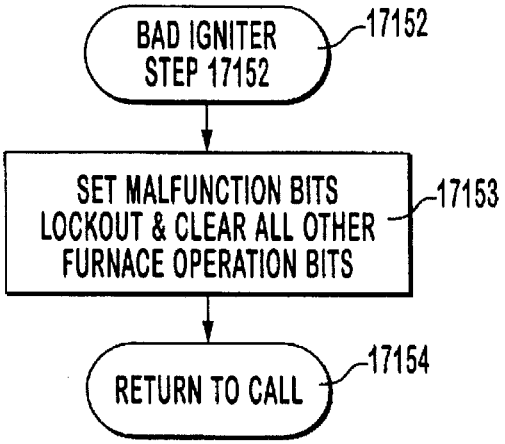

FIG. 14 shows steps to perform the sail switch function, as described above, in which a decrease in infrared radiation is detected from the first radiator as a flow of air engulfs the first radiator during the electrical resistance heating thereof to determine that an adequate flow of air is entering the furnace combustion chamber. Appropriate flags are set in the event that insufficient air supply is reaching the combustion chamber as determined by the detection of infrared radiation and predetermined standards for proper infrared radiation in application specific circumstances.

FIGS. 15A–15H graphically depict steps performed by the inventive method controlling most basic functions of the furnace. Particularly, monitoring of infrared radiation between predetermined low and high levels form the basic routine enacted by the depicted program steps titled "IGNITION".

Figure 16:
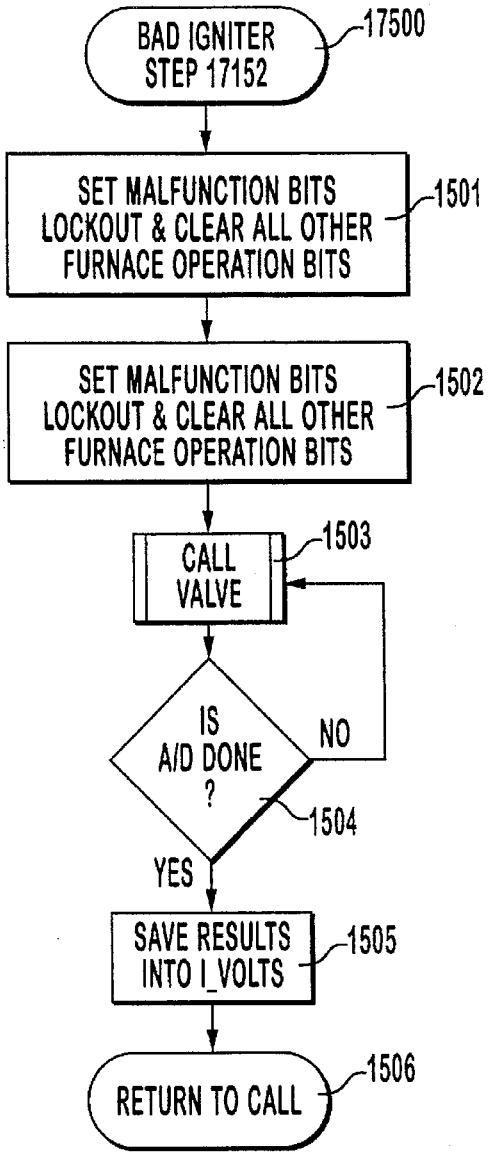

In FIG. 16, a routine is graphically depicted for reading the voltage applied to the first radiator, which is the ignition coil for igniting the combustible gas in the combustion chamber of the furnace. By monitoring the voltage applied to the ignition coil, it may be determined whether the ignition coil is inoperable due to structural failure, or whether it is being heated properly to a temperature necessary for hot surface ignition of the combustible fuel in the combustion area of the furnace.

Figure 17:
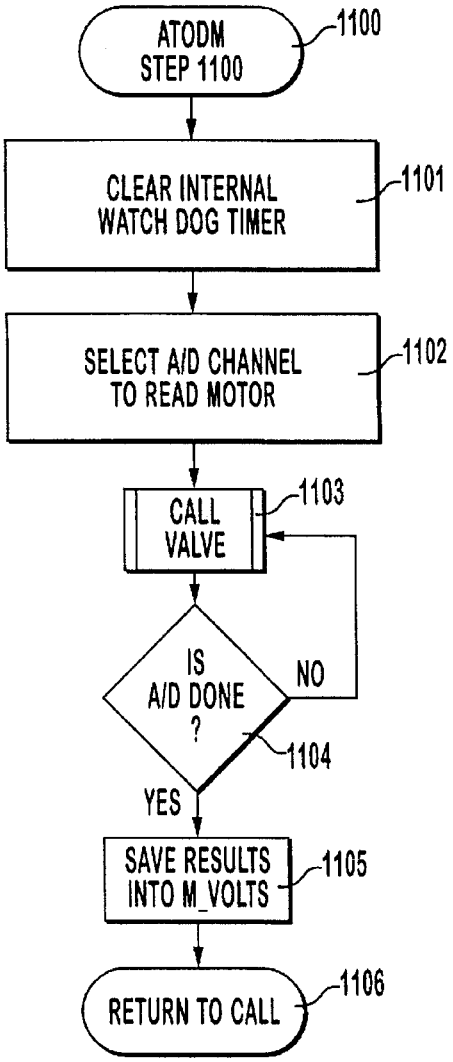

FIG. 17 graphically depicts a routine for reading the voltage applied to the motor of the blower fan so as to monitor the operation thereof.

Figure 18:
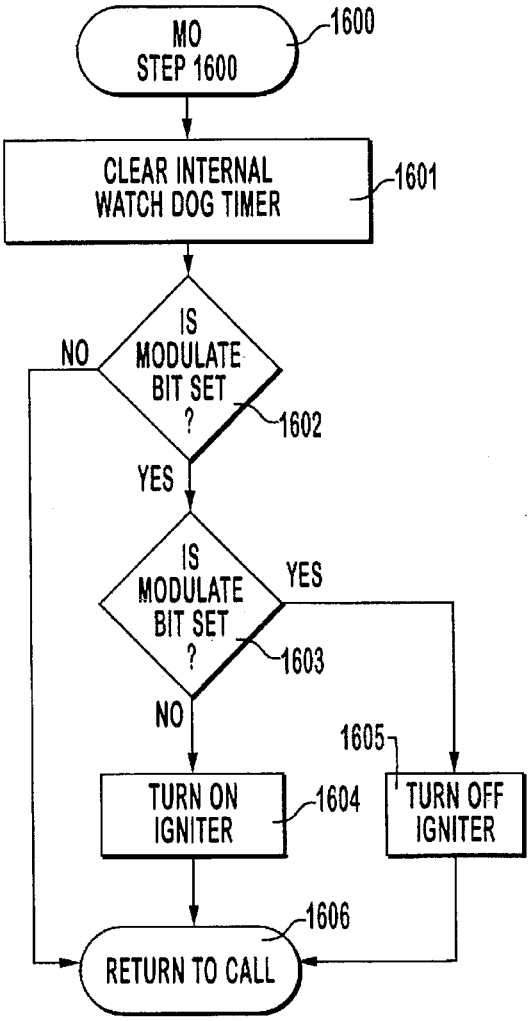

FIG. 18 is a routine for modulation of the voltage of the ignition coil to determine and to verify, in addition to other routines set forth elsewhere, whether the ignition coil is of sufficient temperature for hot surface ignition of the combustible fuel.

Figure 19:
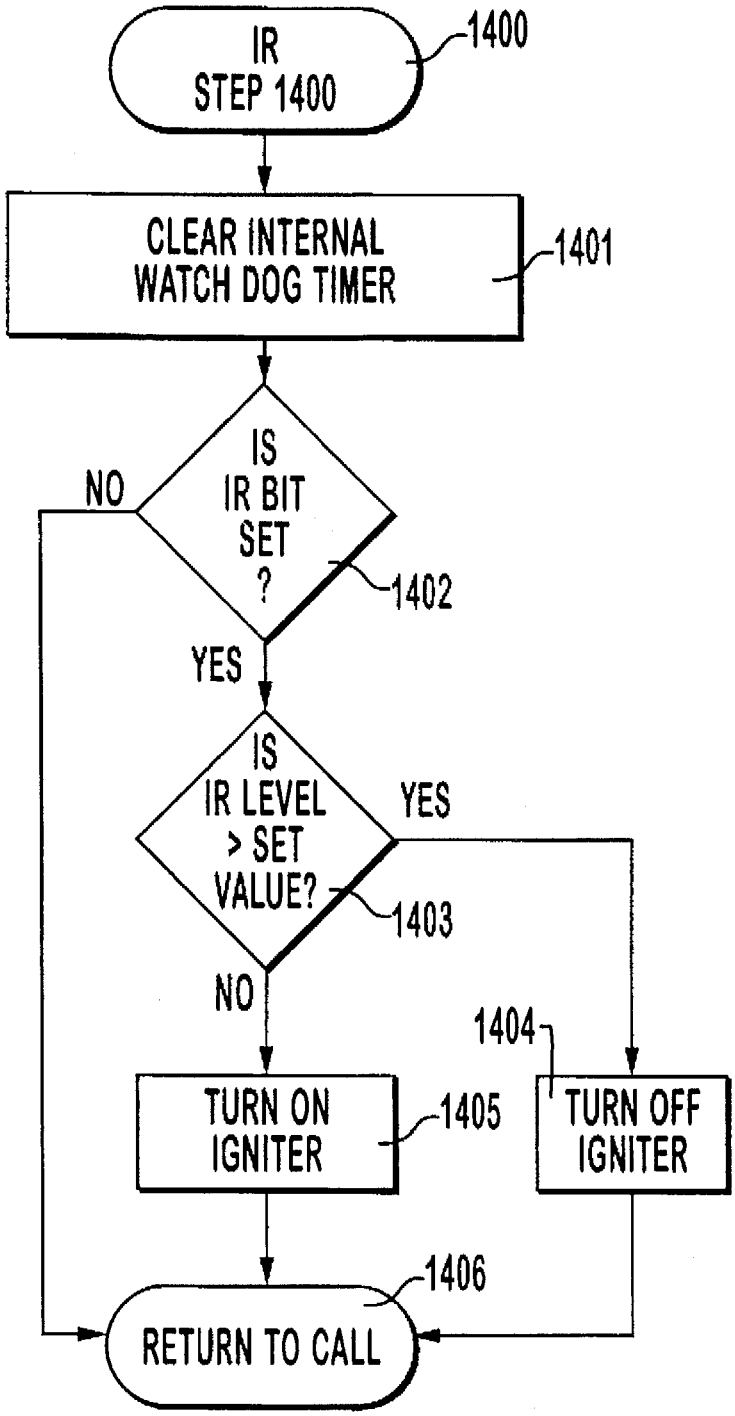
Figure 15G:
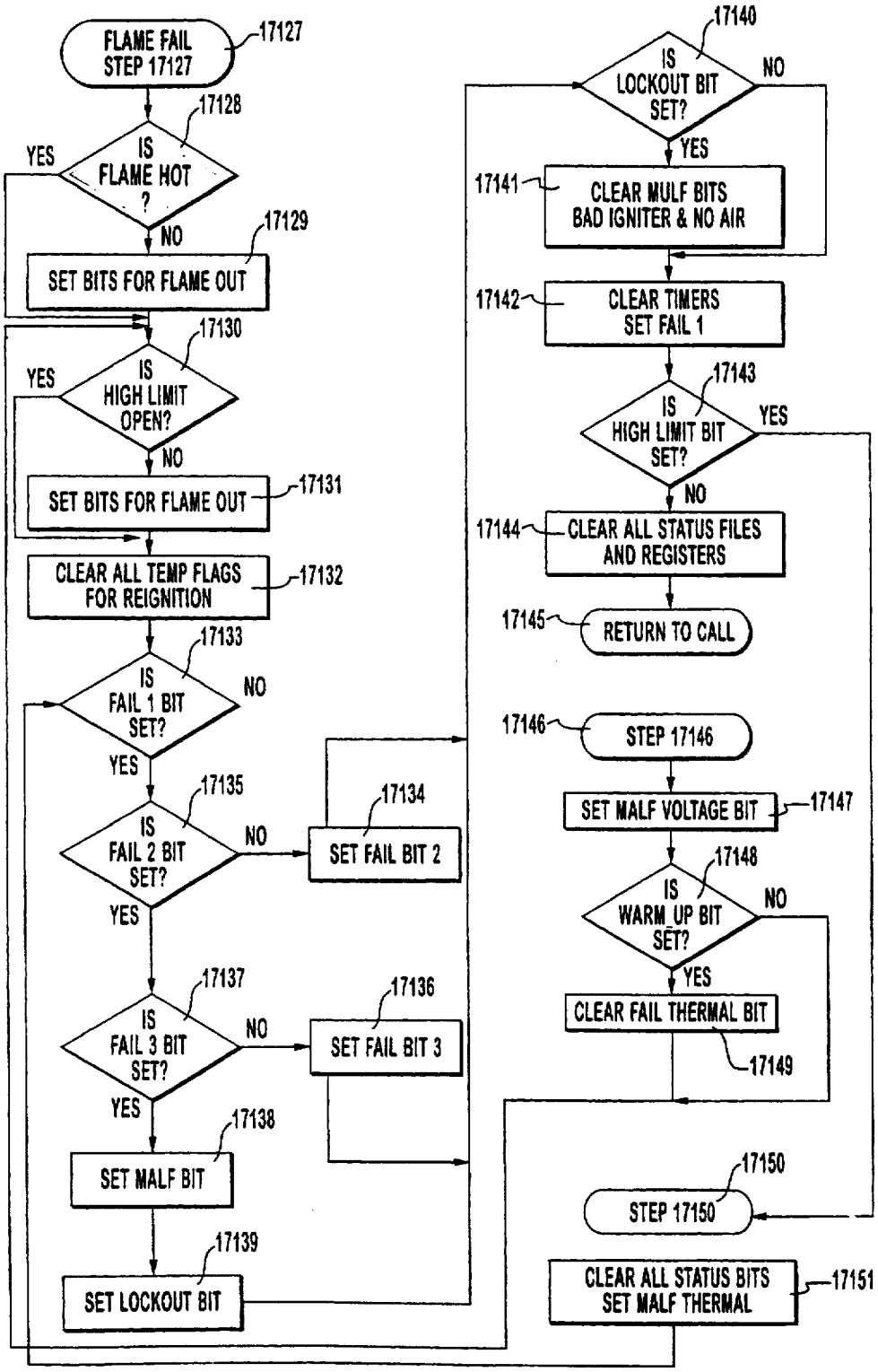

FIG. 19 is a routine for modulating the infrared level detected by the infrared sensor, and for regulating the voltage applied to the ignition coil, while also comparing the detected infrared radiation from the first radiator to a predetermined standard for such radiation maintained in a data memory storage area associated with the microprocessor.

The figures depicting flowcharts may be further understood by referencing their calling routines, by the source code routines of like-title in Appendix A, by the flow chart step descriptions in Appendix B, or by the general descriptions for the system and method of the present invention set forth herein.

It will be appreciated that the microprocessor 92 of FIG. 4, or the digital processor IC1 of FIG. 5 which is identified as a 16C71 microprocessor, could be programmed so as to implement the above-described method using any one of a variety of different programming languages and programming techniques.

The method of the present invention is carried out under the control of a program resident in the 16C71 microcomputer and associated circuitry. Those skilled in the art, using the information given herein, will readily be able to assemble the necessary hardware, either by purchasing it off-the-shelf or by fabricating it and properly programming the microprocessor in either a low level or a high level programming language. While it is desirable to utilize clock rates that are as high as possible, and as many bits as possible in the incorporated A/D converters, the application of the embodiment and economic considerations will allow one skilled in the art to choose appropriate hardware for interfacing the microprocessor with the remainder of the embodiment. Also, it should be understood that for reasons of simplifying the diagrams, power supply connections, as well as other necessary structures, are not explicitly shown in the figures, but are provided in actuality using conventional techniques and apparatus.

TABLE I

IGNITOR PARTS LIST

| DESCRIPTION | DEVICE | QUANTITY |
|---|---|---|
| SHOULDER WASHER | KEYSTONE PART | 1 |
| SPACER | KEYSTONE PART | 1 |
| LOCK RING | AU-VE-CO PART | 1 |
| METAL BRACKET | | 1 |
| MICA INSULATOR | KEYSTONE PART | 1 |
| SPADE LUG SMALL | KEYSTONE PART | 1 |
| SPADE LUG | KEYSTONE PART | 2 |
| CIRCUIT BOARD | | 1 |
| PIN DIODE IR | SHARP PD410P1 | 1 |
| NUT | 6-32 | 4 |
| KANTHAL ROD | GA.127 | 2 |
| KANTHAL WIRE | GA.0142 | 2 |
| LOCK WASHER | ARDEN FASTENER | 2 |

TABLE II

FURNACE CONTROLLER PARTS LIST

| DESCRIPTION | DEVICE | QUANTITY |
|---|---|---|
| POWER MOSFET | 1RFZ40 | 1 |
| POWER DIODE | MUR1520 | 1 |
| VOLTAGE REGULATOR +5 | 7805CT | 1 |
| DARLINGTON TRANSISTOR | TIP117 | 2 |
| P-MOSFET | IRF9Z30 | 1 |
| N-MOSFET | IRF530 | 1 |
| FET | IRF020 | 1 |
| HIGH SIDE DRIVER | MIC5014 | 1 |
| N-FET | 2N7000 | 2 |
| N-TRANSISTOR | 2N4401 | 6 |
| P-TRANSISTOR | 2N4403 | 1 |
| MICROPROCESSOR | PIC16C71 | 1 |
| CAPACITOR | 330 uF 25 V | 3 |
| LOW IMPEDANCE CAPACITOR | 10 uF 50 V | 1 |
| CAPACITOR | 1 uF 50 V | 3 |
| CAPACITOR | .1 uF | 6 |
| RESONATOR | KBR4.00MKST | 1 |
| DIODE | 1N4002 | 12 |
| ZENER DIODE | IN5226 | 1 |
| RESISTOR | 10M OHM | 1 |
| RESISTOR | 200K OHM | 2 |
| RESISTOR | 100K OHM | 1 |
| RESISTOR | 91K OHM | 1 |

TABLE II-continued

FURNACE CONTROLLER PARTS LIST

| DESCRIPTION | DEVICE | QUANTITY |
|---|---|---|
| RESISTOR | 51K OHM | 2 |
| RESISTOR | 10K OHM | 19 |
| RESISTOR | 5.1K OHM | 3 |
| RESISTOR | 2K OHM | 1 |
| RESISTOR | 1K OHM | 1 |
| RESISTOR | 510 OHM | 1 |
| LED | MAA3368S | 1 |
| MINI-FIT CONNECTOR | 39-29-1188 | 1 |
| MINI-FIT CONNECTOR | 39-01-2180 | 1 |
| MINI-FIT CONNECTOR PINS | 39-00-0060 | 18 |
| CIRCUIT BOARD | | 1 |
| STAND OFF | | 4 |
| CONFORMAL COATING | | 1 |
| ALUMINUM BRACKET | | 1 |
| BOLT #4-40 | F581M | 4 |
| NUT #4-40 | F557M | 3 |
| MICA-INSULATOR | 242-4672 | 3 |
| SHOULDER WASHER | | 3 |

MAIL R
PAT. & TRA

APPENDIX A

SOFTWARE PROGRAM SOURCE CODE

```
a:\furn.asm                                                                    Page    1
Printed 09:20 09 Jan 95

          LIST P = 16C71
;
;##############################################################
;## FURN.ASM new igniter                                     ##
;##############################################################
;
INCLUDE   'REGS71.PIC'                  ;Microprocessor register
;                                         equates
          ORG       0C                  ;RAM base address
;
INCLUDE   'VARSFURN.PIC'                ;RAM address equates
;
          ORG       0000                ;Program base address
;
INCLUDE   'INIT.PIC'                    ;Initializion Subroutine
;
MAIN
          clrwdt                        ;clear watch dog
          movlw     roption             ;ESD protection
          option                        ;ESD protection
          clrwdt                        ;clear watch dog    call      DDRA
          call      DDRB                ;ESD protection
          call      PORTA               ;update porta outputs
          call      ATODM               ;atod reading on motor
          call      HEATVENT            ;modulate motor
          call      ATODF               ;atod reading on igniter ir
          call      IR                  ;modulate igniter
          call      ATODV               ;atod reading on volts on igniter
          call      VALVE               ;modulate valve
          call      MO                  ;modulate voltage on igniter
          call      IGNITION            ;sub program to start ignition sequence
          btfss     stat2,fail_thermal  ;looking for fail high limit
          call      MALF                ;sub program for malf
          goto      MAIN                ;jump to top of program
;
INCLUDE   'REGSUBS.PIC'                 ;Register manipulation subroutines
;                                         for 16C71 operation
INCLUDE   'HEATVENT.PIC'
;
INCLUDE   'ATODM.PIC'
;
INCLUDE   'ATODF.PIC'
;
INCLUDE   'IR.PIC'
;
INCLUDE   'VALVE.PIC'
;
INCLUDE   'ATODV.PIC'
;
INCLUDE   'PROOF_4.PIC'
;
INCLUDE   'IGNITION.PIC'
;
INCLUDE   'IR_MOT.PIC'
;
INCLUDE   'MULF.PIC'
;
INCLUDE   'THERMCK.PIC'
;

          END
```

```
e:\furn\varsfurn.pic                                                    Page    1
Printed 15:57 06 Jan 95

;##############################################################
;##  VARS.PIC new igniter                                    ##
;##        Varriable declarations for the Furnace            ##
;##        Contents are Ram locations and pin assignments    ##
;##############################################################
;
; Variable Declarations
;
masklow             equ       0xF0
maskhi              equ       0x0F
maxdelay            equ       .255
duty_max            equ       .253
low_                equ       .93        ;duty cycle for low vent
hi_                 equ       .240       ;duty cycle for high vent
volt_6              equ       .80        ;low ventilator voltage
;****************************** NEED TO CHANGE TO 99 *******
volt_10             equ       .100       ;102 = 10 volts high ventilator voltage
volt_limit          equ       .250
shut_off_volt       equ       .80        ;low voltage on motor
light               equ       .20        ;air speed for fan when lighting furn
;****************************** NEED TO CHANGE TO 99 *******
mid_light           equ       .100       ;****.101 mid air flow for ignition
ir_set              equ       .250       ;number set for igniter for lighting furn
light_flame         equ       .230       ;IR level that igniter lights
lower_ir            equ       .2         ;lowest level for fan test
purgetime           equ       .12        ;purge time
slow_time           equ       .3
warm_time           equ       .1
supper_charger      equ       .1
prooftime           equ       .5         ;(1 sec)***** flame proof time
good_time           equ       .10        ;flame stabilizer !!!!!
three_try           equ       .5         ;after three trys fan turns on three sec.
flamechk            equ       .5         ;flame has to be greater than this number
flame_stable        equ       .15        ;flame chk after one min
running_time        equ       .2         ;time for ir element heat up
running_min         equ       .40        ;heating up rods timmer
;************************need to change to .56  ************
hot                 equ       .84        ;post purge timer
igniter_ck          equ       .8         ;time for igniter to heat up
igniter_proof       equ       .8         ;time for igniter to heat up
flame_detect        equ       .30
flame_add           equ       .5         ;number added for flame proof
volt_add            equ       .12
proof_test          equ       .20
rod_num             equ       .25        ;number sub from rod IR in last stage
rods_min            equ       .2
debounce            equ       .2


; RAM Varriables Assignments

intw       equ       0C        ; interrupt storage for w reg
intstat    equ       0D        ; interrupt storage for status byte
tempw      equ       0E        ; temporary storage for w reg
stat       equ       0F        ;
ramporta   equ       10        ; rev a port operation workaround
ddra       equ       11        ; data direction ram backup porta
ddrb       equ       12        ; data direction ram backup portb
timem      equ       13        ; \ Timers -
times      equ       14        ; /
ir         equ       15        ;
m_volts    equ       16        ;
i_volts    equ       17        ;
tempiture  equ       18        ;
```

```
e:\furn\varsfurn.pic                                                    Page    2
Printed 15:57 06 Jan 95

delay      equ      19        ;
atod       equ      1A        ;
furn       equ      1B        ;
furn1      equ      1C        ;
duty       equ      1D        ;
volt_low   equ      1E        ;
volt_high  equ      1F        ;
malf       equ      20        ;
ignitstat  equ      21        ;
save_volt  equ      22        ;
save_duty  equ      24        ;
stat1      equ      25        ;
save_ir    equ      26        ;
set_ir     equ      27        ;
malf_bit   equ      28        ;
rods       equ      29        ;
ir_setting          equ       2A        ;
stat2      equ      2B        ;
;          equ      2C        ;
;          equ      2D        ;
;          equ      2E        ;
;          equ      2F        ;LAST RAM VECTOR

;*** atod - channel select bits ***

ch0        equ      0         ;1 =
ch1        equ      1         ;1 =
ch2        equ      2         ;1 =
ch3        equ      3         ;1 =
ch4        equ      4         ;1 =
;          equ      5         ;1 =
;          equ      6         ;1 =
err        equ      7         ;1 =

;*** stat - sensor heater and detection status bits          ***
hot_furn   equ      0         ;
ignite     equ      1         ;
heat       equ      2         ;
fail       equ      3         ;
fail_1     equ      4         ;
fail_2     equ      5         ;
high_duty  equ      6         ;
flameout   equ      7         ;

;*** stat1 - sensor heater and detection status bits         ***
proof_bit  equ      0         ;
therm?     equ      1         ;
open       equ      2         ;
sec5       equ      3         ;
min_timer  equ      4         ;
one_hot_mother      equ       5         ;
go_forward          equ       6         ;
finish_flame_proof  equ       7         ;

;*** stat2 - sensor heater and detection status bits         ***
;          equ      0         ;
;          equ      1         ;
;fail_thermal        equ       2         ;
;          equ      3         ;
;          equ      4         ;
;          equ      5         ;
;          equ      6         ;
;lockout   equ      7         ;
```

```
e:\furn\varsfurn.pic                                                    Page    3
Printed 15:57 06 Jan 95

;*** furn - cheak low,high vent,heatrequest        ***

gas?                    equ     0       ;
lmotor_on               equ     1       ;
hmotor_on               equ     2       ;
adjvolts                equ     3       ;
therm_close             equ     4       ;
therm_timer             equ     5       ;
heat_up_igniter                 equ     6       ;
thermal_limit_cycle             equ     7       ;

;*** furn1 - cheak low,high vent,heat request      ***

motor?                  equ     0       ;
ir?                     equ     1       ;
purge?                  equ     2       ;
mo?                     equ     3       ;
warm_up                 equ     4       ;
running                 equ     5       ;
;                       equ     6       ;
hour                    equ     7       ;

;***  ignitstat - sensor heater and detection status bits   ***

time        equ     0       ;
flame?      equ     1       ;
gas_?       equ     2       ;
motor_?     equ     3       ;
igniter_?   equ     4       ;
flame_ck?   equ     5       ;
ign_hot     equ     6       ;
adj_duty?   equ     7       ;

;*** timem - timing values      ***

kil         equ     0       ;64ms
;           equ     1       ;128ms
malf_blink          equ     2           ;256ms
;           equ     3       ;512ms
sec         equ     4       ;1024ms
look        equ     4       ;1024ms
look_2      equ     5       ;2sec
l_speed     equ     5       ;2sec
sec4        equ     6       ;4
blink       equ     6       ;4
eight       equ     7       ;8
;*** times - timing values     ***

;           equ     0       ;16
s32         equ     1       ;32
;           equ     2       ;1min
;           equ     3       ;2min
min4        equ     4       ;4min
min         equ     5       ;8min
;           equ     6       ;16min
;           equ     7       ;32min
;*** malf - malfunction byte   ***

bad_ignitor             equ     0       ;
flame_fail              equ     1       ;
fail_thermal            equ     2       ;
fail_voltage            equ     3       ;
no_air      equ     4       ;
led_test    equ     5       ;
test        equ     6       ;
```

```
e:\furn\varsfurn.pic                                                    Page    4
Printed 15:57 06 Jan 95

lockout   equ       7         ;
```

```
e:\furn\valve.pic                                                    Page    1
Printed 15:59 06 Jan 95

;##########################################################
;#                                                        #
;#        VALVE PROGRAM new igniter                       #
;#                                                        #
;#                                                        #
;##########################################################

VALVE
          clrwdt                        ;clear watch dog
          btfss     furn,gas?           ;look if flag is set
          return                        ;return to main program
          btfss     rtcc,kil            ;look if timer flag is set
          goto      VALVE_OFF           ;if not set jump
VALVE_ON
          bsf       portb,valve         ;turn port pin on
          return                        ;return to main program
VALVE_OFF
          bcf       portb,valve         ;turn port pin off
          return                        ;return to main program
```

```
e:\furn\thermck.pic                                                    Page    1
Printed 16:00 06 Jan 95

;#############################################################
;#        THERMCK.PIC new igniter                            #
;#                                                           #
;#                                                           #
;#############################################################

THERMCK
          clrwdt                                  ;clear watch dog
          btfsc     portb,h_request               ;looking for heat request
          goto      THERMCK_END                   ;if heat goto end
          btfss     stat,flameout                 ;looking for flame out
          goto      THERMCK_END                   ;if no flame out goto end
          btfss     malf,fail_thermal             ;looking for open high limit
          goto      THERMCK_END                   ;if no open goto end
          btfsc     stat1,one_hot_mother          ;looking to see if furnace was hot
          goto      THERMCK_END                   ;if no goto end
          btfss     timem,sec4                    ;looking for timer bit if set
          goto      THERM_TEST                    ;jump to
          btfsc     furn,therm_timer              ;is timer bit clear of set
          goto      THERM_TEST2                   ;jump if set
          btfsc     timem,look                    ;looking for 4 sec timer flag
          bsf       furn,therm_timer              ;set flag if yes
          bsf       furn,gas?                     ;turn on gas routine
          btfss     portb,therm_shut              ;look for high limit closed
          bcf       stat,hot_furn                 ;clear hot furnace
          btfsc     stat,hot_furn                 ;looking if furnace is hot
          goto      THERMCK_END                   ;jump to end if hot
          bcf       malf,fail_thermal             ;clear malf high limit flag
          bcf       stat,flameout                 ;clear falme out flag
          bcf       stat,heat                     ;clear motor flag
          clrf      furn                          ;clear status flags
          clrf      furn1                         ;        "
          clrf      ignitstat                     ;        "
          bcf       ignitstat,motor_?             ;        "
          bcf       stat1,one_hot_mother          ;        "
          bcf       stat1,min_timer               ;clear all bits
          bcf       stat1,proof_bit               ;clear bit for fan chk
          bcf       portb,led                     ;turn off led
          bcf       portb,igniter                 ;turn off igniter
          clrf      timem                         ;clear timers
          clrf      times                         ;        "

THERM_TEST
          bcf       furn,therm_timer              ;clear timer bit
THERM_TEST2
          bcf       portb,valve                   ;clear port pin
          bcf       furn,gas?                     ;clear gas flag
          bcf       portb,igniter                 ;turn off igniter

THERMCK_END
          return                                  ;return to main
```

```
;##############################################################
;## REGSUBS.PIC new igniter                                  ##
;##       Subroutines for register manipulation unique      ##
;##       to the 16C71                                      ##
;##############################################################
;
;************************************************************
;* DDRA   -  Routine to set Data Direction for port b       *
;************************************************************

DDRA
          movf      ddra,w              ;load data direction
          tris      porta               ; ram address and store
          return                        ; in data diriction port

;************************************************************
;* DDRB   -  Routine to set Data Direction for port b       *
;************************************************************

DDRB
          movf      ddrb,w              ;load data direction
          tris      portb               ; ram address and store
          return                        ; in data direction port

;************************************************************
;* PORTA  -  Port A bit set/write routine                   *
;************************************************************

PORTA
          movf      ramporta,w          ;load porta ram vector
          movwf     porta               ; and store on port
          return                        ; (REV A WORKAROUND)

;************************************************************
;* ADREAD - Subroutine to read a/d port.  Channel set prior *
;*          to subroutine entry                             *
;************************************************************

ADREAD
          bsf       adcon,go            ;start a/d conversion
ADLOOP
          btfss     adcon,adif          ;conversion complete?
          goto      ADLOOP              ;loop until done
          movf      adres,w             ;load a/d result
          return                        ;
;*******************************************************
;
;* DELAY - Gerneral Purpose Delay routine
;*******************************************************

DELAY
          movlw     maxdelay            ;30 microsecond delay
          movwf     delay               ;using maxdelay = 8
LOOP
          call      VALVE
          decfsz    delay               ;decrement counter
          goto      LOOP                ;if not zero, loop
          return                        ; else, return
```

```
e:\furn\regs71.pic                                                    Page    1
Printed 16:01 06 Jan 95

;##############################################################
;##  REGS.PIC new igniter                                     ##
;##        Global declarations of all system addresses and    ##
;##        bit assignments to control registers               ##
;##############################################################

; FILE ASSIGNMENTS

rtcc      equ       01h
pc        equ       02h
status    equ       03h
fsr       equ       04h
porta     equ       05h
portb     equ       06h
adcon     equ       08h
adcon1    equ       88h
adres     equ       09h
pclath    equ       0Ah
intcon    equ       0Bh

;***      status register

c         equ       0                   ;carry bit
z         equ       2                   ;zero bit
pagesel   equ       5                   ;select upper/lower page ram

;***      intcon register

rintcon   equ       0A0h                ;current settings

rbif      equ       0                   ; 0 cleared
intf      equ       1                   ; 0 cleared
rtif      equ       2                   ; 0 cleared
rbie      equ       3                   ;*0 disabled; 1 enabled
inte      equ       4                   ;*0 disabled; 1 enabled
rtie      equ       5                   ; 0 disabled;*1 enabled
adie      equ       6                   ;*0 disabled; 1 enabled
gie       equ       7                   ; 0 disabled;*1 enabled

;***      adcon0 register

radcon    equ       01h                 ;Current Setting

adon      equ       0                   ;1 A/D on
adif      equ       1                   ;X don't care
go        equ       2                   ;X don't care
chs0      equ       3                   ;X don't care
chs1      equ       4                   ;X don't care
adcs0     equ       6                   ;0\ A/D conversion clock
adcs1     equ       7                   ;0/ as fosc/2

;***      adcon1 register     Current Setting:  02h

radcon1   equ       00h

pcfg1     equ       0                   ;0 configure RA2,RA3 analog
pcfg0     equ       0                   ;0 configure RA0,RA1 analog

;***      option register

roption   equ       0C7h                ;initial option settings

ps0       equ       0                   ;0\
ps1       equ       1                   ;0 >Set Prescale 1:4
ps2       equ       2                   ;1/   for RTCC
```

```
psa        equ      3                ;0 Assign prescaler to RTCC
rte        equ      4                ;X don't care
rts        equ      5                ;X don't care
intedg     equ      6                ;1 Interrupt on rising edge
rbpu       equ      7                ;1 disable pullups

;***       vector destinations

w          equ      0                ;result in w register
f          equ      1                ;result in file resister

; ***  porta pin assignments

rddra      equ      0fh              ;ddr setting porta

temp       equ      0                ;1 analog
volt_read  equ      1                ;1 analog
therm      equ      2                ;1 analog
irr        equ      3                ;1 analog
gas_valve  equ      4                ;0 digital output

; ***  portb pin assignments

rddrb      equ      74h              ;ddr setting portb

motor      equ      0                ;0 output
valve      equ      1                ;0 output
therm_shut          equ      2       ;1 input
igniter    equ      3                ;0 output
hi_vent    equ      4                ;1 input
low_vent   equ      5                ;1 input
h_request  equ      6                ;1 input
led        equ      7                ;0 output


; ad converter channel assigment

pa0        equ      01h      ;channel an0
pa1        equ      09h      ;channel an1
pa2        equ      11h      ;channel an2
pa3        equ      19h      ;channel an3
```

```
e:\furn\proof_4.pic                                                    Page    1
Printed 16:03 06 Jan 95

;#############################################################
;#        PROOF.PIC new igniter                              #
;#                                                           #
;#                                                           #
;#############################################################

PROOF
          clrwdt                                  ;clear watch dog
          btfss     portb,h_request               ;looking for heat request
          goto      PROOF_START                   ;if heat goto
          bcf       stat1,proof_bit               ;if no heat clear bit
          return

PROOF_START
          bcf       stat1,therm?                  ;
          btfsc     stat1,proof_bit               ;looking for bit is allready set
          return                                  ;return to main program
          btfsc     ignitstat,adj_duty?           ;
          goto      PROOF_COORS_LITE              ;
          btfsc     furn,heat_up_igniter          ;
          goto      PROOF_MOTOR_ON                ;

WARM_IGN_PROOF
          bcf       stat,heat                     ;turn off motor
          movlw     igniter_proof                 ;move constant in for timmer
          subwf     tempw,w                       ;temp register
          btfsc     status,c                      ;looking for a carry
          goto      PROOF_BAD_IGNITER             ;if carry goto
          bsf       furn1,ir?                     ;turn on igniter
          btfss     ignitstat,ign_hot             ;
          return
          bsf       furn,heat_up_igniter          ;
          clrf      timem                         ;clear timmers
          clrf      times                         ;
          return

PROOF_MOTOR_ON
          movlw     warm_time                     ;time to stabilize igniter
          subwf     tempw,w                       ;
          btfss     status,c                      ;
          return
          call      ATODV                         ;read volts on igniter
          movf      i_volts,w                     ;
          addlw     volt_add                      ;adding constant for better fan proof
          movwf     save_volt                     ;save this varible
          bcf       furn1,ir?                     ;turn off ir program
          bsf       furn1,mo?                     ;turn on voltage monitoring of igniter
          bsf       ignitstat,adj_duty?           ;
          bcf       furn,heat_up_igniter
          clrf      timem                         ;clear timmers
          clrf      times                         ;
          return

PROOF_COORS_LITE
          bsf       stat,heat                     ;start motor for fan proof
          call      ATODV                         ;read voltage on igniter
          call      ATODF                         ;read ir level on igniter
          movf      ir,w                          ;save ir level
          comf      ir,w                          ;complment ir level
          movwf     set_ir                        ;save
          movlw     lower_ir                      ;move in constant
          subwf     set_ir,w                      ;sud saved level of ir from constant
          btfss     status,c                      ;look for carry
          goto      PROOF_CK                      ;
          movlw     igniter_proof                 ;move constant in for proofing fan
```

```
        subwf   tempw,w                 ;
        btfss   status,c                ;
        return
        goto    PROOF_NO_FAN            ;

PROOF_BAD_IGNITER
        bsf     malf,bad_ignitor        ;set bit for bad igniter
        bcf     stat,heat               ;turn off motor prog
        bcf     portb,igniter           ;clear igniter
        bcf     furn1,mo?               ;turn off voltage prog for igniter
        bcf     furn1,ir?               ;turn off ir program for igniter
        goto    PROOF_CK                ;

PROOF_NO_FAN
        bsf     malf,no_air             ;set bit for no air
        bcf     stat,heat               ;clear motor speed
        bcf     portb,igniter           ;clear igniter
        bcf     furn1,mo?               ;turn off voltage igniter program -
        bcf     furn1,ir?               ;turn off ir igniter program
        nop

PROOF_CK
        clrf    ignitstat               ;clear all bits for relight
        bsf     stat1,proof_bit         ;set bit for proof bit
        clrf    furn1                   ;clear status bits
        clrf    furn                    ;clear status bits
        bcf     portb,igniter           ;clear igniter
        bcf     furn1,mo?               ;turn off votage program for igniter
        bcf     furn1,ir?               ;turn off ir program for igniter
        clrf    timem                   ;clear timmers
        clrf    times                   ;
        nop
        nop
        return
```

```
;##########################################################
;#                                                        #
;#malfunction blinking sequence for led                   #
;#                                                        #
;#                                                        #
;##########################################################

MALF
        clrwdt                          ;clear watch dog
        btfss   malf,lockout            ;looking for malf flag is set
        return                          ;return to main program
        btfsc   portb,h_request         ;looking for a heat request
        return                          ;return to main program
        movf    times,w                 ;make 1 sec clock
        andlw   maskhi                  ;mask off high word
        movwf   tempw                   ;place in tempw
        movf    timem,w                 ;create seconds timer
        andlw   masklow                 ;from time bytes and
        addwf   tempw,f                 ;
        swapf   tempw,f                 ;
        movf    tempw,w                 ;
        btfsc   stat1,sec5              ;looking for 5 sec timer flag
        goto    MALF_TIMMER             ;if set jump
        call    ATODM                   ;call sub for motor voltage
        call    HEATVENT                ;call sub for modulate motor
        bsf     stat,heat               ;set flag to run heatvent
        movlw   three_try               ;move constant into w register
        subwf   tempw,w                 ;sub temp register
        btfss   status,c                ;look for carry
        goto    MALF                    ;
        clrf    timem                   ;clear all timers
        clrf    times                   ;
        bsf     stat1,sec5              ;set flag not to do again
MALF_TIMMER

        btfss   stat2,fail_thermal      ;looking for high limit open
        goto    MALF_TIMMER2            ;if not set jump over
        bsf     stat,flameout           ;set flame out bit

MALF_TIMMER2


        bcf     stat,heat               ;turn off prog for motor
        bcf     portb,motor             ;turn off motor pin
        clrf    furn                    ;clear status bits
        clrf    furn1                   ;        "
        clrf    ignitstat               ;        "
        clrf    stat                    ;        "
        clrf    tempw                   ;clear temp register
        clrf    ramporta                ;clear port A
        call    PORTA                   ;        "
        btfss   timem,blink             ;look for timer flag
        goto    MALF_OFF                ;if clear jump to
        btfss   timem,malf_blink        ;
        goto    LED_OFF                 ;
        btfsc   malf,led_test           ;
        goto    MALF                    ;
        btfsc   malf,test               ;
        goto    MALF                    ;
        decfsz  malf_bit,f              ;
        goto    LED_ON                  ;
        bsf     malf,test               ;
LED_ON
        bsf     portb,led               ;turn on led
        bsf     malf,led_test           ;set bit for blink code
```

```
        goto    MALF                ;
LED_OFF
        bcf     portb,led           ;turn off led
        bcf     malf,led_test       ;clear bit for blink code
        goto    MALF                ;
MALF_OFF
        bcf     portb,led           ;clear led
        bsf     malf,test           ;set bit for no air
        btfss   malf,no_air         ;no air
        goto    ONE                 ;settiing count for error code
        movlw   .1                  ;
        goto    MALF_END            ;
ONE
        btfss   malf,bad_ignitor    ;settiing count for error code
        goto    TWO                 ;bad igniter
        movlw   .2                  ;
        goto    MALF_END            ;
TWO
        btfss   malf,fail_thermal   ;settiing count for error code
        goto    THREE               ;thermal switch
        movlw   .3                  ;
        goto    MALF_END            ;
THREE
        btfss   malf,flame_fail     ;settiing count for error code
        goto    FOUR                ;flame failer
        movlw   .4                  ;
        goto    MALF_END            ;
FOUR
        movlw   .5                  ;settiing count for error code
MALF_END
        movwf   malf_bit            ;
        bcf     malf,test           ;
        return
```

```
e:\furn\ir_mot.pic                                                    Page    1
Printed 16:07 06 Jan 95

;#############################################################
;# IR_MOT.PIC new igniter                                    #
;#                                                           #
;#                                                           #
;#                                                           #
;#############################################################
MO
        clrwdt                          ;clear watch dog
        btfss     furn1,mo?             ;looking for flag is set to start program
        goto      MO_CLEAR              ;if not set jump to end
        movf      i_volts,w             ;move varible into w register
        subwf     save_volt,w           ;sub saved value from known value
        btfsc     status,c              ;look for carry
        goto      MO_DUTY_ON            ;if carry jump
MO_DUTY_OFF
        bcf       portb,igniter         ;clear igniter port pin
        bcf       portb,led             ;clear led port pin
        goto      MO_END
MO_DUTY_ON
        bsf       portb,igniter         ;set igniter port pin
        bsf       portb,led             ;set led port pin
MO_END
        return                          ;return to main program
MO_CLEAR
        return                          ;return to main program
```

e:\furn\ir.pic
Printed 16:07 06 Jan 95

```
;#############################################################
;# IR.PIC new igniter                                        #
;#        modulate igniter around ir level                   #
;#                                                           #
;#                                                           #
;#############################################################
IR
          clrwdt                          ;clear watch dog
          btfss     furn1,ir?             ;look to see if ir mod should be on
          goto      IR_CLEAR              ;if no goto end of program
          movf      ir_setting,w          ;set ir constant
          subwf     ir,w                  ;sud ir level from constant
          btfsc     status,c              ;looking for carry
          goto      IR_DUTY_ON            ;if carry jump
IR_DUTY_OFF
          bcf       portb,igniter         ;turn off igniter
          bsf       ignitstat,ign_hot     ;set bit for igniter test
          bcf       portb,led             ;turn off led
          goto      IR_END
IR_DUTY_ON
          bsf       portb,igniter         ;turn on igniter
          bsf       portb,led             ;turn on led
IR_END
          return                          ;return to main program
IR_CLEAR
;         bcf       portb,igniter
          return                          ;return to main program
```

```
e:\furn\intrupt.pic                                                    Page    1
Printed 16:08 06 Jan 95

;##############################################################
;##  INTRPT.PIC new igniter                                  ##
;##        Interrupt service routine.  Concept: Service      ##
;##        interrupt and set a flag then get back            ##
;##        the program.  Service flag next exec loop.        ##
;##############################################################
;
INTRPT
          clrwdt                        ;clear watch dog
          movwf     intw                ;save w reg
          swapf     status,w            ;save status reg
          movwf     intstat             ;
          bcf       status,pagesel      ;ensure page 0
          clrwdt                        ;clear watch dog
          call      HEATVENT            ;modulate motor
          btfss     furn1,motor?        ;chk if motor should be on or off
          goto      INCTIME             ;
M_CON
          call      VALVE               ;modulate gas valve if needed
          btfss     portb,motor         ;if motor is already on skip
          goto      DUTY_ON             ;
DUTY_OFF
          movf      duty,w              ;move the duty cycle to the
          movwf     rtcc                ;rea;l time clock counter
          bcf       portb,motor         ;turn off motor
          btfss     stat,hot_furn       ;look to see if the furnice is hot
          bcf       portb,led           ;if not clear led
          goto      MOO                 ;
DUTY_ON
          comf      duty,w              ;complment the duty cycle for the on time
          movwf     rtcc                ;of the motor to get duty cycle that is required
          bsf       portb,motor         ;turn on the motor
;         bsf       portb,led
INCTIME
          incfsz    timem,f             ;increment timers
          goto      MOO                 ;
          incfsz    times,f             ;
          goto      MOO                 ;
          bsf       furn1,hour          ;
MOO
          bcf       intcon,rtif         ;reset interrupt flag
          swapf     intstat,w           ;restore status
          movwf     status              ; and w register
          swapf     intw,f              ;swap up/lo nibble
          swapf     intw,w              ;ditto, restore w reg
          retfie                        ;intrpt return
```

```
e:\furn\init.pic                                                    Page    1
Printed 16:09 06 Jan 95

;##############################################################
;##  INIT.PIC new igniter                                     ##
;##       Initialize system parameters for proper operation ##
;##############################################################

RESET
          clrwdt                        ;clear watchdog
          goto      INIT                ;
          ORG       0004
;
INCLUDE   'INTRUPT.PIC'
;
INIT
          movlw     rddrb               ;configure port b input
          movwf     ddrb                ; and output direction
          call      DDRB                ; update register in page1 ram
          movlw     rddra               ;bit digital out(0)
          movwf     ddra                ; configure porta i/o direction
          call      DDRA                ; update register in page1 ram
          bsf       status,pagesel      ;set page1 mem
          movlw     radcon1
          movwf     adcon               ;set a0-a3 analog inputs
          bcf       status,pagesel      ;set page0 mem
          movlw     roption             ;rtcc scaled 1:4
          option                        ;set option regiser in page1 ram
          movlw     rintcon             ;configure interrupt control
          movwf     intcon              ;store register options
          clrf      timem
          clrf      times
          clrf      malf
          clrf      rods
          clrf      furn
          clrf      furn1
          clrf      portb
          clrf      ignitstat
          clrf      save_volt
          clrf      i_volts
          clrf      m_volts
          clrf      stat
          clrf      stat1
          clrf      tempw
          clrf      stat2
          clrwdt                        ;clear watch dog
          clrf      ramporta
          call      PORTA
          movlw     volt_6
          movwf     volt_low
          movlw     volt_10
          movwf     volt_high
          movlw     lower_ir
          movwf     set_ir
```

```
e:\furn\ignition.pic                                                    Page    1
Printed 16:09 06 Jan 95

;#############################################################
;#        IGNITION.PIC new igniter                           #
;#        START IGNITION SEQUENCE                            #
;#                                                           #
;#############################################################

IGNITION
          clrwdt                                  ;clear watch dog
          movf      times,w                       ;move timer
          andlw     maskhi                        ;mask high side of bit
          movwf     tempw                         ;place in tempw
          movf      timem,w                       ;create seconds timer
          andlw     masklow                       ;from time bytes
          addwf     tempw,f                       ;mask low side of bit
          swapf     tempw,f                       ;swap both words
          movf      tempw,w                       ;save in register

LOCKOUT_CHECK
          clrwdt                                  ;clear watch dog
          btfss     portb,h_request               ;looking for heat request
          goto      LOCKOUT                       ;if heat request goto lockout
          clrwdt                                  ;clear watch dog
          bcf       stat1,one_hot_mother          ;clear status flag
          bcf       stat1,min_timer               ;clear all bits
          bcf       stat1,proof_bit               ;clear bit for fan chk
          bcf       stat1,open                    ;clear high limit flag
          bcf       stat,fail                     ;clear all fail trys
          bcf       stat,fail_1                   ;clear fail flag
          bcf       stat,fail_2                   ;clear fail flag
          bcf       furn1,ir?                     ;turns off igniter IR program
          bcf       furn,gas?                     ;turns off the gas program
          bcf       stat1,sec5                    ;clear timer flag
          bcf       furn,gas?                     ;turn off gas flag
          bcf       furn1,mo?                     ;turn off modulate voltage flag
          bcf       furn,adjvolts                 ;clear status flag
          bcf       portb,led                     ;turn off led
          bcf       portb,igniter                 ;turn off igniter
          clrf      ignitstat                     ;clear hole register
          bcf       malf,fail_thermal             ;clear high limit error flag
          btfsc     stat,flameout                 ;if flame out set up for post purge
          goto      PRE                           ;
          btfsc     stat,hot_furn                 ;look for a hot furnace bit is set
          goto      HOT_FLAME_
          clrf      malf                          ;clear all malfuntion bits
          btfsc     stat2,fail_thermal
          goto      HOT_FLAME_
          bcf       stat,heat                     ;turn off modulating motor
          clrf      timem                         ;clear timer
          clrf      times                         ;clear timer
          return                                  ;return to main

HOT_FLAME_
          clrf      timem                         ;clear timer
          clrf      times                         ;clear timer
          bsf       stat,flameout                 ;set bit for hot furnace
          return                                  ;return to main

LOCKOUT
          btfss     malf,lockout                  ;was there a lockout
          goto      PRE

CLEAR_LOCKOUT

          bcf       portb,valve                   ;clear gas valve port pin
          bcf       furn,gas?                     ;clear gas valve flag
```

```
        bcf     portb,igniter           ;clear igniter port pin
        btfss   stat2,fail_thermal      ;look for high limit flag is set
        bcf     stat,heat               ;clear motor flag bit
        btfsc   stat2,fail_thermal      ;look for high limit flag is set
        bsf     stat,flameout           ;set flame out bit
        btfss   stat,flameout           ;looking for flame out bit if set
        return                          ;return to main

PRE
        clrwdt                          ;clear watch dog
        btfsc   stat,flameout           ;looking to see if flame out bit is set
        goto    HOT_STUFF               ;
        movlw   ir_set                  ;move constant into w register
        movwf   ir_setting              ;save w reg as a varible
        call    PROOF                   ;fan proof
        btfsc   malf,bad_ignitor        ;is bad igniter error bit set
        goto    FAIL_2
        btfsc   malf,no_air             ;is bad fan bit set
        goto    FAIL_2
        bcf     stat,high_duty          ;clear bit for low voltage
        btfss   stat1,proof_bit         ;is proof bit set
        return                          ;return to main

HOT_STUFF
        movlw   light_flame             ;move constant into w register
        movwf   ir_setting              ;save into varible location
        call    THERMCK                 ;sub program to ck if high limit is open
        btfss   stat,flameout           ;make sure post purge is done
        goto    PURGE

HOT_STUFF1
        bcf     portb,igniter           ;clear igniter port pin
        movlw   volt_10                 ;load set value into volt_high
        movwf   volt_high               ;save constant in varible location
        bsf     stat,heat               ;start motor at 10 volts
        btfsc   malf,fail_thermal       ;is high limit bit set
        goto    MALF_THERMAL

HOT_STUFFING
        movlw   hot                     ;start timer for purge
        subwf   tempw,w                 ;temp register for timer
        btfss   status,c                ;looking for over flow bit
        return                          ;return to main

HOT_STUFF2
        clrwdt                          ;clear watch dog
        bcf     stat,hot_furn           ;clear all flag for new ignition sequenc
        bcf     stat,heat               ;        /
        bcf     stat,flameout           ;        /
        bcf     stat,high_duty          ;        /
        bcf     portb,motor             ;        /
        bcf     stat2,fail_thermal      ;        /
        clrf    ignitstat               ;        /
        bcf     stat1,sec5              ;        /
        bcf     stat1,proof_bit         ;        /
        clrf    timem                   ;        /
        clrf    times                   ;        /
        return                          ;return to main

MALF_THERMAL
        clrwdt                          ;clear watch dog
        movlw   volt_10                 ;move constant into w register
        movwf   volt_high               ;save constant in varible
        movlw   duty_max                ;start timer for purge
        subwf   tempw,w                 ;sub timer from constant
```

```
        btfss   status,c                ;looking for over flow bit
        return                          ;return to main
        bcf     stat2,fail_thermal      ;clear all flagsfor a new ignition
        bcf     stat,flameout
        bsf     malf,lockout
        goto    HOT_STUFF2

PURGE
        clrwdt                          ;clear watch dog
        btfsc   furn1,running           ;look for bit set
        goto    RUNNING                 ;jump to
        btfsc   ignitstat,flame_ck?     ;look for bit set
        goto    GOOD_FLAME              ;jump to
        btfsc   ignitstat,flame?        ;look for bit set
        goto    FLAME_PROOF             ;jump to
        btfsc   furn1,warm_up           ;look for bit set
        goto    WARMUP                  ;jump to
        btfsc   ignitstat,adj_duty?     ;look for bit set
        goto    COORS_LITE              ;jump to
        btfsc   ignitstat,motor_?       ;look for bit set
        goto    MOTOR_ON                ;jump to
TIMMER
        clrf    timem                   ;clear timmers
        clrf    times                   ;
        bsf     ignitstat,motor_?       ;set bit to continue
        bsf     stat,heat               ;turn on motor
        return
MOTOR_ON
        movlw   purgetime               ;timmer for purge
        subwf   tempw,w                 ;
        btfss   status,c                ;
        return
PREPURGE
        clrwdt                          ;clear watch dog
        movf    duty,w                  ;setting up motor speed
        movwf   save_duty               ;
        btfsc   stat,high_duty          ;bit set if on duty is over 255
        goto    FAIL_VOLTAGE            ;looking for low voltage
        bsf     ignitstat,adj_duty?     ;set bit to continue on
        bcf     ignitstat,motor_?       ;
        bcf     stat,heat               ;clear fan
        bcf     ignitstat,ign_hot       ;
        clrf    timem                   ;
        clrf    times                   ;
        bsf     furn1,ir?               ;
        return
COORS_LITE
        clrwdt                          ;clear watch dog
        call    ATODF
        movlw   igniter_ck              ;timmer to chk if igniter is bad
        subwf   tempw,w
        btfsc   status,c
        goto    FAIL_VOLTAGE
        btfss   ignitstat,ign_hot       ;did igniter reach temp
        return
        bsf     furn1,warm_up           ;timer to stabilize igniter
        clrf    timem
        clrf    times

        return

WARMUP
        clrwdt                          ;clear watch dog
        movlw   warm_time               ;time to stabilize igniter with motor on
        subwf   tempw,w
```

```
        btfss   status,c
        return
        movlw   mid_light               ;for fan speed
        movwf   volt_high               ;
        bsf     stat,heat               ;start fan bit
        call    ATODF                   ;call for reading on IR
        call    ATODV                   ;call to read volts
        movf    i_volts,w               ;move file to w reg
        movwf   save_volt               ;save volts for igniter
        bsf     furn,gas?               ;turn gas on
        bsf     ignitstat,flame?        ;set bit  bsfnext step of ignition seque
        clrf    timem                   ;clear all timers
        clrf    times                   ;
        return

FLAME_PROOF
        clrwdt                          ;clear watch dog
        call    ATODV                   ;call sub program for igniter same volts
        call    ATODF                   ;call sub for flame read ir
        btfsc   stat1,go_forward
        goto    SUPPER_CHARGE
        movlw   supper_charger          ;
        subwf   tempw,w                 ;timmer
        btfss   status,c                ;
        return
        bsf     stat1,go_forward
        bcf     stat1,finish_flame_proof

SUPPER_CHARGE
        clrwdt                          ;clear watch dog
        bcf     furn1,ir?
        bcf     portb,igniter           ;turn off igniter
        movlw   mid_light               ;set mid voltage on motor
        movwf   volt_high               ;(faster fan speed)
        call    IR
        movf    ir,w                    ;move ir value into w register
        comf    ir,w                    ;complment ir level
        movwf   set_ir                  ;save comp ir level
        movlw   prooftime               ;flame proof
        subwf   tempw,w                 ;timer
        btfss   status,c                ;looking for carry
        return                          ;return to main
        movlw   flame_add               ;move constant into w register
        subwf   set_ir,w                ;set value for flame detect
        btfsc   status,c                ;looking for carry
        bsf     stat1,finish_flame_proof ;set bit to go on to next step
        btfss   stat1,finish_flame_proof ;if bit was not set goto fail
        goto    FLAME_FAIL1             ;if no flame fail

CK_
        clrwdt                          ;clear watch dog
        bsf     ignitstat,flame_ck?     ;set bit to continue
        bcf     stat1,go_forward        ;clear flags for next ignition
        bcf     stat1,finish_flame_proof ;clear flags for next ignition
        clrf    timem                   ;clear timers
        clrf    times                   ;clear timers
        goto    GOOD_FLAME              ;passed go on

GOOD_FLAME
        clrwdt                          ;clear watch dog
        bcf     furn1,ir?               ;turn off modulating igniter
        bcf     furn1,mo?               ;turn off voltage program
        bcf     portb,igniter           ;turn off igniter
        call    IR                      ;modulate ir level
        movlw   mid_light               ;set mid voltage on motor
```

```
        movwf   volt_high               ;(faster fan speed)
        movlw   good_time               ;time for flame to stabilize
        subwf   tempw,w                 ;sub from temp register
        btfss   status,c                ;looking for carry
        return                          ;return to main
        clrf    timem                   ;clear timers
        clrf    times                   ;clear timers

RUNNING
        clrwdt                          ;clear watch dog
        comf    ir,w                    ;complement ir level
        movwf   set_ir                  ;save ir level
        bsf     furn1,running           ;set bit for step

LOOKING_GOOD
        clrwdt                          ;clear watch dog
        movlw   shut_off_volt           ;looking for low voltage
        subwf   m_volts,w               ;sub motor voltage from constant -
        btfss   status,c                ;look for carry
        goto    FAIL_VOLTAGE            ;if no carry goto fail voltage
        btfsc   portb,therm_shut        ;look for high limit
        goto    FLAME_FAIL1             ;error goto flame fail1
        bcf     furn1,ir?               ;turn off ir monitor
        call    HEATVENT                ;looking at motor speed
        btfsc   stat1,one_hot_mother    ;looking if bit is set
        goto    HOT_DOG                 ;
        movf    set_ir,w                ;looking for bad flame
        sublw   flamechk                ;sub a constant from file
        btfsc   status,c                ;look for carry
        goto    FLAME_FAIL1             ;
        btfsc   stat1,min_timer         ;looking for bit to skip forward
        goto    TWENTY_SEC              ;
        movlw   running_time            ;time for the igniter to heat up
        subwf   tempw,w                 ;temp timer register
        btfss   status,c                ;look for carry
        return                          ;return to main
        movlw   volt_10                 ;set voltge highest running speed needed
        movwf   volt_high               ;for good combustion
        bsf     stat,hot_furn           ;set flag for hot furnace
        bsf     stat1,min_timer         ;passed test set bit
        bcf     portb,igniter           ;clear igniter
        bcf     furn1,mo?               ;turn off voltage modulation program for
        bcf     furn1,ir?               ;turn off ir modulation program for igni
        clrf    timem                   ;clear timer
        clrf    times                   ;clear timer
        return

TWENTY_SEC
        clrwdt                          ;clear watch dog
        movlw   running_min             ;timmer set
        subwf   tempw,w                 ;after timmmer, post purge is set.
        btfss   status,c                ;looking for carry
        return                          ;return to main
        bsf     stat,hot_furn           ;clear all fails
        bsf     stat1,one_hot_mother    ;bit set has to go through post purge
        bsf     portb,led               ;proof of good running furnace
        bcf     stat,fail               ;clear fail flag 1
        bcf     stat,fail_1             ;clear fail flag 2
        bcf     stat,fail_2             ;clear fail flag 3
        bcf     stat1,open              ;clear flag for high limit
        movlw   rod_num                 ;after warm up read IR level
        subwf   set_ir,w                ;save level and sub a set number
        btfss   status,c                ;looking for carry
        goto    RODS_LOOK               ;if no carry jump
        movwf   rods                    ;if IR goes below set level fail
```

```
        movlw   flame_stable        ;after warm up read IR level
        subwf   rods,w              ;save level and sub a set number
        btfss   status,c
        goto    RODS_LOOK
        return

RODS_LOOK
        movlw   rods_min            ;if rods are not above set value
        movwf   rods                ;move constant into rods register
        return                      ;return to main

HOT_DOG
        clrwdt                      ;clear watch dog
        movlw   flame_stable        ;move file into w reg
        subwf   set_ir,w            ;lower limit after warm up,fail mode
        btfss   status,c            ;look for carry
        goto    FLAME_FAIL1         ;
        btfsc   portb,therm_shut    ;look for high limit failer
        bsf     stat1,open          ;looking for high limit if open
        btfsc   portb,therm_shut    ;looking for high limit if open
        goto    FLAME_FAIL1         ;jump to fail
        bsf     portb,led           ;turn on led
        movf    set_ir,w            ;read new IR level
        subwf   rods,w              ;saved level after warm up period
        btfsc   status,c            ;look for carry
        goto    FLAME_FAIL2         ;jump to
        movlw   shut_off_volt       ;move constant into w register
        subwf   m_volts,w           ;sub motor voltage from constant
        btfss   status,c            ;look for carry
        goto    FAIL_VOLTAGE        ;jump to
        return                      ;return to main

FLAME_FAIL1
        nop
FLAME_FAIL2
        btfsc   stat,hot_furn       ;look for hot furnace
        bsf     stat,flameout       ;set bit for hot furnace for post purge
        bsf     stat1,therm?        ;if flame is failed set bit
        bsf     malf,flame_fail     ;bit set for error code
        bcf     furn1,ir?           ;turn off igniter ir program
        bcf     portb,igniter       ;make sure igniter is off
        clrf    timem               ;clear timer
        clrf    times               ;clear timer
        goto    FAIL                ;jump to

FAIL
        clrwdt                      ;clear watch dog
        btfsc   portb,therm_shut    ;looking for high limit
        bsf     stat1,open          ;looking for high limit if open
FAIL_2
        bcf     stat1,proof_bit     ;clear status flags
        bcf     stat1,min_timer     ;
        bcf     stat1,one_hot_mother ;
        bcf     stat1,proof_bit     ;clear bit for proofing the fan
        btfss   stat1,open          ;lookto see if high limit is open
        bcf     stat,heat           ;turn off motor
        bcf     furn,gas?           ;turn off gas
        bcf     furn1,ir?           ;turn off ir mod program
        bcf     portb,igniter       ;turn off igniter
        clrf    ignitstat           ;clear register
        btfsc   stat,fail           ;three trys then malf
        bsf     stat,fail_1         ;
        bsf     stat,fail           ;
        btfss   stat,fail_1         ;
```

```
        goto    CLR_TIME                ;
        btfsc   stat,fail_2             ;
        bsf     malf,lockout            ;set malf bit if three trys has failed
        bsf     stat,fail_2             ;

CLR_TIME
        btfsc   malf,lockout            ;looking for malf
        goto    CLR_TIME1
        bcf     malf,bad_ignitor        ;clear igniter for error code
        bcf     malf,no_air             ;clear no air for error code

CLR_TIME1
        clrf    timem                   ;clear all timers
        clrf    times                   ;

CLR_OP_FLAGS
        btfss   stat1,open              ;looking for ECO
        goto    CLR_OP                  ;
        goto    FAIL_THERMAL            ;

CLR_OP
        call    PORTA                   ;
        clrf    ignitstat               ;clear all files for retry or malf
        clrf    furn1                   ;
        clrf    furn                    ;
        clrf    timem                   ;
        clrf    times                   ;
        bcf     stat1,sec5              ;clear bit for 5 sec timmer
        bcf     portb,valve             ;
        bcf     portb,led               ;
        return                          ;

FAIL_VOLTAGE
        bcf     stat,heat               ;turn off motor
        bcf     malf,flame_fail         ;bit clear for error code
        bsf     malf,fail_voltage       ;if voltage is to low
        btfsc   stat1,one_hot_mother
        goto    FLAME_FAIL1
        btfsc   furn1,warm_up
        goto    FAIL                    ;set fail_voltage bit
        bcf     stat2,fail_thermal
        goto    FAIL

FAIL_THERMAL_1
NOP
FAIL_THERMAL
        bsf     malf,fail_thermal       ;set bit for malf led read
        bcf     stat1,open
        btfsc   stat,hot_furn           ;look for hot furnace
        bsf     stat2,fail_thermal
        nop
        goto    CLR_OP

BAD_IGNITER
        bsf     malf,lockout            ;set bit for lockout
        bcf     furn1,ir?               ;clear igniter
        bcf     portb,igniter           ;clear ir flag
        bsf     stat,flameout           ;set bit for flame out
        bsf     malf,bad_ignitor        ;if ignitor is bad set bit
        bcf     stat2,fail_thermal
        nop
        return
```

```
e:\furn\heatvent.pic                                                    Page    1
Printed 16:16 06 Jan 95

;##########################################################
;#                                                        #
;#  LOW AND HIGH MOTOR CONTROL new igniter                #
;#                                                        #
;#                                                        #
;##########################################################

HEATVENT
        clrwdt                                  ;clear watch dog
        bsf     furn,adjvolts                   ;temp bit
        btfsc   stat,heat                       ;looking for heat bit from ignition
        goto    HI_VENT                         ;
        btfss   portb,h_request                 ;skip low and high vent if heat request
        goto    MAYBE_HEAT                      ;
        btfss   portb,hi_vent                   ;look for high vent
        goto    HI_VENT                         ;
        btfss   portb,low_vent                  ;look for low vent
        goto    LOW_VENT                        ;
MAYBE_HEAT
        bcf     furn1,motor?                    ;clear all motor bits
        bcf     portb,motor                     ;        "
        bcf     furn,lmotor_on                  ;        "
        bcf     furn,hmotor_on                  ;        "
        bcf     portb,led                       ;turn off led
        return                                  ;return to main program
LOW_VENT
        bsf     furn1,motor?                    ;set bit for low vent
        btfsc   furn,lmotor_on                  ;look for low vent motor on or off
        goto    LOW_ADJ                         ;
        movlw   volt_low                        ;move constant to w register
        movwf   duty                            ;move w to file duty
        bsf     furn,lmotor_on                  ;set bit that motor is on
        return                                  ;return to main program
LOW_ADJ
        btfss   furn,adjvolts                   ;set temp bit
        return
        bcf     furn,adjvolts                   ;clear temp bit
        movfw   volt_low                        ;move varible into w reg
        subwf   m_volts,w                       ;sub motor volts from varible
        btfss   status,c                        ;look for carry
        goto    INCDUTY                         ;
        goto    DECDUTY                         ;
HI_VENT
        bsf     furn1,motor?                    ;set bit for hi
        btfsc   furn,hmotor_on                  ;
        goto    HI_ADJ                          ;
        movfw   volt_high                       ;move varible into w reg
        movwf   duty                            ;move w to duty
        bsf     furn,hmotor_on                  ;
        return                                  ;return to main program
HI_ADJ
        btfss   furn,adjvolts                   ;
        return
        bcf     furn,adjvolts                   ;
        movfw   volt_high                       ;move voltage of motor into w register
        subwf   m_volts,w                       ;subtract set voltage
        btfss   status,c                        ;look for carry
        goto    INCDUTY                         ;if not carry goto incduty
DECDUTY
        decf    duty                            ;decrement duty motor voltage to high
        btfsc   status,z                        ;look to see if zero
        incf    duty                            ;if zero increment
        return                                  ;return to main program
INCDUTY
        incf    duty                            ;voltage on motor is to low incrment dut
```

```
        btfss     status,z              ;look for carry flag
        return                          ;return to main program
        btfss     stat,ignite           ;
        bsf       stat,high_duty        ;
        movlw     duty_max              ;if overflow set duty to 254
        movwf     duty                  ;save into duty register
        return                          ;return to main program
```

```
e:\furn\atodv.pic                                                    Page    1
Printed 16:17 06 Jan 95

;##############################################################
;## ATODT.PIC new igniter IGNITER VOLTS                      ##
;##        Subroutine for A/D service                        ##
;##        16C71                                             ##
;##############################################################
ATODV
          movlw     pa2                 ;select constant
          movwf     adcon               ;select channel
          call      DELAY               ;
          bsf       adcon,go            ;set bit to start atod conversion

LOOPCH2
          clrwdt                        ;clear watch dog
          call      VALVE               ;call valve program to turn on or turn off
          btfss     adcon,adif          ;conversion complete?
          goto      LOOPCH2             ;
          movf      adres,w             ;move the results into the w register
          movwf     i_volts             ;save the results of what volts are on the igniter
          return
```

```
e:\furn\atodm.pic                                                    Page    1
Printed 16:18 06 Jan 95

;##########################################################
;## ATODM.PIC new igniter                                ##
;##       Subroutine for A/D service                    ##
;##       16C71                                         ##
;##########################################################
ATODM
          movlw     pal                 ;select constant for port pin
          movwf     adcon               ;select channel
          call      DELAY               ;
          bsf       adcon,go            ;set bit to start atod

LOOPCH1
          clrwdt                        ;clear watch dog
          call      VALVE               ;call valve program to turn on or off
          btfss     adcon,adif          ;conversion complete?
          goto      LOOPCH1             ;jump to loopch1
          movf      adres,w             ;move results into w register
          movwf     m_volts             ;save results of reading on motor
          return
```

```
e:\furn\atodf.pic                                                    Page    1
Printed 16:19 06 Jan 95

;##########################################################
;## ATODF.PIC new igniter IR                              ##
;##       Subroutine for A/D service with analog MUX for  ##
;##       the 16C71                                       ##
;##########################################################
;
ATODF
          clrwdt                        ;clear watch dog
          movlw     pa3                 ;select constant
          movwf     adcon               ;select channel
          call      DELAY               ;delay for reading atod
          bsf       adcon,go            ;set bit for atod to start

LOOPCH3
          call      VALVE               ;call valve routine turn valve on or off
          btfss     adcon,adif          ;conversion complete?
          goto      LOOPCH3             ;loop until atod is complete
          movf      adres,w             ;move results into w register
          movwf     ir                  ;save results
          return
```

APPENDIX B

FURNACE
HOT SURFACE IGNITION WITH SPEED CONTROL

Step by Step Indicators

FIGURE 6: INIT

| Step | Description |
|---|---|
| 1. | Indicate beginning of initialize program |
| 2. | Configure pin assignments and registers |
| 3. | Assign ram locations |
| 4. | Prepare analog to digital converters for operation |
| 5. | Initialize constants with names |
| 6. | Clear ram locations (unwanted numbers) |
| 7. | Load ram locations for starting sequence |
| 8. | GOTO Step 9 |

FIGURE 7: MAIN

| Step | Description |
|---|---|
| 9. | Beginning of main program |
| 10. | Make sure port assignments are still loaded |
| 11. | Call sub program ATODM |
| 12. | Call sub program HEATVENT |
| 13. | Cal sub program ATODF |
| 14. | Call sub program IR |
| 15. | Call sub program ATODV |
| 16. | Call sub program MO |
| 17. | Call sub program IGNITION |
| 18. | Check if flag set for high limit |
| 19. | Call sub program MALF |
| 20. | GOTO Step 9 |
| 21. | Conditional brAnch execute if high limit has failed |

FIGURE 8: ATODF

| Step | Description |
|---|---|
| 1300. | Beginning of ATODF (Sub program to read voltage from infrared diode) |
| 1301. | Make sure port assignments are still loaded |
| 1302. | Select analog to digital channel to read |
| 1303. | Call sub program VALVE |
| 1304. | Is the atod interrupt flag done if not loop |

| | |
|---|---|
| 1305. | Save results into IR register |
| 1306. | Return to call |

FIGURE 9: VALVE

| Step | Description |
|---|---|
| 0060. | Beginning of VALVE (Sub program to turn on and off gas valve) |
| 0061. | Clear internal watch dog timer (if not reset, microprocessor will reset) |
| 0062. | Is there a gas request |
| 0063. | Is the bit set in the real time clock counter (Internal clock built into the microprocessor) |
| 0064. | Turn port pin off |
| 0065. | Turn port pin on |
| 0066. | Return to call |

FIGURE 10: INTRPT

| Step | Description |
|---|---|
| 001. | Beginning in INTRPT (Interrupt program) |
| 002. | Save all data in registers so accumulator and other registers can be used during it's processes |
| 003. | Clear internal watchdog timer (if not reset microprocessor will reset) |
| 004. | Call sub program HEATVENT |
| 005. | Is motor flag set |
| 006. | Call VALVE |
| 007. | Is motor port pin on |
| 008. | Move a variable into the RTCC (real time clock counter) |
| 009. | Turn off port pin for motor |
| 010. | Move the complemented variable into RTCC (this varies the duty cycle for the motor speed) |
| 011. | Turn on motor |
| 012. | Increment file to make timers |
| 013. | Clear all interrupt flags |
| 014. | Reload saved data into registers |
| 015. | Return to call |

FIGURE 11: HEATVENT

| Step | Description |
|---|---|
| 1200. | Beginning of HEATVENT (Control motor speed program) |
| 1201. | Save all data in registers so accumulator and other registers can be used during its process |
| 1202. | Set temp flag for internal use |
| 1203. | Is there a heat request (turn fan on for ignition sequences) |
| 1204. | Is there a high ventilator request |
| 1205. | Is there a low ventilator request |
| 1206. | Clear all flags and turn off motor |
| 1207. | Return to call |
| 1208. | Set flag for low ventilator |

| | |
|---|---|
| 1209. | Is flag set for low speed |
| 1210. | Move constant into register for low speed |
| 1211. | Set bit for low speed |
| 1212. | Return to call |
| 1213. | Is temp flag set |
| 1214. | Return to call |
| 1215. | Clear temp flag |
| 1216. | Read voltage on the motor |
| 1217. | Is voltage high or low |
| 1218. | Decrement the duty register |
| 1219. | Set bit for high ventilator |
| 1220. | Is bit set for high vent |
| 1221. | Move constant into the duty register |
| 1222. | Set flag for high speed |
| 1223. | Return to call |
| 1224. | Is temp flag set |
| 1225. | Return to call |
| 1226. | Clear temp flag |
| 1227. | Look to see if voltage is correct (will have to lower or increase duty cycle to maintain voltage) |
| 1228. | Is voltage too high or too low |
| 1229. | Increment duty cycle |
| 1230. | Return to call |

FIGURE 12: THERMCK

| Step | Description |
|---|---|
| 172800. | Beginning of THERMCK (looking for high limit if open with a flame out) |
| 172801. | Is there a heat request |
| 172802. | Is there a flame out (flame was hot then went out) |
| 172803. | Is the high limit open (temperature sensor on the chamber) |
| 172804. | Return to call |
| 172805. | Is 4 second timer flag set (turn on and off power to gas valve to check if limit is closed) |
| 172806. | Is temp flag set |
| 172807. | Is 1 second timer set (time that gas valve stays on) |
| 172808. | Set temp flag |
| 172809. | Turn on power to gas valve |
| 172810. | Look to see if we have a high limit closed |
| 172811. | Clear hot furnace bit, so it will start a new ignition sequence |
| 172812. | Is hot furnace bit clear |
| 172813. | Clear all flags for new ignition |
| 172814. | Turn power off to gas valve |
| 172815. | Clear temp flag |
| 172816. | Clear gas and igniter power (make sure they're off) |
| 172817. | Return to call |

FIGURE 13: MALF

| Step | Description |
|---|---|
| 1900. | Beginning of MALF (looking for malfunction and flash led error code) |
| 1901. | Clear internal watch dog timer (if not reset, microprocessor will reset) |
| 1902. | Is there a malfunction |
| 1903. | Return to call |
| 1904. | Is there a heat request |
| 1905. | Make temp timer |
| 1906. | Is 5 second timer flag set (timer for fan to run when first coming into program) |
| 1907. | Call for ATODM |
| 1908. | Call for HEATVENT |
| 1909. | Set flag to turn on motor |
| 1910. | Is timer done |
| 1911. | Clear all timers |
| 1912. | Set flag for timer done |
| 1913. | Was there a flame out |
| 1914. | Set bit for flame out |
| 1915. | Clear all registers for new ignition |
| 1916. | Move constants into register for flash code (to indicate the proper error code.no gas, gad igniter etc.) |
| 1917. | Is malf flag set |
| 1918. | Flash led and decrement register |
| 1919. | GOTO top of MALF program |
| 1920. | Clear all bits and flags for flash sequence |
| 1921. | Load set constants into malf bit register |
| 1922. | Return to call |

FIGURE 14: PROOF

| Step | Description |
|---|---|
| 171700. | Beginning of PROOF (Program to prove if Igniter and fan are operating) |
| 171701. | Clear internal watch dog timer (if not reset, microprocessor will reset) |
| 171702. | Is there a heat request |
| 171703. | Clear proof flag |
| 171704. | Return to call |
| 171705. | Is proof flag set |
| 171706. | Return to call |
| 171707. | Is temp flag bit set |
| 171708. | Is temp flag seta for heating up the Igniter |
| 171709. | Turn off motor bit |
| 171710. | Is timer done for heating up Igniter |
| 171711. | GOTO bad Igniter |
| 171712. | Turn on Igniter |
| 171713. | Is Igniter hot |
| 171714. | Return to call |
| 171715. | Set flag for.Igniter is hot |
| 171716. | Clear timers |

| | |
|---|---|
| 171717. | Return to main |
| 171718. | Timer to stabilize Igniter |
| 171719. | Is timer done |
| 171720. | Return to call |
| 171721. | Add constant into voltage register to bust up Igniter level for when the fan turns on (voltage drop when motor turns on) |
| 171722. | Save voltage value on Igniter (so the program can modulate around that voltage) |
| 171723. | Clear flag for IR modulation program |
| 171724. | Set flag for voltage modulation program on Igniter |
| 171725. | Clear timers and set flag for next step |
| 171726. | Return to call |
| 171727. | Set flag to turn on motor |
| 171728. | Call for ATODV |
| 171729. | Call for ATODF |
| 171730. | Is IR level below set point |
| 171731. | Is timer done |
| 171732. | Return to call |
| 171733. | Set malf flag for no air |
| 171734. | Clear all flags for new ignition |
| 171735. | Return to call |

FIGURE 15A: IGNITION

| Step | Description |
|---|---|
| 1700. | Beginning of IGNITION program (start and light the furnace and maintain good flame) |
| 1701. | Clear internal watch dog timer (if not reset, microprocessor will reset) |
| 1702. | Is there a heat request |
| 1703. | Make second timer for operations |
| 1704. | Clear all flags and registers for new ignition sequence |
| 1705. | Was there a flame out |
| 1706. | Clear all timers |
| 1707. | Return to call |
| 1708. | Set flag so program will go through a post purge (fan will run to cool chamber and clear out gas) |
| 1709. | Return to call |
| 1710. | Is there a malfunction |
| 1711. | Turn gas valve and Igniter off |
| 1712. | Was there a flame out |
| 1713. | Set flag for flame out |
| 1714. | Return to call |
| 1715. | Is there a flame out |
| 1716. | Move IR level into register and save |
| 1717. | Call PROOF |
| 1718. | Is there a bad Igniter |
| 1719. | GOTO fail |
| 1720. | Is there air flow |
| 1721. | GOTO fail |
| 1722. | Is proof bit set |
| 1723. | Is time done for proofing bad ignition flame |
| 1724. | Return to main |

| | |
|---|---|
| 1725. | Set flag for malf no gas bad ignition |
| 1726. | Return to call |
| 1727. | Is high limit open or closed |
| 1728. | Call THERMCK |
| 1729. | Was there a flame out |
| 1730. | Start timer for post purge |
| 1731. | Clear all flags for new ignition try |
| 1732. | Return to call |
| 1733. | Flow chart bubble |
| 1734. | Go to Step 1735 |

FIGURE 15B

| Step | Description |
|---|---|
| 1735. | Step 1735 |
| 1736. | Flow chart bubble |
| 1737. | Is flag set for running |
| 1738. | Go to Step 1794 |
| 1739. | Is flag for flame ck set |
| 1740. | Go to Step 1785 |
| 1741. | Is flag for flame? set |
| 1742. | Go to Step 1783 |
| 1743. | If flag for warm up set |
| 1744. | Start timer to stabilize Igniter |
| 1745. | Is timer done |
| 1746. | Start fan and turn on gas valve |
| 1747. | Return to call |
| 1748. | Clear timers |
| 1749. | Set flame? flag |
| 1750. | Return to call |
| 1751. | Is adj-duty flag set |
| 1752. | Turn on the Igniter |
| 1753. | Start timer for Igniter to reach temperature |
| 1754. | Is timer done |
| 1755. | GOTO fail Igniter |
| 1756. | Is Igniter at temperature |
| 1757. | Set flag for warm-up |
| 1758. | Return to call |
| 1759. | Is motor? flag set |
| 1760. | Star timer for prepurge |
| 1761. | Is timer done |
| 1762. | Set flag for adj duty |
| 1763. | Return to call |
| 1764. | Clear all timers and set motor? flag |
| 1765. | Return to call |

FIGURE 15C

| Step | Description |
|---|---|
| 1766. | Step 1766 |
| 1767. | Call ATODV |
| 1768. | Call ATODF |
| 1769. | Is go forward flag set |
| 1770. | Is timer done |
| 1771. | Return to call |
| 1772. | Set go forward flag |
| 1773. | Turn off Igniter |
| 1774. | Clear IR modulation flag |
| 1775. | Save IR level |
| 1776. | Is timer done |
| 1777. | Return to call |
| 1778. | Is flame good |
| 1779. | Set bit for good flame |
| 1780. | Is good flame flag set |
| 1781. | Go to Step 1783 |
| 1782. | GOTO flame fail |

FIGURE 15D

| Step | Description |
|---|---|
| 1783. | Step 1783 |
| 1784. | Set flag for flame - ck |
| 1785. | Go to Step 1785 |
| 1786. | Clear timers |
| 1787. | Turn off IR and MO programs for the Igniter |
| 1788. | Call IR |
| 1789. | Make sure motor speed is correct |
| 1790. | Is timer done |
| 1791. | Return to call |
| 1792. | Clear timers |
| 1793. | Save IR levels into register |
| 1794. | Step 1794 |
| 1795. | Set running flag |
| 1796. | Is high limit open |
| 1797. | Fail high limit flag set |
| 1798. | Call HEATVENT |
| 1799. | Is one-hot-mother flag set |
| 17100. | Flow chart bubble |
| 17101. | Go to Step 17102 |

FIGURE 15E

| Step | Description |
|---|---|
| 17102. | Step 17102 |
| 17103. | Is flame hot looking for low IR levels |
| 17104. | GOTO flame fail |
| 17105. | Is timer flag set |
| 17106. | Is timer done |
| 17107. | Return to call |
| 17108. | Clear all timers and set hot-furn flag |
| 17109. | Return to call |
| 17110. | Is timer done |
| 17111. | Return to call |
| 17112. | Set flags hot-furn and one-hot-mother turn on led |
| 17113. | Is IR level above lowest IR set point |
| 17114. | Move lowest constant into rods register (this is the lowest set value allowed for operations) |
| 17115. | Sub constant from variable and save into rod register as a variable |
| 17116. | Return to call |

FIGURE 15F

| Step | Description |
|---|---|
| 17117. | Flow chart bubble |
| 17118. | Is flame hot |
| 17119. | Is high limit open |
| 17120. | Flow chart bubble |
| 17121. | Turn on led |
| 17122. | Is IR level above lowest constant |
| 17123. | Flow chart bubble |
| 17124. | Is voltage on motor correct |
| 17125. | Flow chart bubble |
| 17126. | Return to call |

FIGURE 15G

| Step | Description |
|---|---|
| 17127. | Flow chart bubble |
| 17128. | Is flame hot |
| 17129. | Set bit for flame out |
| 17130. | Is high limit open |
| 17131. | Set flag for malf high limit |
| 17132. | Clear all error flags (furnace has been running good, set up for three new ignition tries) |
| 17133. | Is fail flag 1 set |
| 17134. | Set fail 2 flag |
| 17135. | Is fail flag 2 set |
| 17136. | Set fail 3flag |

| | |
|---|---|
| 17137. | Is fail 3 flag set |
| 17138. | Set malf flag |
| 17139. | Set lockout flag |
| 17140. | Is lockout flag set |
| 17141. | Clear all malfunction flags for new ignition (not lockout flag) |
| 17142. | Clear timers |
| 17143. | Is high limit open |
| 17144. | Clear all status registers and files |
| 17145. | Return to call |
| 17146. | Flow chart bubble for fail voltage |
| 17147. | Set malf voltage flag |
| 17148. | Is warm-up bit set |
| 17149. | Clear fail thermal flag |
| 17150. | Flow chart bubble |
| 17151. | Set flag for high limit failure |

FIGURE 15H

| Step | Description |
|---|---|
| 17152. | Flow chart bubble for bad Igniter |
| 17153. | Set malf flags and lockout flag |
| 17154. | Return to call |

FIGURE 16: ATODV

| Step | Description |
|---|---|
| 1500. | Beginning ATODV (Program to read the voltage feedback from the Igniter) |
| 1501. | Clear internal watch dog timer (if not reset microprocessor will reset) |
| 1502. | Select analog channel to read |
| 1503. | Cal VALVE |
| 1504. | Is atod reading done |
| 1505. | Save results |
| 1506. | Return to call |

FIGURE 17: ATODM

| Step | Description |
|---|---|
| 1100. | Beginning of ATODM (Program to read the voltage feedback from the motor) |
| 1101. | Clear internal watch dog timer (if not reset, microprocessor will reset) |
| 1102. | Select analog channel to read |
| 1103. | Call VALVE |
| 1104. | Is atod reading done |
| 1105. | Save results |
| 1106. | Return to call |

FIGURE 18: MO

| Step | Description |
|---|---|
| 1600. | Beginning of MO (Program to modulate voltage on the Igniter) |
| 1601. | Clear internal watch dog timer (if not reset, microprocessor will reset) |
| 1602. | Is flag set for program to start |
| 1603. | If volt reading greater than set value |
| 1604. | Turn on Igniter |
| 1605. | Turn off Igniter |
| 1606. | Return to call |

FIGURE 19: IR

| Step | Description |
|---|---|
| 1400. | Beginning of IR (Program to modulate Igniter to keep IR level at set value) |
| 1401. | Clear internal watch dog timer (if not reset, microprocessor will reset) |
| 1402. | Is flag set for program to start |
| 1403. | Is IR reading greater than set value |
| 1404. | Turn off Igniter |
| 1405. | Turn on Igniter |
| 1406. | Return to call |

G:\DATA\WPDOCS2\MKK\76155.PGM

What is claimed and desired to be secured by United States Patent is:

1. An appliance fired by a combustible gas mixture producing combustion flames upon ignition, and comprising:

means for supplying said combustible gas mixture;

hot surface ignition means, composed of solid materials, providing a hot surface to ignite the combustible gas mixture;

means providing a stream of ambient air directed towards and substantially surrounding said hot surface ignition means;

emission means, composed of solid materials heated by the combustion flames of said supply of said gas mixture, for emitting a quantity of radiation proportional to the heating thereof;

means for detecting radiation, said detecting means detecting radiation from the emission means and producing therefrom an emission signal proportional thereto, said detecting means detecting radiation from the hot surface ignition means and producing therefrom a sail switch signal proportional thereto;

derivation means for deriving quantities, said derivation means receiving said emission signal from said detecting means and deriving therefrom an emission quantity, said derivation means receiving said sail switch signal from said detecting means and deriving therefrom an ignition quantity; and means for stopping the supply of said combustible gas mixture when the emission quantity is less than an predetermined combustion quantity, and when the ignition quantity is less than a predetermined ignition quantity.

2. The appliance as defined in claim 1, wherein said hot surface ignition means is substantially positioned away from and out of the combustion flames of said gas mixture.

3. The appliance as defined in claim 1, further comprising means providing electrical resistance heating to said hot surface ignition means so as to achieve a temperature for hot surface ignition of said combustible gas mixture into said combustion flames.

4. An appliance fired by a combustible gas mixture producing flames upon ignition, and comprising:

means for supplying said gas mixture to a combustion chamber;

hot surface ignition means, defined by solid materials and contained within the combustion chamber, providing a hot surface to ignite the combustible gas mixture into combustion flames, and substantially positioned away from the combustion flames so as to not be substantially heated thereby;

thermal emission means, composed of solid materials heated by the combustion flames and contained within the combustion chamber, for emitting therefrom radiation when heated;

detection means for detecting radiation within the combustion chamber and for producing a combustion signal proportional thereto; derivation means for deriving from said combustion signal a first quantity; and;

means providing a stream of ambient air directed towards and substantially surrounding said hot surface ignition means, said detection means producing a sail switch signal when surrounded by said stream of ambient air different from said combustion signal, said derivation means deriving a second quantity from the sail switch signal and comparing the first and second quantities to derive a magnitude proportional to a quantitative measurement of said stream of ambient air.

5. The appliance as defined in claim 4, wherein said hot surface ignition means emits radiation as it undergoes electrical resistance heating, and wherein said detection means detects radiation emitted by said hot surface ignition means and produces a signal proportional to a quantity of radiation emitted therefrom, and wherein said appliance further includes means for providing electrical resistance heating to said hot surface ignition means.

6. A method for monitoring the ongoing combustion of a combustible gaseous mixture in a gas fired appliance comprising the steps of:

heating an ignitor solid material surface to produce therefrom a quantity of radiation proportional to the heating thereof;

detecting the quantity of radiation from said ignitor solid material surface;

producing a signal proportional to the quantity of radiation detected from said ignitor solid material surface;

deriving from said signal proportional to the quantity of radiation detected from said ignitor solid material surface a first quantity;

comparing the first quantity to a predetermined range of ignition quantities; supplying a precombustion stream of said combustible gaseous mixture to the ignitor solid material surface when the first quantity is within the predetermined range of ignition quantities;

heating an emitter solid material surface with combustion flames from a supply of a stream of said combustible gaseous mixture;

detecting a quantity of radiation emitted from the emitter solid material surface heated by the combustion flames;

producing a signal proportional to the quantity of radiation emitted from the emitter solid material surface;

deriving from said signal a second quantity; and directing a stream of ambient air to the combustion flames to shift the position thereof away from the ignitor solid material surface so as to lower the radiation emitted therefrom proportional to the absence of heating thereof by the combustion flames, said directed stream of ambient air shifting the combustion flames toward the emitter solid material surface to thereby increase the radiation emitted therefrom proportional to the heating thereof by the combustion flames.

7. The method as defined in claim 6, further comprising the steps of:

comparing the second quantity to a predetermined range of combustion quantities; and preventing the supply of the stream of said combustible gaseous mixture so as to halt the combustion thereof when the second quantity is outside of the predetermined range of combustion quantities.

8. A method for igniting a combustible gaseous mixture and for monitoring the ongoing combustion thereof comprising the steps of:

heating a first solid material surface within a combustion chamber;

supplying a stream of said combustible gaseous mixture to the heated first surface in the combustion chamber to ignite the combustible gaseous mixture into combustion flames within the combustion chamber;

halting the heating of the first surface;

directing a stream of ambient air to the combustion flames to shift the position thereof away from the heated first surface towards a solid second surface in the combustion chamber to be heated thereby and emit therefrom a quantity of radiation proportional to the heating thereof by the combustion flames;

detecting the quantity of radiation from the combustion chamber;

producing a signal proportional to the quantity of radiation detected from the combustion chamber; and deriving from said signal a first quantity.

9. The method as defined in claim 8, further comprising the steps of:

comparing the first quantity to a predetermined range of combustion quantities; and preventing the step of supplying a stream of said combustible gaseous mixture to the heated second surface while the first quantity is outside of the predetermined range of combustion quantities.

10. The method as defined in claim 8, which prior to the step of supplying a stream of said combustible gaseous mixture to the heated first surface, further comprises the steps of:

detecting a quantity of radiation from the combustion chamber after the step of heating the first surface;

producing a signal proportional to the quantity of radiation from the combustion chamber;

deriving from said signal proportional to the quantity of radiation from the combustion chamber a second quantity;

comparing the second quantity to a predetermined range of ignition quantities reflective of a temperature sufficient to ignite said combustible gaseous mixture; and preventing the step of supplying a stream of said combustible gaseous mixture to the heated first surface while the second quantity is outside of the predetermined range of ignition quantities.

11. The method as defined in claim 8, which prior to the step of supplying a stream of said combustible gaseous mixture to the heated first surface, further comprises the steps of:

directing a stream of ambient air towards and substantially surrounding said heated first surface;

detecting a quantity of radiation emitted from the first surface;

comparing the quantity of radiation emitted by the first surface to a predetermined range of sail switch quantities representative of a quantitative volume measurement of the stream of ambient air engulfing the first surface; and preventing the step of supplying a stream of said combustible gaseous mixture to the heated first surface while the quantity of radiation from said heated first surface is outside of the predetermined range of sail switch quantities.

12. A system for operating a gas fired appliance for combusting into combustion flames a combustible gas mixture and for producing monitoring data corresponding to the combustion of the gas mixture comprising:

(a) a combustion chamber;

(b) a supply of a stream of said combustible gas mixture to the combustion chamber;

(c) a burner element, composed of solid materials, dwelling within the flames of combustion of said combustible gas mixture in said combustion chamber;

(d) a discrete electrical element for detecting radiation from both said burner element and said combustion chamber and for producing a signal proportional to the detected radiation;

(e) a controller electrically connected to said discrete electrical element comprising:

(1) means for amplifying said signal output by said discrete electrical element;

(2) means for converting said amplified signal from an analog to a digital signal form;

(3) digital processor means for processing said digital signal form; data memory means for storing digital data; and (4) program memory means for storing machine-readable instructions utilized by said digital processor means; wherein said digital processor means responds to said machine-readable instructions to electronically derive a quantity proportional to the sensed radiation in the combustion chamber;

(f) a motor driven fan in communication with and controlled by the digital processor means, the motor driven fan operating to entrain a stream of ambient air into the combustion chamber, wherein the digital processor means responds to said machine-readable instructions to electronically determine if the quantity proportional to the sensed radiation in the combustion chamber is outside of a predetermined range of quantities, and controls the operation of the motor driven fan in relation to such comparison to said predetermined range.

13. The system as defined in claim 12, wherein said digital processor means is in communication with a means for supplying the supply of a stream of said combustible gas mixture to the combustion chamber, and wherein the digital processor means responds to said machine-readable instructions to electronically determine if the quantity proportional to the detected radiation in the combustion chamber is outside of said predetermined range of quantities, and controls the operation of the supply means in relation to such comparison to said predetermined range of quantities.

14. The system as defined in claim 12, further comprising an ignitor, wherein said ignitor comprises two electrically conductive rods having an electrically conductive ignition element therebetween electrically heated by an electrical current through said ignition element, said ignition element providing a hot surface ignition for said combustible gas mixture, said burner element being positioned at upon one of the two electrically conductive rods and separated from said ignition element.

15. The system as defined in claim 14, wherein the ignitor is in communication with and controlled by the digital processor means, the electrically conductive rods being operated by the digital processor means to electrically heat the ignition element therebetween so as to ignite the stream of combustible gas mixture into combustion flames in the combustion chamber, wherein the digital processor means responds to said machine-readable instructions to electronically determine if the quantity proportional to the sensed radiation in the combustion chamber is outside of said predetermined range of quantities, and controls the ignitor in relation to such comparison to said predetermined range of quantities.

16. The system as defined in claim 12, further comprising a display means, in communication with the controller, for outputting a visual display of the quantity proportional to the sensed radiation in the combustion chamber.

17. The system as defined in claim 14, wherein the stream of ambient air is directed towards and substantially surrounds said ignition element, said discrete electrical element detecting radiation from the ignition element and producing a sail switch signal proportional to the radiation therefrom when said ignition element is surrounded by said stream of ambient air, said digital processor means:

(a) responding to said machine-readable instructions to electronically derive a quantity proportional to the sail switch signal;

(b) comparing said quantity proportional to the sail switch signal with a predetermined range of sail switch quantities; and (c) controlling the ignitor in relation to such comparison of the sail switch signal to said predetermined range of sail switch quantities.

18. An appliance fired by a combustible gas mixture producing combustion flames upon ignition, and comprising:

(a) means for supplying a stream of said combustible gas mixture; a combustion monitor comprising:

(1) an electrically conductive ignition element electrically heated by an electrical current, said ignition element providing a hot surface ignition for said combustible gas mixture, said ignition element emitting a quantity of radiation proportional to the heating thereof;

(2) a discrete electrical element for detecting radiation emitted from said ignition element and producing an ignition signal proportional thereto; and (3) derivation means for deriving an ignition quantity from said ignition signal;

(b) means providing a stream of ambient air directed towards said ignition element for cooling the ignition element and thereby reducing the quantity of radiation emitted therefrom; and (c) means for controlling the means for supplying a stream of said combustible gas mixture based upon a comparison of the ignition quantity to a predetermined range of ignition quantities.

19. An appliance as defined in claim 18, wherein the combustion monitor further comprises:

an emitter element, composed of solid materials, positioned within the combustion flames of said combustible gas mixture said emitter element emitting a quantity of radiation proportional to the heating thereof, wherein:

(1) said discrete electrical element detects radiation emitted from said emitter element and produces an emitter signal proportional thereto;

(2) said derivation means derives an emitter quantity from said emitter signal; and (3) said means for controlling the means for supplying a stream of said combustible gas mixture controls the means for supplying a stream of said combustible gas mixture based upon a comparison of the emitter quantity to a predetermined range of emitter quantities.

20. Appliance as defined in claim 19, wherein the means for supplying a stream of said combustible gas mixture shifts the position of the combustion flames so that the emitter element is within the combustion flames and the ignition element is away from the combustion flames.

21. An appliance as defined in claim 19, wherein the combustion monitor further comprises:

a pair of electrically conductive rods, said electrically conductive ignition element being electrically heated by an electrical current passing therethrough via said pair of electrically conductive rods, and wherein said discrete electrical element is mounted upon said pair of electrically conductive rods.

22. An appliance as defined in claim 21, wherein the emitter element is positioned upon at least one of the two electrically conductive rods and is separate from said ignition element.

23. An appliance as defined in claim 19, wherein at least one of the emitter element and the ignitor element is substantially composed of a material having a melting point above 1200° F. and selected from the group consisting of aluminum-nickel alloys, iron-chromium-aluminum alloys, and stainless-steel having an aluminum-silicon additive, said material.

24. An appliance as defined in claim 19, wherein at least one of the emitter element and the ignitor element is substantially composed of a material having a composition of between 4 and 5% aluminum, about 22% chromium, and iron.

25. An appliance as defined in claim 19, wherein the means providing a stream of ambient air shifts the position of the combustion flames so that the emitter element is within the combustion flames and the ignition element is away from the combustion flames.

26. An appliance fired by a combustible gas mixture producing combustion flames upon ignition, and comprising:

(a) means for supplying a stream of said combustible gas mixture; a combustion monitor comprising:

(1) an electrically conductive ignition element electrically heated by an electrical current, said ignition element providing a hot surface ignition for said combustible gas mixture, said ignition element emitting a quantity of radiation proportional to the heating thereof;

(2) an emitter element, composed of solid materials, dwelling within the combustion times of said combustible gas mixture said emitter element emitting a quantity of radiation proportional to the heating thereof, (3) a discrete electrical element for detecting radiation emitted from said ignition element and producing an ignition signal proportional thereto, and wherein said discrete electrical element detects radiation emitted from said emitter element and produces an emitter signal proportional thereto; and (4) derivation means for deriving an ignition quantity from said ignition signal, and wherein said derivation means derives an emitter quantity from said emitter signal;

(b) means providing a stream of ambient air directed towards said ignition element for cooling the ignition element and thereby reducing the quantity of radiation emitted therefrom; and (c) means for controlling the means for supplying a stream of said combustible gas mixture based upon a comparison of the ignition quantity to a predetermined range of ignition quantities, and based upon a comparison of the emitter quantity to a predetermined range of emitter quantities.

27. An appliance fired by a combustible gas mixture producing combustion times upon ignition, and comprising:

means for supplying said combustible gas mixture;

means having a hot surface for igniting the combustible gas mixture to produce said combustion times, said hot surface consisting essentially of a metal material;

means for shifting said combustion flames away from said hot surface subsequent to ignition of the combustible mixture into said combustion flames;

means for detecting radiation, said detecting means detecting radiation from the hot surface and producing therefrom an ignition signal proportional thereto;

derivation means for deriving quantities, said derivation means receiving said ignition signal from said detecting means and deriving therefrom an ignition quantity; and means for stopping the supply of said combustible gas mixture when the ignition quantity is less than a selected ignition quantity.

28. The appliance as defined in claim 27, wherein said means for shifting said combustion flames away from said hot surface subsequent to ignition of the combustible mixture into said combustion flames comprises:

(a) a tube having a hollow interior, wherein said hot surface is situated outside of said hollow interior of said tube, said tube comprising:

(i) a gas inlet situated at an end of said tube;

(ii) a flame outlet situated at an end of said tube opposite of said gas inlet;

(iii) an air inlet between said gas inlet and said flame outlet, said air inlet being closer to said gas inlet than said flame outlet; and (iv) a combustible gas mixture outlet between said gas inlet and said time outlet, said combustible gas mixture outlet being:

(A) closer to said flame outlet than said gas inlet;

(B) substantially smaller than said air inlet; and (C) situated proximal to said hot surface;

(b) whereby in an operational mode of said appliance:

(i) said hollow interior of said tube receives:

(A) a gas through said gas inlet; and (B) ambient air through said air inlet;

(ii) said ambient air and said gas combining in said hollow interior of said tube to form said combustible gas mixture;

(iii) at least a portion of said combustible gas mixture exits the tube through the combustible mixture outlet to contact said hot surface;

(iv) said hot surface ignites the combustible gas mixture exiting the hollow interior of the tube through the combustible mixture outlet to produce said combustion flames, and (v) subsequent to ignition of the combustible mixture into said combustion flames, said combustion flames shift away from said hot surface through said combustible mixture outlet to exit said tube through said flame outlet.

29. The appliance as defined in claim 27, wherein said means for shifting said combustion flames away from said hot surface subsequent to ignition of the combustible mixture into said combustion flames comprises means providing a stream of air directed towards and substantially surrounding said hot surface to shift said combustion flames shift away from said hot surface.

30. The appliance as defined in claim 29, wherein said means providing a stream of air directed towards and substantially surrounding said hot surface ignition comprises a motor driven fan operating to entrain a stream of air towards the combustion flames so as to shift said combustion flames shift away from said hot surface.

31. The appliance as defined in claim 27, further comprising:

(a) means providing a stream of air directed towards and substantially surrounding said hot surface to shift said combustion flames shift away from said hot surface for cooling the ignition element and thereby reducing the quantity of radiation emitted therefrom; and (b) means for controlling the means for supplying a stream of said combustible gas mixture based upon a comparison of the ignition quantity to a predetermined range of ignition quantities.

32. An appliance as defined in claim 27, further comprising:

an emitter element, composed of solid materials, positioned within the combustion flames of said combustible gas mixture said emitter element emitting a quantity of radiation proportional to the heating thereof, wherein:

(1) said means for detecting radiation detects radiation emitted from said emitter element and produces an emitter signal proportional thereto;

(2) said derivation means derives an emitter quantity from said emitter signal; and (3) said means for stopping the supply of said combustible gas mixture controls the means for supplying a stream of said combustible gas mixture based upon a comparison of the emitter quantity to a selected range of emitter quantities.

33. An appliance fired by a combustible gas mixture producing combustion flames upon ignition, and comprising:

means for supplying said combustible gas mixture;

means having a hot surface for igniting the combustible gas mixture to produce said combustion flames, said hot surface consisting essentially of a metal material; and means for shifting said combustion flames away from said hot surface subsequent to ignition of the combustible mixture.

34. The appliance as defined in claim 33, further comprising:

means for detecting radiation, said detecting means detecting radiation from the hot surface and producing therefrom an ignition signal proportional thereto;

derivation means for deriving quantities, said derivation means receiving said ignition signal from said detecting means and deriving therefrom an ignition quantity; and means for stopping the supply of said combustible gas mixture when the ignition quantity is less than a selected ignition quantity.

35. The appliance as defined in claim 33, wherein said means for shifting said combustion flames away from said hot surface subsequent to ignition of the combustible mixture comprises:

(a) a tube having a hollow interior, wherein said hot surface is situated outside of said hollow interior of said tube, said tube comprising:

(i) a gas inlet situated at an end of said tube;

(ii) a flame outlet situated at an end of said tube opposite of said gas inlet;

(iii) an air inlet between said gas inlet and said flame outlet, said air inlet being closer to said gas inlet than said flame outlet; and (iv) a combustible gas mixture outlet between said gas inlet and said flame outlet, said combustible gas mixture outlet being:

(A) closer to said flame outlet than said gas inlet;

(B) substantially smaller than said air inlet; and (C) situated proximal to said hot surface;

(b) whereby in an operational mode of said appliance:

(i) said hollow interior of said tube receives:
(A) a gas through said gas inlet; and
(B) ambient air through said air inlet;
(ii) said ambient air and said gas combining in said hollow interior of said tube to form said combustible gas mixture;
(iii) at least a portion of said combustible gas mixture exits the tube through the combustible mixture outlet to contact said hot surface;
(iv) said hot surface ignites the combustible gas mixture exiting the hollow interior of the tube through the combustible mixture outlet to produce said combustion times, and
(v) subsequent to ignition of the combustible mixture into said combustion flames, said combustion flames shift away from said hot surface through said combustible mixture outlet to exit said tube through said flame outlet.

36. The appliance as defined in claim 33, wherein said means for shifting said combustion flames away from said hot surface subsequent to ignition of the combustible mixture into said combustion flames comprises means providing a stream of air directed towards and substantially surrounding said hot surface to shift said combustion flames shift away from said hot surface.

37. The appliance as defined in claim 36, wherein said means providing a stream of air directed towards and substantially surrounding said hot surface ignition means comprises a motor driven fan operating to entrain a stream of air towards the combustion flames so as to shift said combustion flames shift away from said hot surface.

38. The appliance as defined in claim 33, further comprising:

(a) means providing a stream of air directed towards and substantially surrounding said hot surface to shift said combustion flames shift away from said hot surface for cooling the ignition element and thereby reducing the quantity of radiation emitted therefrom; and (b) means for controlling the means for supplying a stream of said combustible gas mixture based upon a comparison of the ignition quantity to a predetermined range of ignition quantities.

39. An appliance as defined in claim 27, further comprising:

an emitter element, composed of solid materials, positioned within the combustion flames of said combustible gas mixture said emitter element emitting a quantity of radiation proportional to the heating thereof, wherein:

(1) said means for detecting radiation detects radiation emitted from said emitter element and produces an emitter signal proportional thereto;

(2) said derivation means derives an emitter quantity from said emitter signal; and (3) said means for stopping the supply of said combustible gas mixture controls the means for supplying a stream of said combustible gas mixture based upon a comparison of the emitter quantity to a selected range of emitter quantities.

* * * * *

UNITED STATES PATENT AND TRADEMARK OFFICE

CERTIFICATE OF CORRECTION

PATENT NO. : 5,632,614

DATED : May 27, 1997

INVENTOR(S) : Franco Consadori; D. George Field; Kevin D. Banta; Gary S. Nichols It is certified that error appears in the above-identified patent and that said Letters Patent is hereby corrected as shown below:

In the Drawings:

Diagram 15G change step 17128 "IS HIGH LIMIT OPEN?" to --IS FLAME HOT?-- as shown on the attached page Col. 4, line 63, after "and" change "it" to --its--

Col. 6, line 16, after "the" change "sallie." to --same.--

Col. 6, line 39, after "Such" change "a" to --an--

Col. 6, line 61, after "the" change "times" to --flames--

Col. 11, line 21, after "embodiments change "oft he" to --of the--

Col. 13, line 9, after "fire" change "box 3" to --box 30--

Col. 13, line 18, after "thermostat" change "leads 52" to --leads 50--

Col. 13, line 20, after "fan" change "leads 42" to --leads 52--

Col. 14, line 28, change "circuit 80" to --circuit 83--

Col. 14, line 46, after "seen in" change "FIG. 5" to --FIG. 5D--

Col. 15, line 25, change "15-A" to --15A--

Col. 15, line 65 after "Appendix A" change "is" to --are--

Col. 15, line 67, change "15-A" to --15A--

UNITED STATES PATENT AND TRADEMARK OFFICE

CERTIFICATE OF CORRECTION

PATENT NO. : 5,632,614

DATED : May 27, 1997

INVENTOR(S) : Franco Consadori; D. George Field; Kevin D. Banta; Gary S. Nichols It is certified that error appears in the above-identified patent and that said Letters Patent is hereby corrected as shown below:

Col. 16, line 1, after "16-19." a new paragraph should begin.

Col. 16, line 1, change "15-A" to --15A--

Col. 16, line 15, after "are" change "carded" to --carried--

Col. 17, line 19, change "FIGS. 7" to --FIG. 7--

Col. 93, step 1728, change "THERMCK" to --THERMICK--

Col. 93, step 1742, change "Go to Step 1783" to --Go to Step 1766--

Col. 103, line 31, after "than" change "an" to --a--

Col. 106, line 46, after "at" delete "upon"

Col. 108, line 37, after "combustion" change "times" to --flames--

Col. 108, line 63, after "combustion" change "times" to --flames--

Col. 108, line 66, after "combustion" change "times," to --flames,--

Col. 109, line 27 after "said" change "time" to --flame--

Signed and Sealed this

Seventh Day of April, 1998

Bruce Lehman

*Attest:*

BRUCE LEHMAN

*Attesting Officer*

*Commissioner of Patents and Trademarks*